US006390604B2

(12) United States Patent
Kashino et al.

(10) Patent No.: US 6,390,604 B2
(45) **Date of Patent: *May 21, 2002**

(54) LIQUID DISCHARGE METHOD AND APPARATUS EMPLOYING A MOVABLE INELASTIC SEPARATION FILM

(75) Inventors: Toshio Kashino, Chigasaki; Hiroyuki Ishinaga, Tokyo; Aya Yoshihira; Kiyomitsu Kudo, both of Yokohama; Yoshie Asakawa, Hotaka-machi; Yoichi Taneya, Yokohama; Hiroyuki Sugiyama, Sagamihara; Satoshi Shimazu, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/289,759

(22) Filed: Apr. 12, 1999

Related U.S. Application Data

(62) Division of application No. 08/870,389, filed on Jun. 6, 1997, now Pat. No. 5,943,074.

(30) Foreign Application Priority Data

Jun. 7, 1996 (JP) ..... 8-145683
Jun. 2, 1997 (JP) ..... 9-144013

(51) Int. Cl.[7] ..... B41J 2/05

(52) U.S. Cl. ..... 347/54; 347/65

(58) Field of Search ..... 347/54, 65, 56, 347/63

(56) References Cited

U.S. PATENT DOCUMENTS

| | | | | |
|---|---|---|---|---|
| 4,480,259 | A | 10/1984 | Kruger et al. | 347/63 |
| 4,994,825 | A | 2/1991 | Saito et al. | |
| 5,208,604 | A | 5/1993 | Watanabe et al. | |
| 5,278,585 | A | 1/1994 | Karz et al. | 347/65 |
| 5,389,957 | A | 2/1995 | Kimura et al. | |
| 5,467,112 | A | 11/1995 | Mitani | 347/1 |
| 5,589,858 | A | 12/1996 | Kadowaki et al. | |

(List continued on next page.)

FOREIGN PATENT DOCUMENTS

| | | | |
|---|---|---|---|
| EP | 0 583 116 | 2/1994 | |
| EP | 0 721 841 A2 | 7/1996 | B41J/2/05 |
| GB | 2 274 727 | 8/1994 | |
| JP | 55-81172 | 6/1980 | B41J/3/04 |
| JP | 57024262 A | 2/1982 | |
| JP | 59-26270 | 2/1984 | B41J/3/04 |

(List continued on next page.)

*Primary Examiner*—Robert Beatty
(74) *Attorney, Agent, or Firm*—Fitzpatrick, Cella, Harper & Scinto

(57) ABSTRACT

A liquid discharge method for discharging a liquid through a discharge port for discharging the liquid utilizing a bubble by displacing a movable separation film for always substantially separating a first liquid flow path in communication with said discharge port for discharging the liquid from a second liquid flow path comprising a bubble-generating region for generating the bubble in said liquid, on the upstream side of said discharge port with respect to flow of the liquid in said first liquid flow path, comprises a step of displacing a downstream portion of said movable separation film toward said discharge port relatively more than an upstream portion of said movable separation film with respect to a direction of the flow of the liquid.

13 Claims, 43 Drawing Sheets

U.S. PATENT DOCUMENTS

| | | | | |
|---|---|---|---|---|
| 5,602,576 | A | 2/1997 | Murooka et al. | |
| 5,684,519 | A | * 11/1997 | Matoba et al. | 347/54 |
| 5,790,311 | A | 8/1998 | Togino | 359/630 |
| 5,821,962 | A | * 10/1998 | Kudo et al. | 347/65 |
| 5,825,383 | A | * 10/1998 | Abe et al. | 347/54 |
| 5,943,074 | A | * 8/1999 | Kashino | 347/54 |
| 6,007,187 | A | * 12/1999 | Kashino et al. | 347/65 |
| 6,028,709 | A | 2/2000 | Takahashi | 359/630 |

FOREIGN PATENT DOCUMENTS

| | | | |
|---|---|---|---|
| JP | 61069467 A | 4/1986 | |
| JP | 61-59911 | 12/1986 | H03K/17/687 |
| JP | 61-59914 | 12/1986 | H03M/1/50 |
| JP | 02179748 A | 7/1990 | |
| JP | 4-329148 | 11/1992 | B41J/2/05 |
| JP | 5-229122 | 9/1993 | B41J/2/05 |

* cited by examiner

:AREA WHERE FILM IS SHIFTABLE UPWARD

:AREA WHERE FILM IS SHIFTABLE DOWNWARD

LIQUID DISCHARGE METHOD AND APPARATUS EMPLOYING A MOVABLE INELASTIC SEPARATION FILM

CROSS-REFERENCE TO RELATED APPLICATION

This application is a division of U.S. patent application Ser. No. 08/870,389, filed on Jun. 6, 1997 now U.S. Pat. No. 5,943,074.

BACKGROUND OF THE INVENTION

1. Field of the Invention

The present invention relates to a liquid discharge method and a liquid discharge apparatus for discharging a desired liquid by generation of bubble by thermal energy or the like and, more particularly, to a liquid discharge method and a liquid discharge apparatus using a movable separation film arranged to be displaced utilizing the generation of bubble.

It is noted here that "recording" in the present invention means not only provision of an image having meaning, such as characters or graphics, on a recorded medium, but also provision of an image having no meaning, such as patterns, on the medium.

2. Related Background Art

One of the conventionally known recording methods is an ink jet recording method for imparting energy of heat or the like to ink so as to cause a state change accompanied by a quick volume change of ink (generation of bubble), thereby discharging the ink through an discharge port by acting force based on this state change, and depositing the ink on a recorded medium, thereby forming an image, which is so called as a bubble jet recording method. A recording apparatus using this bubble jet recording method is normally provided, as disclosed in the bulletin of Japanese Patent Publication No. 61-59911 or in the bulletin of Japanese Patent Publication No. 61-59914, with an discharge port for discharging the ink, an ink flow path in communication with this discharge port, and a heat-generating member (an electrothermal transducer) as energy generating means for discharging the ink located in the ink flow path.

The above recording method permits high-quality images to be recorded at high speed and with low noise and in addition, because a head for carrying out this recording method can have discharge ports for discharging the ink as disposed in high density, it has many advantages; for example, high-resolution recorded images or even color images can be obtained readily by compact apparatus. Therefore, this bubble jet recording method is used in many office devices including printers, copiers, facsimile machines, and so on in recent years and further is becoming to be used for industrial systems such as textile printing apparatus.

On the other hand, the conventional bubble jet recording method sometimes experienced occurrence of deposits due to scorching of ink on the surface of the heat-generating member, because heating was repeated in a contact state of the heat-generating member with the ink. In the case of the liquid to be discharged being a liquid easy to deteriorate due to heat or a liquid not easy to generate a sufficient bubble, good discharge is not achieved in some cases by formation of bubble by direct heating with the aforementioned heat-generating member.

Against it, the present applicant proposed a method for discharging an discharge liquid by generating a bubble in a bubble-generating liquid by thermal energy through a flexible film for separating the bubble-generating liquid from the discharge liquid, in the bulletin of Japanese Laid-open Patent Application No. 55-81172. The configuration of-the flexible film and the bubble-generating liquid in this method is such that the flexible film is formed in a part of nozzle, whereas the bulletin of Japanese Laid-open Patent Application No. 59-26270 discloses the configuration using a large film for separating the entire head into upper and lower spaces. This large film is provided for the purpose of being placed between two plates forming the liquid paths and thereby preventing the liquids in the two liquid paths from being mixed with each other.

On the other hand, countermeasures for giving a specific feature to the bubble-generating liquid itself and taking bubble-generating characteristics into consideration include the one disclosed in the bulletin of Japanese Laid-open Patent Application No. 5-229122 using a lower-boiling-point liquid than the boiling point of the discharge liquid, and the one disclosed in the bulletin of Japanese Laid-open Patent Application No. 4-329148 using a liquid having electric conductivity as the bubble-generating liquid.

However, the liquid discharge methods using the conventional separation film as described above are the structure of Just separating the bubble-generating liquid from the discharge liquid or simply an improvement of the bubble-generating liquid itself, and they are not at the level of practical use yet.

SUMMARY OF THE INVENTION

The present inventors have researched mainly liquid droplets discharged in discharge of liquid droplet using the separation film and came to the conclusion that the efficiency of liquid discharge based on formation of bubble by thermal energy was lowered because of intervention of change of the separation film, so that it had not been applied to practical use.

Therefore, the present inventors came to study the liquid discharge method and apparatus that achieved the higher level of liquid discharge while taking advantage of the effect by the separation function of the separation film.

The present invention has been accomplished during this study and provides breakthrough liquid discharge method and apparatus that are improved in the discharge efficiency for discharge of liquid droplet and that stabilize and enhance the volume of liquid droplet discharged or the discharge rate.

The present invention can improve the discharge efficiency in the liquid discharge method and apparatus using a liquid discharging head comprising a first liquid flow path for discharge liquid in communication with an discharge port, a second liquid flow path containing a bubble-generating liquid so as to be capable of supplying or moving the bubble-generating liquid and having a bubble-generating region, and a movable separation film for separating the first and second liquid flow paths from each other, and having a region of displacement of the movable separation film upstream of the discharge port with respect to a direction of flow of the discharge liquid in the first liquid flow path.

Particularly, the present inventors found out the following problem. When the space becoming the bubble-generating region is a small space, that is, when the bubble-generating region itself, though being formed on the upstream side of the discharge port with respect to the direction of flow of the discharge liquid, has the width and length close to those of the heat-generating portion, in generation of bubble in the bubble-generating region, the movable film is displaced with generation of bubble only in the perpendicular direction to the direction of discharge of the discharge liquid, so that sufficient discharge rates cannot be attained. This resulted in the problem that the efficient discharge operation was not achieved. Noting that the cause of this problem is that the same bubble-generating liquid is always used repetitively only in the small space closed, the present invention also realizes the efficient discharge operation.

A first object of this invention involves a liquid discharging method for discharging liquid from a discharge port by displacing, using a bubble generated at a bubble generation area for generating the bubble in the liquid, a movable separation film. That film substantially separates from each other a first liquid flow path communicating with the discharge port for discharging the liquid and a second liquid flow path having the bubble generation area. This method includes the steps of generating a bubble in the bubble generation area and displacing the movable separation film substantially without stretch in accordance with the generating step to discharge liquid from the discharge port.

A second object of this invention concerns a liquid discharging apparatus having a first liquid flow path communicating with a discharge port for discharging liquid, a second liquid flow path having a bubble generation area for generating a bubble in the liquid, and a movable separation film substantially separating the first from the second liquid flow paths. The movable separation film is displaced by the bubble generated at the bubble generation area to discharge the liquid from the discharge port, and the movable separation film is a thin film without substantial elasticity.

Another object of the present invention is to provide a liquid discharge method and a liquid discharge apparatus employing the structure for substantially separating or, more preferably, perfectly separating the discharge liquid from the bubble-generating liquid by the movable film, wherein in deforming the movable film by force generated by pressure of bubble generation to transmit the pressure to the discharge liquid, the pressure is prevented from leaking to upstream and the pressure is guided toward the discharge port, whereby high discharge force can be achieved without degrading the discharge efficiency.

Still another second object of the present invention is to provide a liquid discharge method and a liquid discharge apparatus that can decrease an amount of deposits depositing on the heat-generating member and that can discharge the liquid at high efficiency without thermally affecting the discharge liquid, by the above-stated structure.

Yet another object of the present invention is to provide a liquid discharge method and a liquid discharge apparatus having wide freedom of selection, irrespective of the viscosity of the discharge liquid and the formulation of material thereof.

For achieving the above objects, the present invention provides a liquid discharge method having a step of displacing a movable separation film for always substantially separating a first liquid flow path in communication with an discharge port for discharging a liquid from a second liquid flow path comprising a bubble-generating region for generating a bubble in said liquid, on the upstream side of said discharge port with respect to flow of the liquid in said first liquid flow path, said liquid discharge method comprising a step of displacing a downstream portion of said movable separation film toward said discharge port relatively more than an upstream portion of said movable separation film with respect to a direction of the flow of said liquid.

Here, if the above step is carried out after midway of a growing process of bubble, a further increase will be achieved in the discharge amount. If the above step is carried out continuously substantially after the initial stage of the growing process of bubble, a further increase will be achieved in the discharge rate.

The displacement of the movable separation film can be controlled as desired or as stabilized by direction regulating means for regulating the displacement of the movable separation film in the above step.

Specific structures for carrying out the above displacing step, which is the feature of the present invention as described above, include those in the embodiments described hereinafter. In addition, the present invention involves all that can achieve the above displacing step by other structures included in the technological concept of the present invention.

Further, if the shape of the movable separation film is preliminarily determined or if the movable separation film is provided with a slack portion, the movable separation film itself will not need to extend with generation of bubble, which raises the discharge efficiency and which permits the movable separation film itself to regulate the displacement.

If the displacement of the movable separation film is regulated by regulating the growth of bubble in the second liquid flow path, direct action will take place on the bubble itself, whereby the displacement of the movable separation film is regulated from the initial stage of generation of bubble.

Here is a typical example of the structure of the device according to the present invention. The "direction regulating means" stated herein includes all arrangements of the movable separation film itself (for example, distribution of modulus of elasticity, a combination of a deformably extending portion with a non-deforming portion, etc.), all arrangements of the second liquid flow path itself (control of the heat-generating member or the bubble itself, etc.), an additional member acting on the movable separation film, structures of the first liquid flow path, and all combinations thereof. The typical structure according to the present invention is a liquid discharge apparatus having at least a first liquid flow path in communication with an discharge port for discharging a liquid, a second liquid flow path comprising a bubble-generating region for generating a bubble in said liquid, and a movable separation film for always substantially separating said first liquid flow path from said second liquid flow path, said liquid discharge apparatus comprising direction regulating means for displacing said movable separation film on an upstream side of said discharge port with respect to flow of the liquid in said first liquid flow path and for displacing a downstream portion of said movable separation film toward said discharge port relatively more than an upstream portion of said movable separation film with respect to a direction of the flow of said liquid.

In the present invention of the above structure, the movable separation film provided above the bubble-generating region is displaced into the first liquid flow path with generation and growth of the bubble in the bubble-generating region. On that occasion, the downstream portion of the movable separation film is displaced into the first liquid flow path more than the upstream portion of the movable separation film, so that the pressure due to the generation of bubble is guided toward the discharge port of the first liquid flow path. By this, the liquid in the first liquid flow path is discharged efficiently through the discharge port with generation of bubble.

In the case wherein the deforming region of the movable separation film is provided with a slack portion, the slack portion is displaced in a curved shape with generation and growth of bubble and, therefore, the volume of the bubble acts more effectively on deformation of the movable separation film, thereby discharging the liquid more efficiently.

In the case wherein a movable member is provided adjacent to the movable separation film on the first liquid flow path side of the movable separation film and wherein the movable member has a free end on the downstream side of an upstream edge of a portion facing the bubble-generating region and a fulcrum on the upstream side of the free end, the displacement of the movable separation film to the second liquid flow path is suppressed upon collapse of bubble, which prevents movement of liquid to upstream, thereby improving refilling characteristics and decreasing crosstalk.

When the shape of the second liquid flow path is one capable of readily guiding the pressure due to the bubble generated in the bubble-generating region to the discharge port, the liquid in the first liquid flow path can be discharged through the discharge port efficiently by generation of bubble.

When the shape of the first liquid flow path is such that the height is smaller upstream than downstream, the downstream portion of the movable separation film is displaced more into the first liquid flow path than the upstream portion of the movable separation film, whereby the pressure due to the generation of bubble is guided to the discharge port of the first liquid flow path, so that the liquid in the first liquid flow path is discharged efficiently through the discharge port by the generation of bubble.

When the movable separation film is formed so that the thickness thereof on the downstream side is smaller than that on the upstream side, the movable separation film becomes easier to deform toward the discharge port with growth of bubble in the bubble-generating region, whereby the liquid in the first liquid flow path is discharged efficiently through the discharge port.

When the movable separation film is provided with a convex portion which projects into the second liquid flow path upon non-generation of bubble and which projects into the first liquid flow path upon generation of bubble, the pressure due to generation of bubble in the bubble-generating region is guided to the discharge port of the first liquid flow path by the convex portion, whereby the liquid in the first liquid flow path is discharged efficiently through the discharge port by the generation of bubble. Further, if the volume inside the convex portion is smaller than the maximum expansion volume of the bubble generated in the bubble-generating region, the amount of displacement of the convex portion will be kept constant even with dispersion in the expansion volume of bubble due to the discharge characteristics of liquid, thus realizing good discharge without dispersion between nozzles.

BRIEF DESCRIPTION OF THE DRAWINGS

FIGS. 4A, 4B and 4C are cross-sectional views along the flow path direction to show the first embodiment of the liquid discharge method and the liquid discharge apparatus according to the present invention, wherein FIG. 4A is a drawing to show a state upon non-generation of bubble, FIG. 4B is a drawing to show a state upon generation of bubble (upon discharge), and FIG. 4C is a drawing to show a state upon collapse of bubble;

FIGS. 5A and 5B are longitudinal cross-sectional views each to show a structural example of the liquid discharge apparatus of the present invention, wherein FIG. 5A is a drawing to show a device with a protecting film described hereinafter and FIG. 5B is a drawing to show a device without the protecting film;

FIGS. 9A, 9B and 9C are drawings to show the second embodiment of the liquid discharge apparatus according to the present invention, wherein FIG. 9A is a cross-sectional view along the flow path direction upon non-generation of bubble, FIG. 9B is a cross-sectional view along the flow path direction upon generation of bubble, and FIG. 9C is a drawing obtained by observing the first flow path from the second flow path side of the drawing shown in FIG. 9A;

FIGS. 11A and 11B are drawings to show characteristics of the movable separation film used in the liquid discharge apparatus of the present invention, wherein FIG. 11A is a drawing to show the relation between pressure f of a bubble generated in the bubble-generating region and stress F of the movable separation film against it and FIG. 11B is a graph to show characteristics of the stress F of the movable separation film against volume change of bubble shown in FIG. 11A;

FIGS. 12A and 12B are drawings to show the fourth embodiment of the liquid discharge apparatus according to the present invention, wherein FIG. 12A is a cross-sectional view along the flow path direction and FIG. 12B is a top plan view;

FIGS. 13A and 13B are cross-sectional views along the flow path direction to show the fifth embodiment of the liquid discharge method and the liquid discharge apparatus according to the present invention, wherein FIG. 13A is a drawing to show a state upon non-generation of bubble and FIG. 13B. is a drawing to show a state upon generation of bubble (upon discharge);

FIGS. 16A, 16B and 16C are drawings for explaining the relationship of location,between thick portion 205*a* of movable separation film 205 and second liquid flow path 204 in the liquid discharge apparatus shown in FIGS. 13A, 13B to FIGS. 15A, 15B, 15C and 15D, wherein FIG. 16A is a top plan view of the thick portion 205*a*, FIG. 16B is a top plan view of the second liquid flow path 204 without the movable separation film 205, and FIG. 16C is a schematic view to show the relation of location between the thick portion 205*a* and the second liquid flow path 204 as superimposed;

FIGS. 20A and 20B are cross-sectional views along the flow path direction to show the sixth embodiment of the liquid discharge method and the liquid discharge apparatus according to the present invention, wherein FIG. 20A is a drawing to show a state upon non-generation of bubble and FIG. 20B is a drawing to show a state upon generation of bubble (upon discharge);

FIGS. 22A and 22B are cross-sectional views along the flow path direction to show the seventh embodiment of the liquid discharge apparatus according to the present invention, wherein FIG. 22A is a drawing to show a state upon non-generation of bubble and FIG. 22B is a drawing to show a state upon generation of bubble (upon discharge);

FIGS. 23A and 23B are cross-sectional views along the flow path direction to show the eighth embodiment of the liquid discharge method and the liquid discharge apparatus according to the present invention, wherein FIG. 23A is a drawing to show a state upon non-generation of bubble and FIG. 23B is a drawing to show a state upon generation of bubble (upon discharge);

FIGS. 24A and 24B are cross-sectional views along the flow path direction to show the ninth embodiment of the liquid discharge method and the liquid discharge apparatus according to the present invention, wherein FIG. 24A is a drawing to show a state upon non-generation of bubble and FIG. 24B is a drawing to show a state upon generation of bubble (upon discharge);

FIGS. 25A, 25B and 25C are drawings to show the tenth embodiment of the liquid discharge apparatus according to the present invention, wherein FIG. 25A is a cross-sectional view along the flow path direction to show a state upon non-generation of bubble, FIG. 25B is a cross-sectional view along the flow path direction to show a state upon generation of bubble (upon discharge), and FIG. 25C is a drawing to show the structure of the second liquid flow path;

FIGS. 26A and 26B are cross-sectional views along the flow path direction to show the eleventh embodiment of the liquid discharge method and the liquid discharge apparatus according to the present invention, wherein FIG. 26A is a drawing to show a state upon non-generation of bubble and FIG. 26B is a drawing to show a state upon generation of bubble (upon discharge);

FIGS. 27A and 27B are cross-sectional views along the flow path direction to show modifications of the liquid discharge apparatus shown in FIGS. 26A and 26B, wherein FIG. 27A is a drawing to show a modification in which a part of the second liquid flow path wall is formed in a stepped shape and FIG. 27B is a drawing to show a modification in which a part of the second liquid flow path wall is formed in a curved shape;

FIGS. 28A and 28B are drawings to show the twelfth embodiment of the liquid discharge apparatus according to the present invention, wherein FIG. 28A is a top plan view to show the positional relation between the second liquid flow path and the heat-generating member and FIG. 28B is a perspective view of the positional relation of FIG. 28A and wherein the discharge port is disposed on the left side in FIG. 28A;

FIGS. 30A, 30B and 30C are drawings to show modifications of the liquid discharge apparatus shown in FIGS. 28A and 28B, wherein FIG. 30A is a drawing to show a modification in which the width of the second liquid flow path near the heat-generating member gradually increases stepwise from upstream to downstream, FIG. 30B is a drawing to show a modification in which the width of the second liquid flow path near the heat-generating member gradually increases in a curved shape from upstream to downstream, and FIG. 30C is a drawing to show a modification in which the width of the second liquid flow path near the heat-generating member gradually increases in an opposite curved shape to that of FIG. 30B from upstream to downstream;

FIGS. 32A, 32B, 32C and 32D are drawings for explaining the relation of location among the heat-generating member, the second liquid flow path, and a movable separation film displacement regulating member in the liquid discharge apparatus shown in FIGS. 31A to 31E, wherein FIG. 32A is a drawing to show the positional relation between the heat-generating member and the second liquid flow path, FIG. 32B is a top plan view of the movable separation film displacement regulating member, FIG. 32C is a drawing to show the relation of location among the heat-generating member, the second liquid flow path, and the movable separation film displacement regulating member, and FIG. 32D is a drawing to show displaceable areas of the movable separation film;

FIGS. 40A and 40B are cross-sectional views along the flow path direction to show the eighteenth embodiment of the liquid discharge method and the liquid discharge apparatus according to the present invention, wherein FIG. 40A is a drawing to show a state upon non-generation of bubble and FIG. 40B is a drawing to show a state upon generation of bubble;

FIGS. 42A and 42B are cross-sectional, schematic views along the flow path direction to show the twentieth embodiment of the liquid discharge method and the liquid discharge apparatus according to the present invention, wherein FIG. 42A is a drawing to show a state upon non-discharge and FIG. 42B is a drawing to show a state upon discharge;

FIGS. 43A and 43B are cross-sectional views along the flow path direction to show the twenty first embodiment of the liquid discharge apparatus according to the present invention, wherein FIG. 43A is a lateral, cross-sectional view and FIG. 43B is a longitudinal, cross-sectional view;

FIGS. 44A and 44B are cross-sectional views along the flow path direction to show the twenty second embodiment of the liquid discharge apparatus according to the present invention, wherein FIG. 44A is a lateral, cross-sectional view and FIG. 44B is a longitudinal, cross-sectional view;

FIGS. 46A and 46B are cross-sectional views along the flow path direction to show the twenty third embodiment of the liquid discharge apparatus according to the present invention, wherein FIG. 46A is a lateral, cross-sectional view and FIG. 46B is a longitudinal, cross-sectional view;

FIGS. 48A and 48B are drawings to show a like form of the movable separation film shown in FIGS. 46A and 46B and FIGS. 47A, 47B, 47C, 47D and 47E, wherein FIG. 48A is a lateral, cross-sectional view and FIG. 48B is a longitudinal, cross-sectional view and wherein the discharge port is located on the left side in the drawing;

FIGS. 49A and 49B are cross-sectional views along the flow path direction to show the twenty fourth embodiment of the liquid discharge apparatus according to the present invention, wherein FIG. 49A is a lateral, cross-sectional view and FIG. 49B is a longitudinal, cross-sectional view;

FIGS. 50A and 50B are cross-sectional views along the flow path direction to show the twenty fifth embodiment of the liquid discharge apparatus according to the present invention, wherein FIG. 50A is a lateral, cross-sectional view and FIG. 50B is a longitudinal, cross-sectional view;

FIGS. 52A and 52B are cross-sectional views along the flow path direction to show an application example wherein the present invention is applied to an arrangement of the discharge port disposed on the downstream side of the bubble-generating region so that the liquid is discharged in the direction perpendicular to the flow direction of the liquid in the first liquid flow path, wherein FIG. 52A is a drawing to show a state upon non-generation of bubble and FIG. 52B is a drawing to show a state upon generation of bubble.

DESCRIPTION OF THE PREFERRED EMBODIMENTS

Figure 1A:
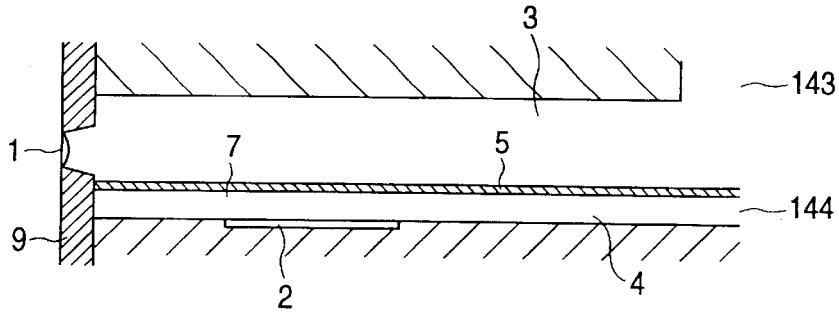
FIGS. 1A, 1B, 1C, 1D and 1E are cross-sectional views along the flow path direction for explaining the first embodied form of the liquid discharge method according to the present invention.

The embodiments of the present invention will be described, but, prior thereto, the basic concept of discharge, which is the basis of the present invention, will be described with two embodied forms.

FIGS. 1A to 1E through FIGS. 3A to 3C are drawings for explaining embodiments of the liquid discharge method according to the present invention, wherein the discharge port is disposed in the end area of the first liquid flow path and wherein the displaceable area of the movable separation film capable of being displaced according to growth of the bubble generated is present on the upstream side of the discharge port (with respect to the flow direction of the discharge liquid in the first liquid flow path). The second liquid flow path contains the bubble-generating liquid or is filled with the bubble-generating liquid (preferably, capable of being refilled therewith and more preferably, capable of moving the bubble-generating liquid) and the second liquid flow path has a generating region of bubble.

In the present example, this bubble-generating region is also located in the upstream area of the discharge port with respect to the flow direction of the discharge liquid described above. In addition, the separation film is longer than the electrothermal transducer forming the bubble-generating region and has a movable area and a fixed portion, not illustrated, between the upstream edge of the electrothermal transducer with respect to the above flow direction and a common liquid chamber of the first liquid flow path, preferably, at the upstream edge. Accordingly, the substantially movable range of the separation film is understood from FIGS. 1A to 1E through FIGS. 3A to 3C.

The states of the movable separation film in these figures are elements representing all obtained from the elasticity and the thickness of the movable separation film itself, or another additional structure.

(First embodied form)

FIGS. 1A to 1E are cross-sectional views along the flow path direction for explaining the first embodied form (an example having the displacing step of the present invention from midway of the discharge step) of the liquid discharge method according to the present invention.

In the present form, as shown in FIGS. 1A to 1E, the inside of the first liquid flow path 3 in direct communication with the discharge port 1 is filled with a first liquid supplied from first common liquid chamber 143 and the second liquid flow path 4 having the bubble-generating region 7 is filled with the bubble-generating liquid for generating the bubble as receiving the thermal energy from the heat-generating member 2. The movable separation film 5 for separating the first liquid flow path 3 from the second liquid flow path 4 is provided between the first liquid flow path 3 and the second liquid flow path 4. The movable separation film 5 is fixed in close contact with orifice plate 9, so that the liquids in the respective liquid flow paths are prevented from mixing herein with each other.

When displaced by the bubble generated in the bubble-generating region 7, the movable separation film 5 normally has no directivity or rather, the displacement thereof sometimes proceeds to the common liquid chamber with higher freedom of displacement.

In the present invention, noting this motion of the movable separation film 5, the movable separation film 5 itself is provided with means for regulating the direction of displacement, acting thereon directly or indirectly, whereby the displacement (movement, expansion, or extension, or the like) of the movable separation film 5 caused by the bubble is directed toward the discharge port.

In the initial state shown in FIG. 1A, the liquid inside the first liquid flow path 3 is retracted to near the discharge port 1 by capillary attraction. In the present form, the discharge port 1 is located downstream of the projection area of the heat-generating member 2 onto the first liquid flow path 3 with respect to the flow direction of the liquid in the liquid flow path 3.

Figure 1B:
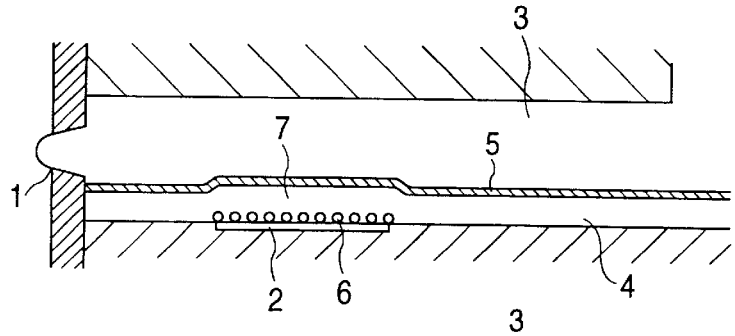

In this state, when the thermal energy appears in the heat-generating member 2 (a heating resistor member having the shape of 40 $\mu$m×105 $\mu$m in the present form), the heat-generating member 2 is heated quickly and the surface in contact with the second liquid in the bubble-generating region 7 heats the second liquid to generate bubbles (FIG. 1B). The bubbles 6 generated by this heating generation of bubble are those based on the film boiling phenomenon as described in U.S. Pat. No. 4,723,129 and are generated together all over the surface of the heat-generating member as carrying very high pressure. The pressure generated at this time propagates in the form of pressure wave in the second liquid in the second liquid flow path 4 to act on the movable separation film 5, thereby displacing the movable separation film 5 and starting discharge of the first liquid in the first liquid flow path 3.

Figure 1C:
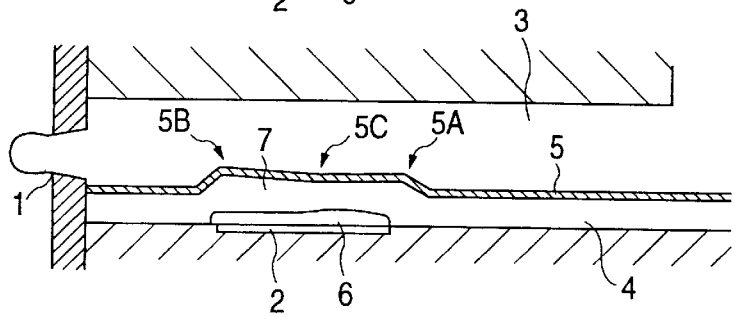
Figure 1D:
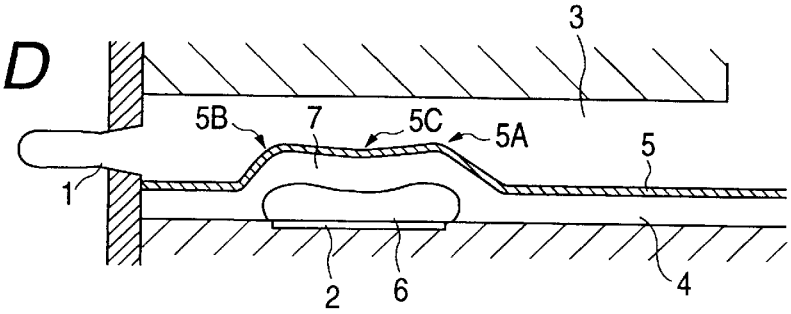

As the bubbles 6 generated over the entire surface of the heat-generating member 2 grow quickly, they become of a film shape (FIG. 1C). The expansion of the bubble 6 by the very high pressure in the initial stage of generation further displaces the movable separation film 5, which promotes discharge of the first liquid in the first liquid flow path 3 through the discharge port Further growth of the bubble 6 thereafter increases the displacement of the movable separation film 5 (FIG. 1D). Up to the state shown in FIG. 1D, the movable separation film 5 continues extending so that displacement of upstream portion 5A becomes nearly equal to displacement of downstream portion 5B with respect to central portion 5C of the area of the movable separation film facing the heat-generating member 2.

Figure 1E:
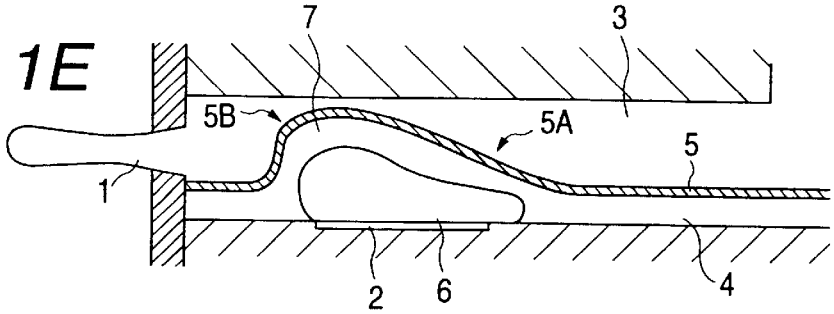

After that, with further growth of the bubble 6, the bubble 6 and the movable separation film 5 having continuously been displaced are displaced so that the downstream portion 5B is displaced relatively greater toward the discharge port than the upstream portion 5A, whereby the first liquid in the first liquid flow path 3 is moved directly toward the discharge port 1 (FIG. 1E).

The discharge efficiency is increased further by the step wherein the movable separation film 5 is displaced toward the discharge port on the downstream side so that the liquid is directly moved toward the discharge port as described above. Further, movement of the liquid to upstream is decreased relatively, which is effective in refilling of liquid (replenishment from upstream) into the nozzle, especially into the displacement area of the movable separation film 5.

When the movable separation film 5 itself is also displaced toward the discharge port so as to change from FIG. 1D to FIG. 1E, as shown in FIG. 1D and FIG. 1E, the discharge efficiency and refilling efficiency described above can be further increased and it causes transport of the first liquid in the projection area of the heat-generating member 2 in the first liquid flow path 3 toward the discharge port, thus increasing the discharge amount.

(Second embodied form)

FIGS. 2A to 2E are cross-sectional views along the flow path direction for explaining the second embodied form (an example having the displacing step of the present invention from the initial stage) of the liquid discharge method according to the present invention.

The present form also has the basically similar structure to the first embodied form, wherein, as shown in FIGS. 2A to 2E, the inside of the first liquid flow path 13 in direct communication with the discharge port 11 is filled with the first liquid supplied from the first common liquid chamber 143 and the second liquid flow path 14 having the bubble-generating region 17 is filled with the bubble-generating liquid for generating the bubble as receiving the thermal energy from the heat-generating member 12. The movable separation film 15 for separating the first liquid flow path 13 from the second liquid flow path 14 is provided between the first liquid flow path 13 and the second liquid flow path 14. The movable separation film 15 is fixed in close contact with the orifice plate 19, so that the liquids in the respective liquid flow paths are prevented from mixing herein with each other.

Figure 2A:
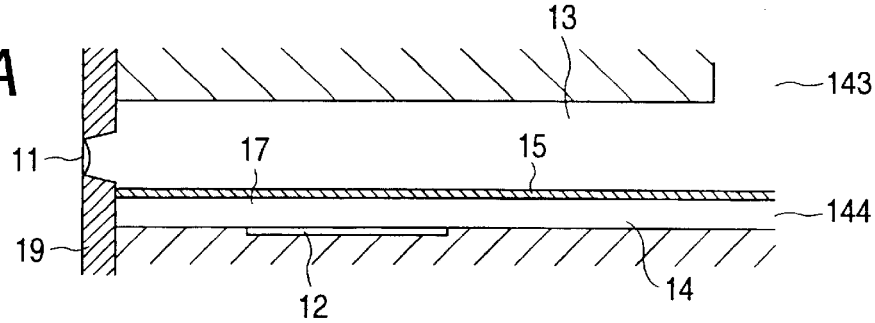
FIGS. 2A, 2B, 2C, 2D and 2E are cross-sectional views along the flow path direction for explaining the second embodied form of the liquid discharge method according to the present invention.

In the initial state shown in FIG. 2A, the liquid in the first liquid flow path 13 is retracted to near the discharge port 11 by capillary attraction, similarly as in FIG. 1A. In the present form, the discharge port 11 is located on the downstream side of the projection area of the heat-generating member 12 onto the first liquid flow path 13.

Figure 2B:
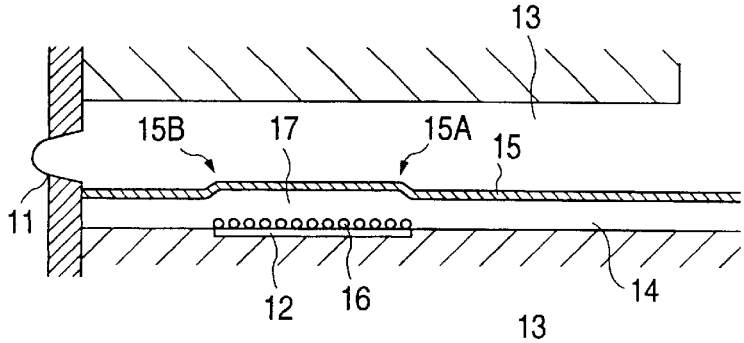

In this state, when the thermal energy appears in the heat-generating member 12 (a heating resistor member having the shape of 40 $\mu$m×115 $\mu$m in the present form), the heat-generating member 12 is heated quickly and the surface in contact with the second liquid in the bubble-generating region 17 heats the second liquid to generate bubbles (FIG. 2B). The bubbles 16 generated by this heating generation of bubble are those based on the film boiling phenomenon as described in U.S. Pat. No. 4,723,129 and are generated together all over the surface of the heat-generating member as carrying very high pressure. The pressure generated at this time propagates in the form of pressure wave in the second liquid in the second liquid flow path 14 to act on the movable separation film 15, thereby displacing the movable separation film 15 and starting discharge of the first liquid in the first liquid flow path 13.

Figure 2C:
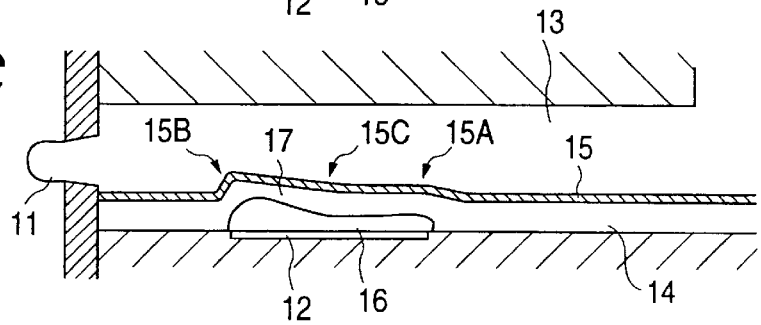

As the bubbles 16 generated over the entire surface of the heat-generating member 12 grow quickly, they become of a film shape (FIG. 2C). The expansion of the bubble 16 by the very high pressure in the initial stage of generation further displaces the movable separation film 15, which promotes discharge of the first liquid in the first liquid flow path 13 through the discharge port 11. At this time, as shown in FIG. 2C, the movable separation film 15 is displaced from the initial stage so that in the movable area, displacement of the downstream portion 15B is relatively greater than that of the upstream portion 15A. This efficiently moves the first liquid in the first liquid flow path 13 toward the discharge port 11 from the beginning.

Figure 2D:
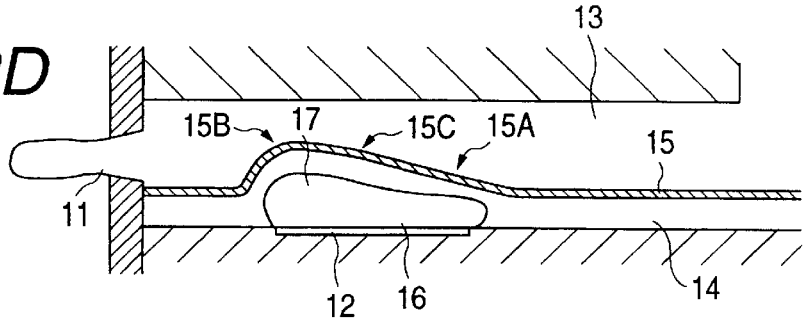

After that, with further growth of the bubble 16, the displacement of film 15 and the growth of bubble is promoted from the state of FIG. 2C, and thus the displacement of the movable separation film 15 also increases therewith (FIG. 2D). Especially, the downstream portion 15B of the movable area is displaced greater toward the discharge port than the upstream portion 15A and the central portion 15C, whereby the first liquid in the first liquid flow path 13 is directly accelerated to move toward the discharge port. In addition, since displacement of the upstream portion 15A is not much during the whole process, movement of the liquid to upstream is decreased.

Therefore, the discharge efficiency, especially the discharge rate, can be increased and it is advantageous in refilling of liquid to nozzle and in stabilization of the volume of droplet of discharge liquid.

Figure 2E:
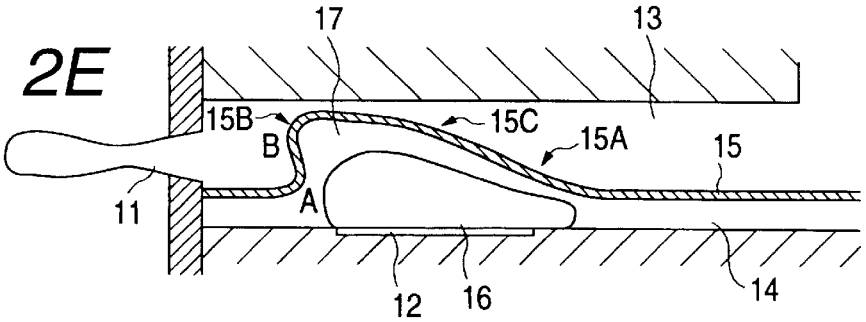

After that, with further growth of the bubble 16, the downstream portion 15B and central portion 15C of the movable separation film 15 are further displaced to extend toward the discharge port, thereby achieving the above-stated effect, i.e., the increase in the discharge efficiency and discharge rate (FIG. 2E). Especially, in the shape of the movable separation film 15 in this case, displacement and extension in the width direction of the liquid flow path also increases in addition to that shown by the cross-sectional shape, so that an increase of the action area takes place to move the first liquid in the first liquid flow path 13 toward the discharge port, which synergistically increases the discharge efficiency. Particularly, the displacement shape of the movable separation film 15 at this time will be referred to as a nose shape, because it is similar to the shape of human nose. This nose shape includes the "S" shape, as shown in FIG. 2E, wherein point B, which was located upstream in the initial state, is located downstream of point A, which was located downstream in the initial state, and the shape, as shown in FIG. 1E, wherein these points A, B are located at equivalent positions.

(Form of displacement of the movable separation film)

Figure 3A:
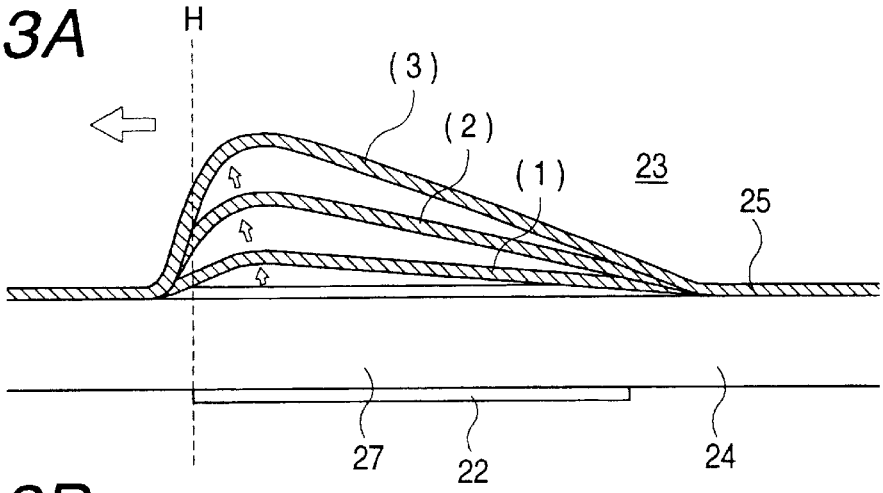
FIGS. 3A, 3B, and 3C are cross-sectional views along the flow path direction for explaining steps of displacement of the movable separation film in the liquid discharge method of the present invention.
Figure 3B:
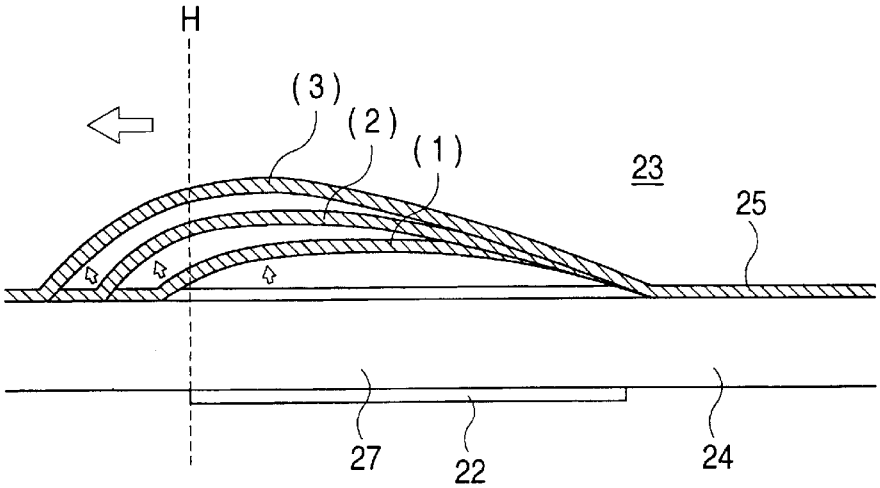
Figure 3C:
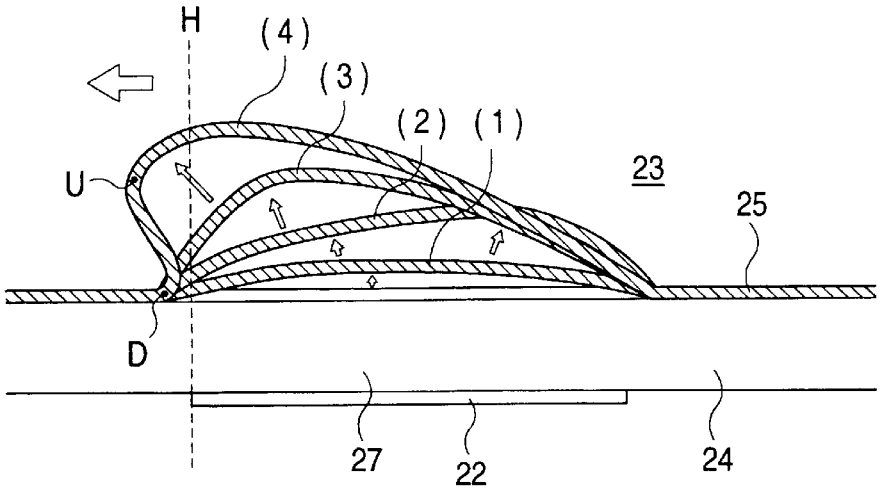

FIGS. 3A to 3C are cross-sectional views along the flow path direction for explaining steps of displacement of the movable separation film in the liquid discharge method of the present invention.

In the present form, especially, since description is given as focusing attention on the movable range and the change of displacement of the movable separation film, the bubble, the first liquid flow path, and the discharge port are not illustrated but the basic structure in either figure is such that the bubble-generating region 27 is near the projection area of the heat-generating member 22 in the second liquid flow path 24 and that the second liquid flow path 24 and the first liquid flow path 23 are always substantially separated from each other by the movable separation film 25, specifically, throughout the period of from the beginning to the end of displacement. With respect to the border at the downstream edge (denoted by line H in the drawing) of the heat-generating member 22, the discharge port is provided on the downstream side while the supply portion of the first liquid is on the upstream side. In this form and after, "upstream" and "downstream" are defined based on the central portion of the movable range of the movable separation film with respect to the flow direction of the liquid in the flow path.

The example shown in FIG. 3A has from the beginning the step wherein the movable separation film 25 is displaced in the order of (1), (2) and (3) in the drawing from the initial state whereby the downstream side is displaced more than the upstream side. Especially, it enhances the discharge efficiency and has such action that the downstream displacement causes such movement as to push the first liquid in the first liquid flow path 23 toward the discharge port, thus increasing the discharge rate. In FIG. 3A the above movable range is substantially constant.

In the example shown in FIG. 3B, as the movable separation film 25 is displaced in the order of (1), (2) and (3) in the drawing, the movable range of the movable separation film 25 moves or expands toward the discharge port. In this form the upstream side of the above movable range is fixed. In this example, since the downstream side is displaced more than the upstream side and since the growth of bubble itself is directed toward the discharge port, the discharge efficiency can be enhanced furthermore.

In the example shown in FIG. 3C, displacement of the movable separation film 25 is such that the upstream side and the downstream side are displaced equally or the upstream side is displaced a little larger from the initial state (1) to the state indicated by (2) in the drawing, but with further growth of the bubble as shown from (3) to (4) in the drawing, the downstream side is displaced more than the upstream side. This can also move the first liquid in the upstream part of the movable range toward the discharge port, whereby the discharge efficiency can be increased and the discharge amount can also be increased.

Further, in the step indicated by in FIG. 3C, since a certain point U on the movable separation film 25 is displaced toward the discharge port farther than point D, which was located downstream thereof in the initial state, the discharge efficiency is improved furthermore by the inflated portion projecting to the discharge port. This shape will be called the nose shape as described above.

The present invention includes the liquid discharge methods having the steps as described above, but it is noted that the examples shown in FIGS. 3A to 3C are not always independent of each other and that the present invention also includes steps having components of the respective examples. The step having the nose shape can be introduced not only to the example shown in FIG. 3C, but also to the examples shown in FIGS. 3A and 3B. The movable separation film used in FIGS. 3A to 3C may be preliminarily provided with a slack portion, irrespective of whether it has capability of expansion and contraction. It is also noted that the thickness of the movable separation film in the drawing does not have specific, dimensional meaning.

Embodiments

The embodiments of the present invention will be described with reference to the drawings.

The "direction regulating means" in the present specification is directed to at least either one of means based on the structure or feature of the movable separation film itself, the action or arrangement relation of the bubble-generating means to the movable separation film, the flow resistance relation around the bubble-generating region, a member directly or indirectly acting on the movable separation film, and a member (means) for regulating displacement or extension of the movable separation film, and includes all for achieving the "displacement" defined by the present application. Accordingly, the present invention includes embodiments having a plurality of (two or more) the above direction regulating means, of course. Although the embodiments described below will not show an arbitrary combination of plural direction regulating means clearly, it is noted that the present invention is by no means intended to be limited to the following embodiments.

(Embodiment 1)

Figure 4A:
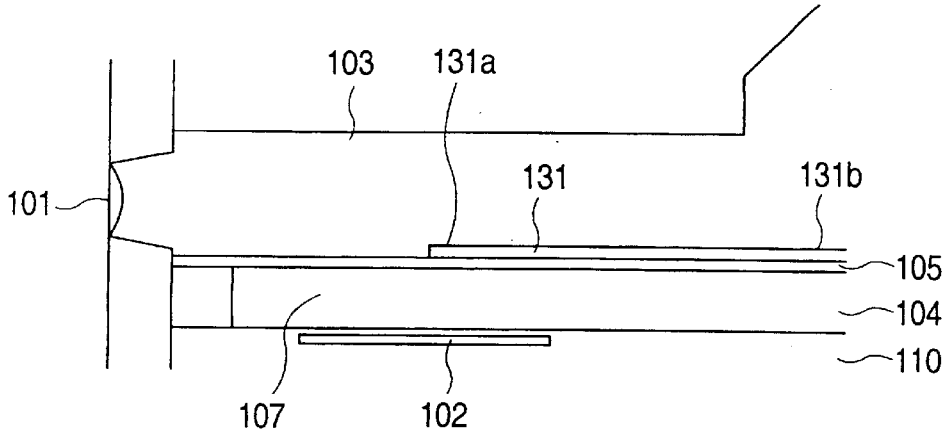
Figure 4B:
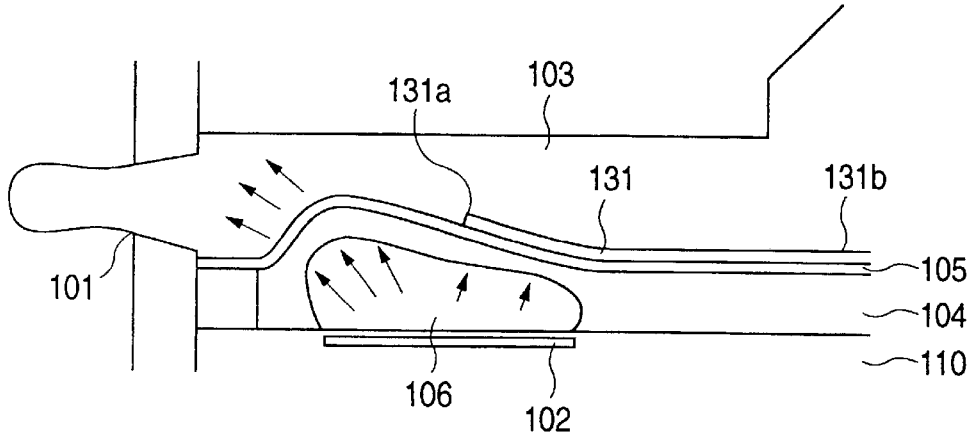
Figure 4C:
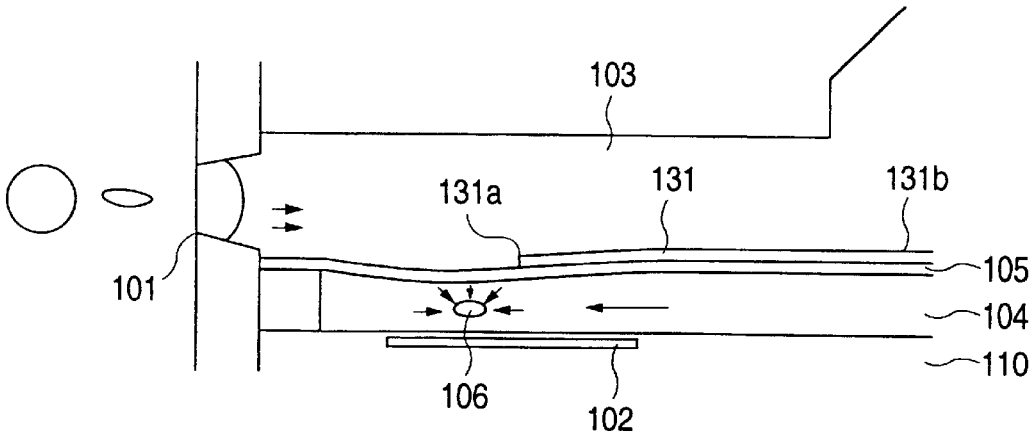

FIGS. 4A to 4C are cross-sectional views along the flow path direction to show the first embodiment of the liquid discharge method and the liquid discharge apparatus according to the present invention, wherein FIG. 4A is a drawing to show the state upon non-generation of bubble, FIG. 4B is a drawing to show the state upon generation of bubble (upon discharge), and FIG. 4C is a drawing to show the state upon collapse of bubble.

In the present embodiment, as shown in FIG. 4A, the second liquid flow path 104 for bubble-generating liquid is provided on substrate 110 provided with heat-generating member 102 (a heating resistor member in the shape of 40 $\mu$m×105 $\mu$m in the present embodiment) for giving the thermal energy for generating the bubble to the liquid, and the first liquid flow path 103 for discharge liquid in direct communication with the discharge port 101 is provided above it. The movable separation film 105 made of a thin film with elasticity is provided between the first liquid flow path 103 and the second liquid flow path 104, so that the movable separation film 105 separates the discharge liquid in the first liquid flow path 103 from the bubble-generating liquid in the second liquid flow path 104. The movable separation film 105 is disposed as opposed to the heat-generating member 102 and faces at least a part of the bubble-generating region 107 in which the bubble is generated by heat in the heat-generating member 102. Further provided on the first liquid flow path 103 side of the movable separation film 105 is movable member 131 as the direction regulating means adjacent to the movable separation film 105, and the movable member 131 has free end 131*a* above the bubble-generating region 107 and fulcrum 131*b* on the upstream side of the free end 131*a*.

The free end 131*a* of the movable member 131 does not always have to be located in the portion facing the bubble-generating region 107, but it may be one provided downstream of fulcrum 131*b* and arranged to guide extension of the movable separation film 105 toward the discharge port 101. More preferably, it is opposed through the movable separation film 105 to at least a part of the heat-generating member 102, whereby the displacement of the movable separation film 105 can be controlled efficiently. Particularly, if the movable member 131 is arranged so that the free end 131*a* thereof is located at the position opposite to the movable separation film 105 on the downstream side of the center of the area of the heat-generating member 102 or the bubble-generating region 107, the movable member 131 can make expanding components perpendicular to the heat-generating member 102 concentrated toward the discharge port 101, thus greatly improving the discharge efficiency. In the case wherein the free end 131*a* is provided on the downstream side of the bubble-generating region 107, the discharge efficiency is improved, because the free end 131*a* is displaced more greatly so as to displace the movable separation film 105 more toward the discharge port 101.

Now, when heat is generated in the heat-generating member 102, the bubble 106 is generated in the bubble-generating region 107 on the heat-generating member 102, whereby the movable separation film 105 is displaced into the first liquid flow path 103. Here, the displacement of the movable separating film 105 is regulated by the movable member 131. Since the movable member 131 is provided with the free end 131*a* above the bubble-generating region 107 and the fulcrum 131*b* upstream thereof, the movable separation film 105 is displaced more on the downstream side than on the upstream side (FIG. 4B). Namely, the desired deformation and displacement can be attained on a stable basis by the direction regulating means for regulating the direction of displacement of the movable separation film.

In this way, with growth of bubble 106 the downstream portion of the movable separation film 105 is displaced greater, whereby the growth of bubble 106 is transmitted mainly toward the discharge port 101, so that the discharge liquid in the first liquid flow path 103 is discharged efficiently from the discharge port 101.

After that, the bubble 106 contracts to return the movable separation film 105 to the position before displacement.

In this case, the movable separation film 105 is shifted to the second liquid flow path 104 from the position before displacement by the pressure caused by the disappearance of bubbles. However, in this embodiment, the displacement of the movable separation film 105 to the second liquid flow path is restricted since the movable separation film 105 is integrally provided on the movable member 131 (FIG. 4C).

Therefore, the pressure at the side of the movable member 131 is limited to decrease so that the retraction of the meniscus is restricted and the refilling properties are improved.

The movable member 131 restricts movement of the liquid to upstream, thereby achieving the effects including an improvement in the refilling characteristics, decrease of crosstalk, and so on.

As described above, the structure of the present embodiment can discharge the discharge liquid, using the different liquids as the discharge liquid and as the bubble-generating liquid. Therefore, the present embodiment can well discharge even high-viscosity liquid such as polyethylene glycol, which was insufficient to generate the bubble with application of heat and which thus had insufficient discharge force heretofore, by supplying this liquid to the first liquid flow path 103 and supplying another liquid with good bubble-generating property (for example, a mixture of ethanol:water=4:6 having the viscosity of about 1 to 2 cP) as the bubble-generating liquid to the second liquid flow path 104.

By selecting the bubble-generating liquid from those that form no deposits of scorching or the like on the surface of the heat-generating member with application of heat, bubble generation can be stabilized and good discharge can be carried out.

Further, since the structure of the liquid discharge apparatus according to the present invention also achieves the effects as described in the above-stated embodiment, the liquid such as the high-viscosity liquid can be discharged at further higher discharge efficiency and under further higher ejection force.

In the case of the liquid weak against heat being used, if this liquid is supplied as the discharge liquid to the first liquid flow path 103 and another liquid resistant against thermal deterioration and easy to generate the bubble is supplied to the second liquid flow path 104, the thermally weak liquid can be discharged at high discharge efficiency and under high discharge force as described above without thermally damaging the liquid weak against heat.

Next explained is the configuration of the element substrate 110 in which the heat-generating member 102 for supplying heat to the liquid is mounted.

Figure 5A:
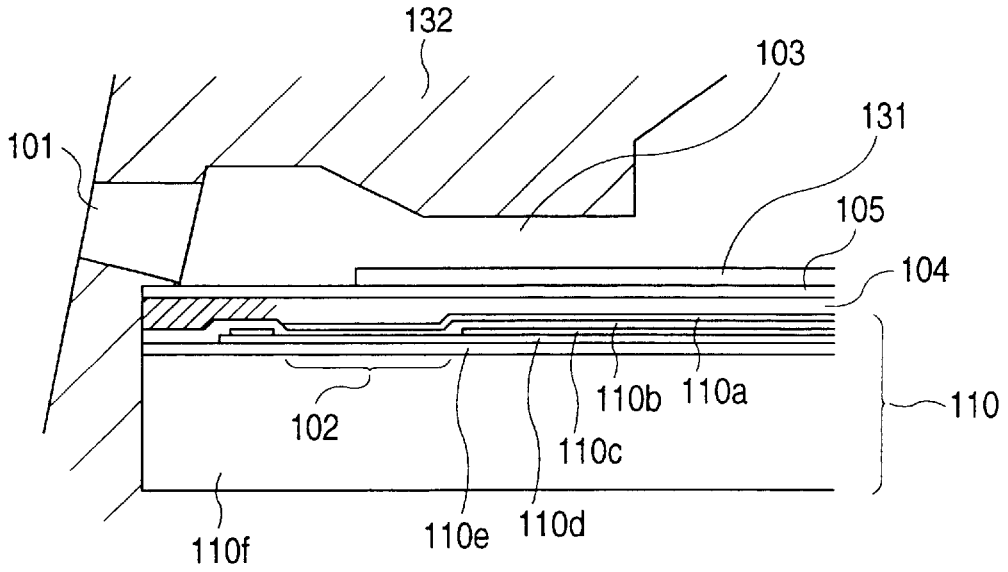
Figure 5B:
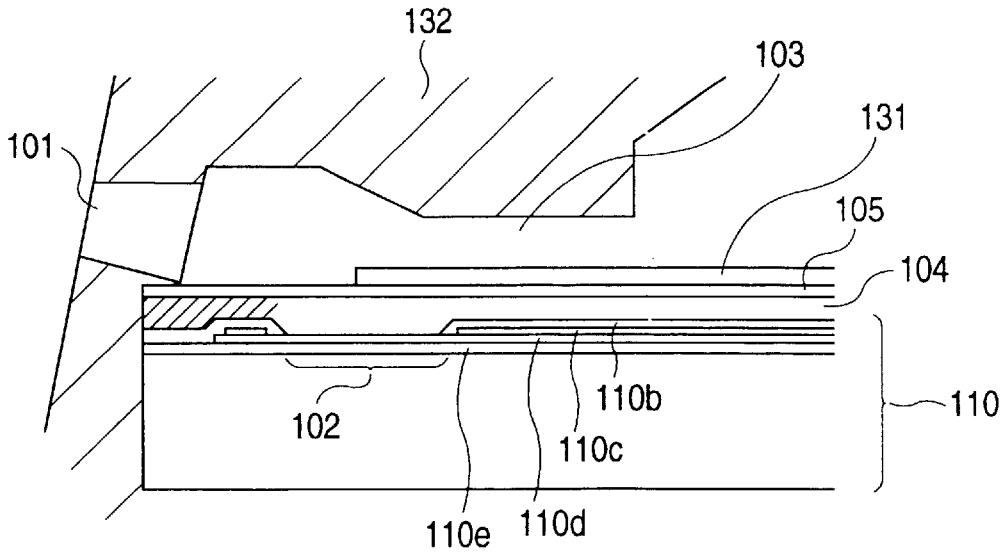

FIGS. 5A and 5B show longitudinal, cross-sectional views each to show a structural example of the liquid discharge apparatus according to the present invention, wherein FIG. 5A shows the device with a protection film as detailed hereinafter and FIG. 5B the device without the protection film.

Above the element substrate 110 there are provided the second liquid flow path 104, the movable separation film 105 to be a partition wall, the movable member 131, the first liquid flow path 103, and a grooved member 132 having a groove for forming the first liquid flow path 103, as shown in FIGS. 5A and 5B.

The element substrate 110 has patterned wiring electrodes 110*c*0.2–1.0 μm thick of aluminum (Al) or the like and patterned electric resistance layer 110*d* 0.01–0.2 μm thick of hafnium boride ($HfB_2$), tantalum nitride (TaN), tantalum aluminum (TaAl) or the like constituting the heat-generating member on silicon oxide film or silicon nitride film 110*e* for electric insulation and thermal accumulation formed on base 110*f* of silicon or the like. The resistance layer 110*d* generates heat when a voltage is applied to the resistance-layer 110*d* through the two wiring electrodes 110*c* so as to let an electric current flow in the resistance layer 110*d*. A protection layer 110*b* of silicon dioxide, silicon nitride, or the like 0.1–0.2 μm thick is provided on the resistance layer 110*d* between the wiring electrodes 110*c*, and in addition, an anti-cavitation layer 110*a* of tantalum or the like 0.1–0.6 μm thick is formed thereon to protect the resistance layer 110*d* from various liquids such as ink.

Particularly, the pressure and shock wave generated upon bubble generation and collapse is so strong that the durability of the oxide film hard and relatively fragile is considerably deteriorated. Therefore, a metal material such as tantalum (Ta) or the like is used as a material for the anti-cavitation layer 110*a*.

The protection layer stated above may be omitted depending upon the combination of liquid, liquid flow path structure, and resistance material, an example of which is shown in FIG. 5B.

The material for the resistance layer not requiring the protection layer may be, for example, an iridium-tantalum-aluminum (Ir-Ta-Al) alloy or the like. Particularly, since the present invention uses the liquid for generation of bubble separated from the discharge liquid and being suitable for generation of bubble, it is advantageous in the case without the protection layer as described.

Thus, the structure of the heat-generating member 102 in the foregoing embodiment may be that including only the resistance layer 110*d* (heat-generating portion) between the wiring electrodes 110*c*, or may be that including the protection layer for protecting the resistance layer 110*d*.

In this embodiment, the heat-generating member 102 has a heat generation portion having the resistance layer which generates heat in response to the electric signal. Without having to be limited to this, any means well suffices if it creates the bubble enough to discharge the discharge liquid, in the bubble-generating liquid. For example, the heat generation portion may be in the form of a photothermal transducer which generates heat upon receiving light such as laser, or a heat-generating element having the heat generation portion which generates heat upon receiving high frequency wave.

Function elements such as a transistor, a diode, a latch, a shift register, and so on for selectively driving the electrothermal transducer may also be integrally built in the aforementioned element substrate 110 by the semiconductor fabrication process, in addition to the electrothermal transducer comprised of the resistance layer 110*d* constituting the heat-generating portion and the wiring electrodes 110*c* for supplying the electric signal to the resistance layer 110*c*.

Figure 6:
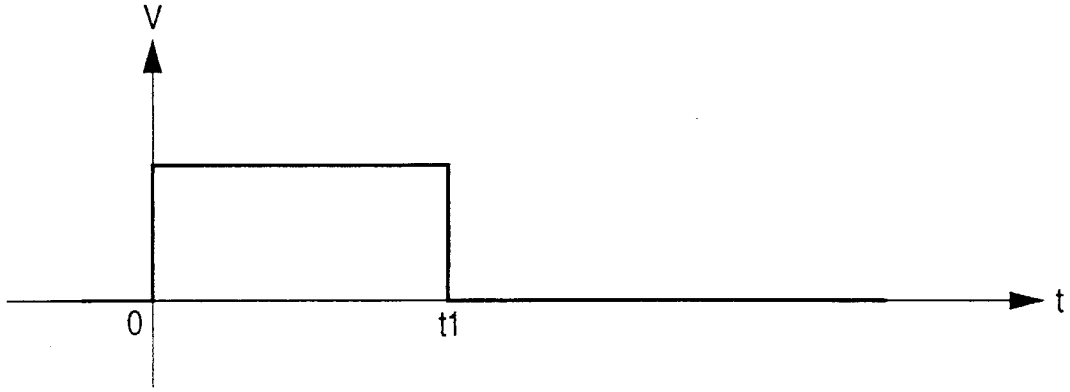
FIG. 6 is a drawing to show the waveform of voltage applied to an electric resistance layer shown in FIGS. 5A and 5B.

In order to drive the heat generation portion of the electrothermal transducer on the above-described element substrate 110 so as to discharge the liquid, a rectangular pulse is applied through the wiring electrodes 110*c* to the resistance layer 110*d* to quickly heat the resistance layer 110*d* between the wiring electrodes 110*c*. FIG. 6 is a diagram to show the waveform of the voltage applied to the resistance layer 110*d* shown in FIGS. 5A and 5B.

With the liquid discharge apparatus of the foregoing embodiment, the electric signal was applied to the heat-generating member under the conditions: the voltage 24 V, the pulse width 7 μsec, the electric current 150 mA, and the frequency 6 kHz to drive it, whereby the ink as the liquid was discharged through the discharge port, based on the operation described above. However, the conditions of the driving signal in the present invention are not limited to the above, but any driving signal may be used if it can properly generate the bubble in the bubble-generating liquid.

Next described is a structural example of the liquid discharge apparatus which has two common liquid chambers, while decreasing the number of components, which can introduce the different liquids to the respective common liquid chambers while well separating from each other, and which can decrease the cost.

Although FIGS. 5A and 5B and FIG. 6 were described in the form of Embodiment 1, the structure of the substrate can also be applied to the present invention including the following embodiments and other forms.

Figure 7:
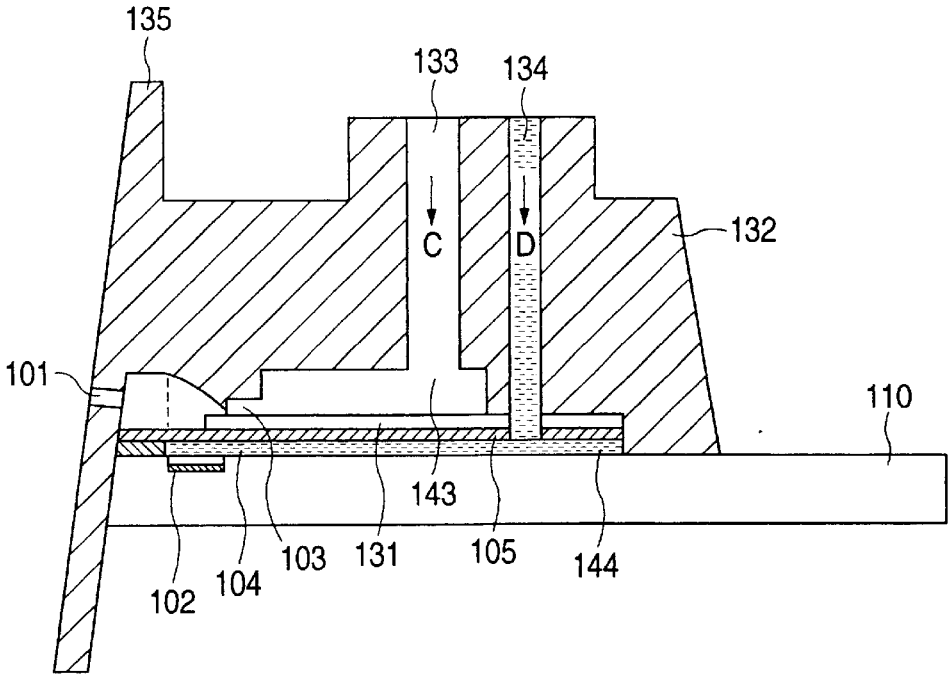
FIG. 7 is a schematic drawing to show a structural example of the liquid discharge apparatus according to the present invention.

FIG. 7 is a schematic diagram to show a structural example of the liquid discharge apparatus according to the present invention, wherein the same constituents as those in the example shown in FIGS. 4A to 4C and FIGS. 5A and 5B are denoted by the same reference numbers, and the detailed description thereof is thus omitted herein.

The grooved member 132 in the liquid discharge apparatus shown in FIG. 7 is schematically comprised of orifice plate 135 having discharge ports 101, a plurality of grooves forming a plurality of first liquid flow paths 103, and a recessed portion forming first common liquid chamber 143, communicating in common with the plurality of first liquid flow paths 103, for supplying the liquid (the discharge liquid) to the first liquid flow path 103.

The plurality of first liquid flow paths 103 are formed by joining the movable separation film 105, at least a part of which is bonded to the movable member 131, to the lower part of the grooved member 132. The grooved member 132 is provided with first liquid supply path 133 running from the top thereof into the first common liquid chamber 143 and is also provided with second liquid supply path 134 running from the top thereof through the movable member 131 and movable separation film 105 into the second common liquid chamber 144.

The first liquid (the discharge liquid) is supplied through the first liquid supply path 133 and the first common liquid chamber 143 to the first liquid flow paths 103, as indicated by arrow C in FIG. 7, while the second liquid (the bubble-generating liquid) is supplied through the second liquid supply path 134 and the second common liquid chamber 144 to the second liquid flow paths 104, as indicated by arrow D in FIG. 7.

The present embodiment is arranged so that the second liquid supply path 134 is disposed in parallel to the first liquid supply path 133, but the present invention is not limited to this. For example, any arrangement may be applied as long as the second liquid supply path 134 is formed through the movable separation film 105 disposed outside the first common liquid chamber 143 and in communication with the second common liquid chamber 144.

The thickness (the diameter) of the second liquid supply path 134 is determined in consideration of the supply amount of the second liquid and the shape of the second liquid supply path 134 does not always have to be circular, but may be rectangular.

The second common liquid chamber 144 can be formed by partitioning the grooved member 132 by the movable separation film 105. As a method of the formation, the second common liquid chamber 144 and the second liquid flow paths 104 may be formed by making the frame of common liquid chamber and the walls of the second liquid paths of a dry film on the substrate 110 and bonding the substrate 110 to a combined body of the movable separation film 105 with the grooved member 132 to which the movable separation film 105 is fixed.

Figure 8:
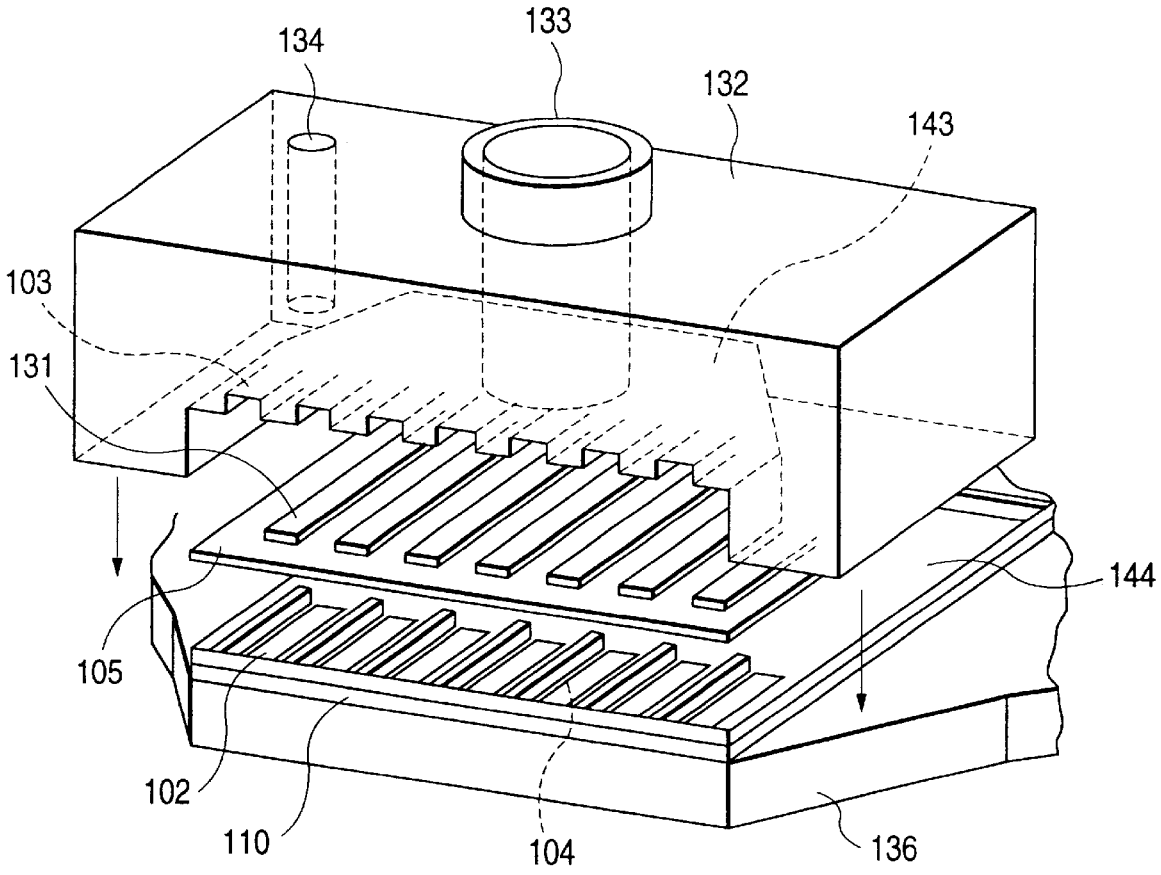
FIG. 8 is an exploded, perspective view to show a structural example of the liquid discharge apparatus according to the present invention.

FIG. 8 is an exploded, perspective view to show a structural example of the liquid discharge apparatus according to the present invention.

In the present embodiment, the element substrate 110 provided with a plurality of electrothermal transducers as the heat-generating member 102 for generating heat for generating the bubble by film boiling in the bubble-generating liquid as described above is disposed on support body 136 made of metal such as aluminum.

Provided above the element substrate 110 are a plurality of grooves for forming the second liquid flow paths 104 as made of dry film DF, a recessed portion forming the second common liquid chamber (common bubble-generating liquid chamber) 144, communicating with the plurality of second liquid flow paths 104, for supplying the bubble-generating liquid to each of the second liquid flow paths 104, and the movable separation film 105 to which the movable members 131 described above are bonded.

The grooved member 132 has grooves for forming the first liquid flow paths (discharge liquid flow paths) 103 when bonded with the movable separation film 105, a recessed portion for forming the first common liquid chamber (common discharge liquid chamber) 143, communicating with the discharge liquid flow paths, for supplying the discharge liquid to each of the first liquid flow paths 103, first liquid supply path (discharge liquid supply path) 133 for supplying the discharge liquid to the first common liquid chamber 143, and second liquid supply path (bubble-generating liquid supply path) 134 for supply the bubble-generating liquid to the second common liquid chamber 144. The second liquid supply path 134 is connected with a communication passage running through the movable member 131 and the movable separation film 105 disposed outside the first common liquid chamber 133, into the second common liquid chamber 144, and this communication passage permits the bubble-generating liquid to be supplied to the second common liquid chamber 144 without mixing with the discharge liquid.

The positional relation among the element substrate 110, the movable member 131, the movable separation film 105, and the grooved member 132 is such that the movable member 131 is located corresponding to the heat-generating member 102 of the element substrate 110 and the first liquid flow path 103 is disposed corresponding to this movable member 131. Although the present embodiment showed an example wherein a second liquid supply path 134 is provided in one grooved member 132, plural paths may be provided depending upon the supply amount of liquid. Further, the cross-sectional area of flow path of each of the first liquid supply path 133 and the second liquid supply path 134 may be determined in proportion to the supply amount. By such optimization of the flow path cross-sectional area, the components forming the grooved member 132 etc. can be further compactified.

As described above, the present embodiment is arranged so that the second liquid supply path 134 for supplying the second liquid to the second liquid flow path 104 and the first liquid supply path 133 for supplying the first liquid to the first liquid flow path 103 are formed in the grooved top plate as the common grooved member 132, whereby the number of components can be decreased and the number of steps and the cost can be decreased.

Because of the structure in which the supply of the second liquid to the second common liquid chamber 144 in communication with the second liquid flow paths 104 is carried out by the second liquid flow paths 104 in such a direction as to penetrate the movable separation film 105 separating the first liquid from the second liquid, only one step is sufficient for bonding of the movable separation film 105, the grooved member 132, and the substrate 110 with the heat-generating member 102 formed therein, which enhances ease of fabrication and the bonding accuracy and which achieves good discharge.

Since the second liquid is supplied into the second common liquid chamber 144 as penetrating the movable separation film 105, the supply of the second liquid to the second liquid flow paths 104 becomes certain and the sufficient supply amount can be assured, thus enabling stable discharge.

As described above, since the present invention employs the configuration having the movable separation film 105 to which the movable member 131 is bonded, the liquid can be discharged under higher discharge force, at higher discharge efficiency, and at higher speed than by the conventional liquid discharge apparatuss. The bubble-generating liquid may be the liquid having the above-mentioned properties; specifically, it may be selected from methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and mixtures thereof.

The discharge liquid may be selected from various liquids, free from possession of the bubble-generating property and the thermal property thereof. Further, the discharge liquid may be selected from liquids with low bubble-generating property, discharge of which was difficult before, liquids likely to be modified or deteriorated by heat, and liquids with high viscosity.

However, the discharge liquid is preferably a liquid without a property to hinder the discharge of liquid, the generation of bubble, the operation of the movable separation film and the movable member, and so on by the discharge liquid itself or by reaction thereof with the bubble-generating liquid.

For example, high-viscosity ink or the like may be used as the discharge liquid for recording.

Other discharge liquids applicable include liquids weak against heat such as pharmaceutical products and perfumes.

Recording was conducted as discharging the discharge liquid in combinations of the bubble-generating liquid and the discharge liquid in the following compositions. The recording results confirmed that the liquids with viscosity of ten and several cP, discharge of which was difficult by the conventional liquid discharge apparatuss, were discharged well, of course, and the liquid even with very high viscosity of 150 cP was also discharged well, thus obtaining high-quality recorded objects.

| | |
|---|---|
| Bubble-generating liquid 1 | |
| Ethanol | 40 wt % |
| Water | 60 wt % |
| Bubble-generating liquid 2 | |
| Water | 100 wt % |
| Bubble-generating liquid 3 | |
| Isopropyl alcohol | 10 wt % |
| Water | 90 wt % |
| Discharge liquid 1 (pigment ink of approximately 15 cP) | |
| Carbon black | 5 wt % |
| Styrene-acrylic acid-ethyl acrylate copolymer separating material (acid value 140 and weight average molecular weight 8000) | 1 wt % |
| Monoethanol amine | 0.25 wt % |
| Glycerine | 6.9 wt % |
| Thio diglycol | 5 wt % |
| Ethanol | 3 wt % |
| Water | 16.75 wt % |
| Discharge liquid 2 (55 cP) | |
| Polyethylene glycol 200 | 100 wt % |
| Discharge liquid 3 (150 cP) | |
| Polyethylene glycol 600 | 100 wt % |

Incidentally, in the case of the liquids conventionally regarded as not easy to eject, because of their low discharge speeds, dispersion of discharge directivity was enhanced so as to degrade the impact accuracy of dot on recording sheet and unstable discharge caused dispersion in the discharge amount, which made it not easy to obtain a high-quality image. The structure in the embodiment as described above, however, can generate the bubble sufficiently and stably by using the bubble-generating liquid. This can enhance the impact accuracy of liquid droplet and can stabilize the ink discharge amount, so that the quality of recorded image can be improved remarkably.

Next described are fabrication steps of the liquid discharge apparatus according to the present invention.

Roughly describing, the device was fabricated in such a way that the walls of the second liquid flow paths were formed on the element substrate, the movable separation film was attached thereonto, and the grooved member having the grooves etc. for forming the first liquid flow paths was attached further thereonto. Alternatively, the device was fabricated in such a way that after forming the walls of the second liquid flow paths, the grooved member to which the movable separation film with the movable member bonded thereto was attached was joined onto the walls.

Further, the process for producing the second liquid flow paths will be described in detail.

First, elements for electrothermal conversion each. having the heat-generating member of hafnium boride, tantalum nitride, or the like were formed on an element substrate (silicon wafer), using the same fabrication system as that for semiconductors, and thereafter the surface of the element substrate was cleaned for the purpose of improving adherence with a photosensitive resin in the next step. The adherence can be improved further by subjecting the surface of element substrate to surface modification by ultraviolet-ozone or the like and thereafter spin- coating the thus modified surface, for example, with a liquid of silane coupling agent (available from Nihon Unica: A189) diluted in 1% by weight with ethyl alcohol.

Then the surface was cleaned and an ultraviolet-sensitive resin film (available from Tokyo Ohka: dry film, Ordil SY-318) DF was laminated on the adherence-enhanced substrate.

Next, photomask PM was placed on the dry film DF and ultraviolet rays were radiated to portions to be left as the second flow path walls in the dry film DF through the photomask PM. This exposure step was carried out in the exposure dose of about 600 mJ/cm$^2$, using MPA-600 available from CANON INC.

Then the dry film DF was developed with a developer comprised of xylene and butyl cellosolve acetate (available from Tokyo Ohka: BMRC-3) to dissolve unexposed portions, so that the portions hardened by exposure were formed as the wall portions of the second liquid flow paths. Further, the residue remaining on the surface of element substrate was removed by processing it for about 90 seconds by an oxygen plasma ashing system (available from Alcantec Inc.: MAS-800) and then ultraviolet irradiation under 100 mJ/cm$^2$ was further carried out at 150° C. for 2 hours to harden the exposed portions completely.

By the above method, the second liquid flow paths can be uniformly formed with accuracy in a plurality of heater boards (element substrates) obtained by dividing the above silicon substrate. Specifically, the silicon substrate was cut and divided into the respective heater boards by a dicing machine (available from Tokyo Seimitsu: AWD-4000) to which a diamond blade 0.05 mm thick was attached. Each heater board separated was fixed on an aluminum base plate with adhesive (available from Toray: SE4400).

Then the heater board was connected to a printed board preliminarily joined onto the aluminum base plate, by aluminum wires of the diameter of 0.05 mm.

Next positioned and joined to the heater board thus obtained was a joint body of the grooved member with the movable separation film by the aforementioned method. Specifically, the grooved member having the movable separation film was positioned to the heater board, they were engaged and fixed by stop springs, thereafter supply members for ink and bubble-generating liquid were joined and fixed onto the aluminum base plate, and gaps between the aluminum wires and gaps among the grooved member, the heater board, and the supply members for ink and bubble-generating liquid were sealed with silicon sealant (available from Toshiba Silicone: TSE399), thus completing the second liquid flow paths.

By forming the second liquid flow paths by the above process, the accurate flow paths can be obtained without positional deviation relative to the heaters of each heater board. Particularly, by preliminarily joining the grooved member with the movable separation film in the previous step, the position accuracy can be enhanced between the first liquid flow path and the movable member. Then stable discharge is achieved by these high-accuracy fabrication techniques so as to enhance the quality of print. In addition, since the flow paths can be formed en bloc on the wafer, the devices can be mass-produced at low cost.

The present embodiment employed the ultraviolet-curing dry film for forming the second liquid flow paths, but it is also possible to obtain the element substrate by using a resin material having an absorption band in the ultraviolet region, especially near 248 nm, curing it after lamination, and directly removing the resin in the portions to become the second liquid flow paths by excimer laser.

The first liquid flow paths etc. were formed by joining the combined body of the substrate with the movable separation film described above to the grooved top plate having the orifice plate with discharge ports, the grooves for forming the first liquid flow paths, and the recessed portion for forming the first common liquid chamber, communicating in common with the plurality of first liquid flow paths, for supplying the first liquid to each flow path. The movable separation film is fixed by being pinched by this grooved top plate and the second liquid flow path walls. The movable separation film is not fixed only to the substrate, but it may be also positioned and fixed to the substrate after fixed to the grooved top plate.

Preferable examples of the material for the movable member to be the direction regulating means include durable materials, for example, metals such as silver, nickel, gold, iron, titanium, aluminum, platinum, tantalum, stainless steel, or phosphor bronze, alloys thereof, resin materials, for example, those having the nitryl group such as acrylonitrile, butadiene, or styrene, those having the amide group such as polyamide, those having the carboxyl group such as polycarbonate, those having the aldehyde group such as polyacetal, those having the sulfone group such as polysulfone, those such as liquid crystal polymers, and chemical compounds thereof; and materials having durability against the ink, for example, metals such as gold, tungsten, tantalum, nickel, stainless steel, titanium, alloys thereof, materials coated with such metal, resin materials having the amide group such as polyamide, resin materials having the aldehyde group such as polyacetal, resin materials having the ketone group such as polyetheretherketone, resin materials having the imide group such as polyimide, resin materials having the hydroxyl group such as phenolic resins, resin materials having the ethyl group such as polyethylene, resin materials having the alkyl group such as polypropylene, resin materials having the epoxy group such as epoxy resins, resin materials having the amide group such as melamine resins, resin materials having the methylol group such as xylene resins, chemical compounds thereof, ceramic materials such as silicon dioxide, and chemical compounds thereof.

Preferable examples of the material for the movable separation film 105 include, in addition to the aforementioned polyimide, resin materials having high heat-resistance, high anti-solvent property, good moldability, elasticity, and capability of forming a thin film, typified by recent engineering plastics, such as polyethylene, polypropylene, polyamide, polyethylene terephthalate, melamine resins, phenolic resins, polybutadiene, polyurethane, polyetheretherketone, polyether sulfone, polyallylate, silicone rubber, and polysulfone, and chemical compounds thereof.

The thickness of the movable separation film 105 can be determined in consideration of the material and the shape and the like thereof from the viewpoints that the strength as a partition wall should be assured and that expansion and contraction takes place well, and it is desirably approximately 0.5 $\mu$m to 10 $\mu$m.

(Embodiment 2)

Figure 9A:
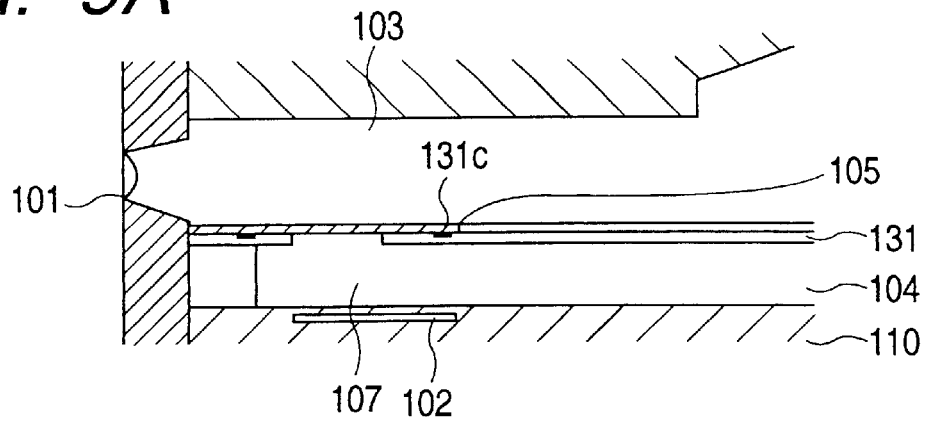
Figure 9B:
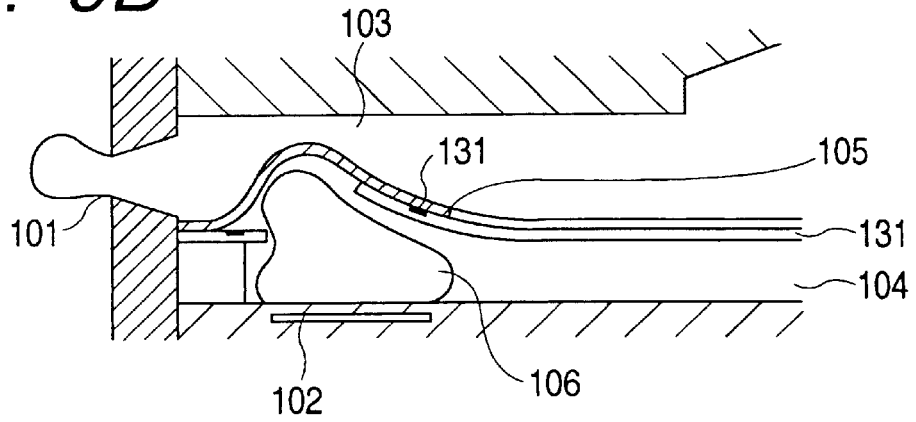
Figure 9C:
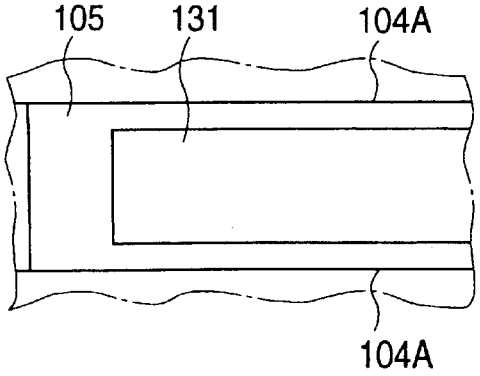

FIGS. 9A to 9C are drawings to show the second embodiment of the liquid discharge apparatus of the present invention, wherein FIG. 9A is a cross-sectional view along the flow path direction upon non-generation of bubble, FIG. 9B is a cross-sectional view along the flow path direction upon generation of bubble, and FIG. 9C is a drawing to show a view of the first flow path observed from the second flow path side of the drawing shown in FIG. 9A.

In the present embodiment as shown in FIGS. 9A and 9C, the second liquid flow path 104 for bubble-generating liquid is provided on the substrate 110 provided with the heat-generating member 102 (the heating resistor member in the shape of 40 $\mu$m×105 $\mu$m in the present embodiment) for supplying the thermal energy for generating the bubble in the liquid, and the first liquid flow path 103 for discharge liquid in direct communication with the discharge port 101 is provided above it. The movable member 131 is provided as the direction regulating means, which has the free end on the downstream side of the upstream edge of the bubble-generating region 107, and the fulcrum on the upstream side thereof. The movable member 131 and the movable separation film 105, provided in an opening portion between the first liquid flow path 103 and the second liquid flow path 104, are bonded with each other at bonding portion 131*c*, which forms a part of the free end side of the movable member 131, whereby the first liquid flow path 103 and the second liquid flow path 104 are always separated substantially from each other.

When heat is generated in the heat-generating member 102, the bubble 106 is generated in the bubble-generating region 107 on the heat-generating member 102. This displaces the movable separation film 105 into the first liquid flow path 103, whereupon the displacement of the movable separation film 105 is controlled by the movable member 131. Since the movable member 131 has the free end above the bubble-generating region 107 and the fulcrum upstream thereof, the movable separation film 105 is displaced more on the downstream side than on the upstream side (FIG. 9B).

In this way, the downstream portion of the movable separation film 105 is displaced greater with growth of bubble 106, whereby the pressure due to generation of bubble 106 is transmitted mainly to the discharge port 101, thereby efficiently discharging the discharge liquid in the first liquid flow path 103 from the discharge port 101. Since the movable separation film does not have to cover the entire surface, the cost can be decreased.

(Embodiment 3)

FIGS. 10A to 10F are cross-sectional views along the flow path direction to show the third embodiment of the liquid discharge method and the liquid discharge apparatus according to the present invention.

Figure 10A:
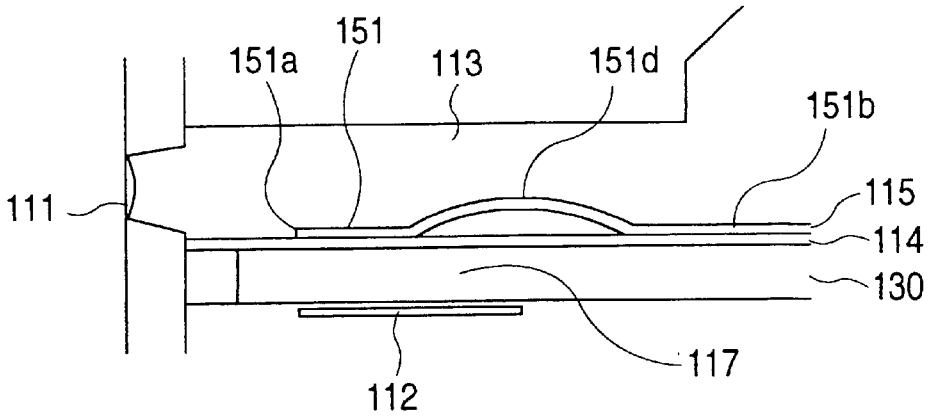
FIGS. 10A, 10B, 10C, 10D, 10E and 10F are cross-sectional views along the flow path direction to show the second embodiment of the liquid discharge method and the liquid discharge apparatus according to the present invention.

In the present embodiment, as shown in FIG. 10A, the second liquid flow path 114 for bubble-generating liquid is provided on the substrate 130 provided with the heat-generating member 112 (the heating resistor member in the shape of 40 $\mu$m×105 $\mu$m in the present embodiment) for supplying the thermal energy for generating the bubble in the liquid, and the first liquid flow path 113 for discharge liquid in direct communication with the discharge port 111 is provided above it. The movable separation film 115 made of a thin film with elasticity is provided between the first liquid flow path 113 and the second liquid flow path 114. The movable separation film 115 separates the discharge liquid in the first liquid flow path 113 from the bubble-generating liquid in the second liquid flow path 114. The movable separation film 115 is disposed opposite to the heat-generating member 112 and faces at least a part of the bubble-generating region 117 where the bubble is generated by the heat generated in the heat-generating member 112. Further provided on the first liquid flow path 113 side of the movable separation film 115 is the movable member 151 as the direction regulating means, which has the free end 151*a* on the downstream side of the upstream edge of the bubble-generating region 117, and the fulcrum 151*b* on the upstream side of the free end 151*a* and which is disposed adjacent to the movable separation film 115. The movable separation film 115 and the movable member 151 may be bonded to each other at the bonding portion 151*c*, which becomes a part of the free end 151*a* side of the movable member 151 (on the upstream side of the bubble-generating region 117). In the movable member 151, a portion between the bonding portion 151*c* and the fulcrum 151*b* is a curved portion 151*d* curved on the first liquid flow path 113 side.

The liquid discharge operation in the liquid discharge apparatus constructed as described above will be described, but, prior thereto, characteristics of the movable separation film 115 shown in FIGS. 10A to 10F will be described.

Figure 11A:
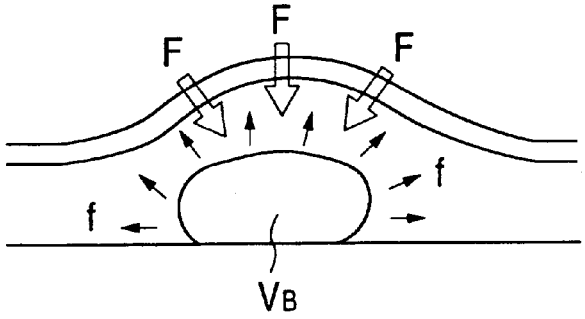
Figure 11B:
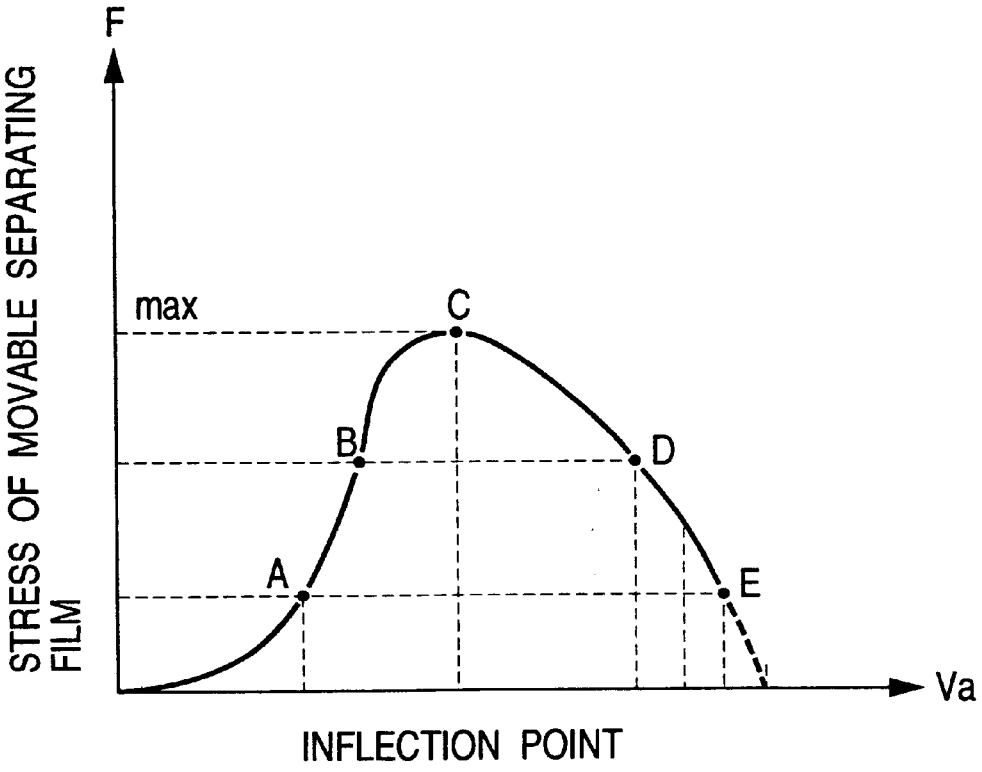

FIGS. 11A and 11B are drawings to show the characteristics of the movable separation film used in the liquid discharge apparatus according to the present invention, wherein FIG. 11A is a drawing to show the relationship between pressure f of the bubble generated in the bubble-generating region and stress F of the movable separation film against it and FIG. 11B is a graph to show the characteristics of the stress F of the movable separation film against volume change of bubble shown in FIG. 11A.

As shown in FIGS. 11A and 11B, the stress of the movable separation film exponentially increases with increasing volume $V_B$ of the bubble as far as the volume $V_B$ of the bubble is small in the initial stage of generation of bubble. With total expansion of bubble the film thickness of the movable separation film becomes smaller and the stress becomes weaker. Thus, the stress turns to decreasing after reaching a certain inflection point.

Now returning to FIGS. 10A to 10F, the liquid discharge operation in the present embodiment will be described.

Figure 10B:
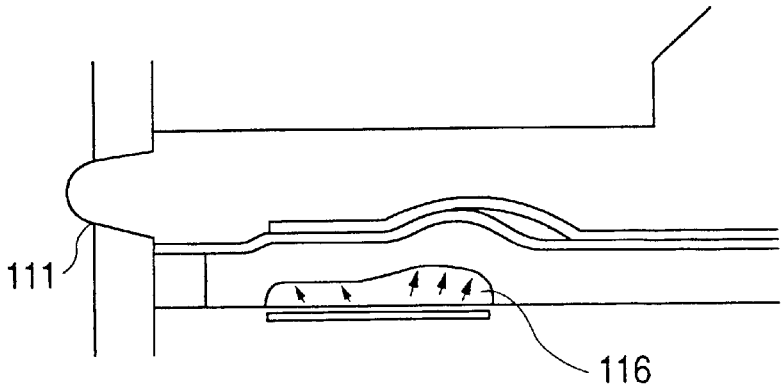

When heat is generated in the heat-generating member 112, the bubble 116 is generated in the bubble-generating region 117 on the heat-generating member 112, whereby the part of the movable separation film 115 below the curved portion 151*d* of the movable member 151 starts extending (FIG. 10B).

Figure 10C:
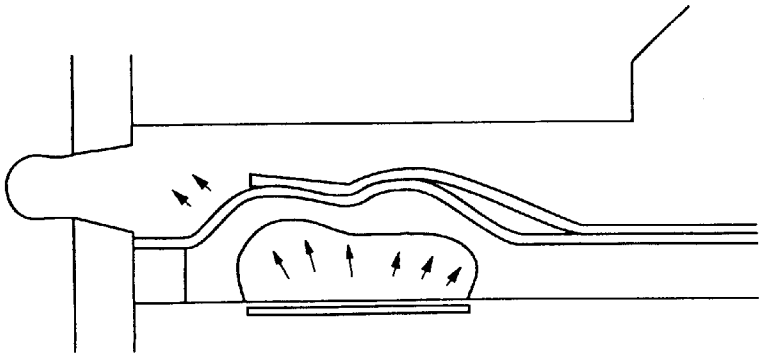

With further growth of the bubble 116, the movable separation film 115 further extends to start being displaced into the first liquid flow path 113 (FIG. 10C).

Figure 10D:
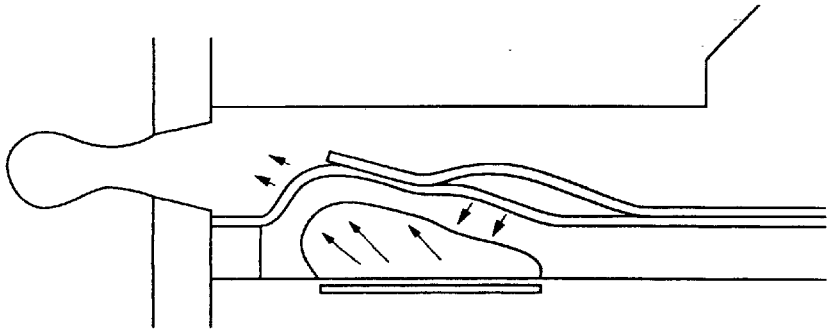
Figure 10E:
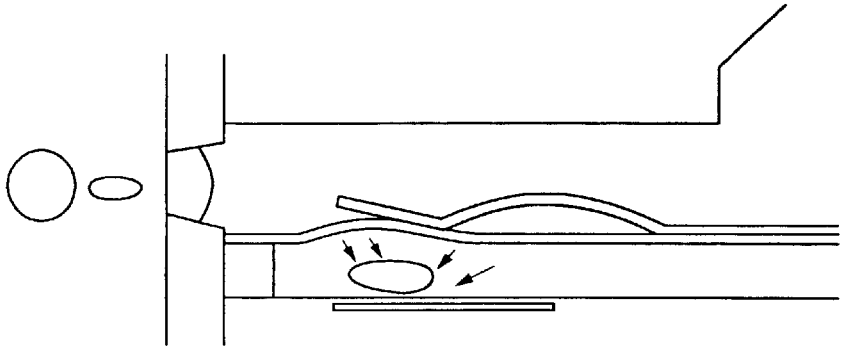

After that, with further growth of the bubble 116, the movable separation film 115 becomes about to be displaced further into the first liquid flow path 113, but because the upstream side is fixed by the fulcrum 151*b*, the displacement is restricted there, so that the downstream side being the free end 151*a* side is displaced greater (FIG. 10D).

In this way, the downstream portion of the movable separation film 115 is displaced greater with growth of the bubble 116, whereby the pressure due to the generation of bubble 116 is transmitted mainly toward the discharge port 111, thereby efficiently discharging the discharge liquid in the first liquid flow path 113 from the discharge port 111.

In this state the stress on the movable separation film 115 is maintained at point C in FIG. 11B on the upstream side because of restriction of extension and at point E in FIG. 11B on the downstream side because of the more enhancement of extension. In the stress distribution over the whole of the movable separation film 115, therefore, the stress on the upstream side is greater than that on the downstream side.

With contraction of the bubble 116 thereafter the movable separation film 115 becomes about to return to the position before displacement (FIG. 10E), whereupon because of the stress distribution as described above, the contraction speed is fast on the upstream side of bubble 116 while the contraction speed is slow on the downstream side. Thus, the stress distribution over the whole of the movable separation film 115 makes such a shift as to gradually decrease the stress on the upstream side and as to gradually increase the stress on the downstream side.

Figure 10F:
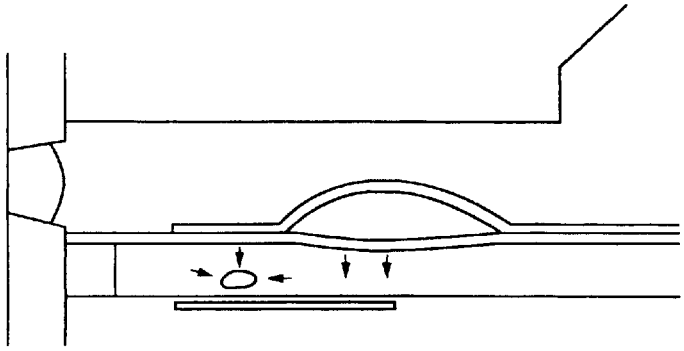

Because of the negative pressure upon collapse of bubble, the portion of the movable separation film 115 below the curved portion 151*d* of the movable member 151 becomes displaced into the second liquid flow path 104 past the position before displacement. However, since the curved portion 151*d* of the movable member 151 is provided, the reduction of pressure is suppressed on the first liquid flow path 113 side, which suppresses back of meniscus and improves the refilling characteristics (FIG. 10F).

Further, the movable member 151 restricts movement of the liquid to upstream, thereby achieving the effects including the improvement in the refilling characteristics, the reduction of crosstalk, and so on.

(Embodiment 4)

Figure 12A:
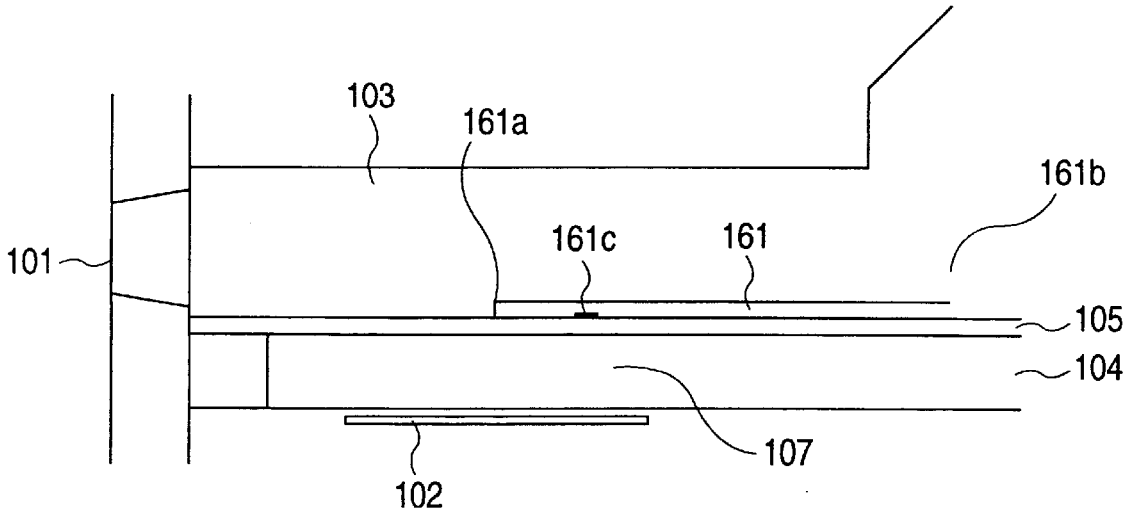
Figure 12B:
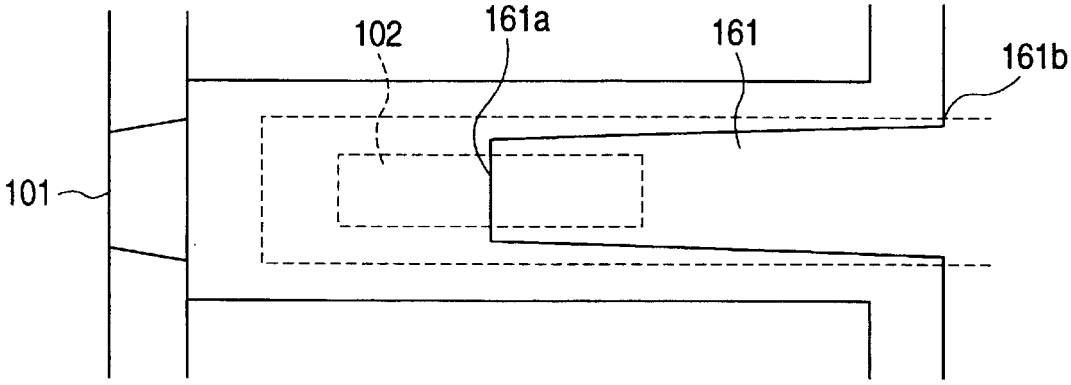

FIGS. 12A and 12B are drawings to show the fourth embodiment of the liquid discharge apparatus according to the present-invention, wherein FIG. 12A is a cross-sectional view along the flow path direction and FIG. 12B is a top plan view.

The present embodiment, as shown in FIGS. 12A and 12B, is different from the first embodiment in that the movable member 161 is formed in such a trapezoid shape as to decrease the width toward downstream where the free end 161*a* is located, and the other structure is the same as in the first embodiment.

In the liquid discharge apparatus constructed as described above, since the movable member 161 is formed in such a trapezoid shape as to narrow the width toward downstream, the movable member 161 is easy to deform and the movable separation film 105 is displaced efficiently by the pressure of bubble generated in the bubble-generating region 107.

Therefore, the present embodiment can achieve enhancement of discharge efficiency and increase of discharge amount.

The above-stated effects can be enhanced further if the free end 161*a* in the present embodiment is arranged, more preferably, as located on the upstream side of the center of the heat-generating member 102.

(Embodiment 5)

Figure 13A:
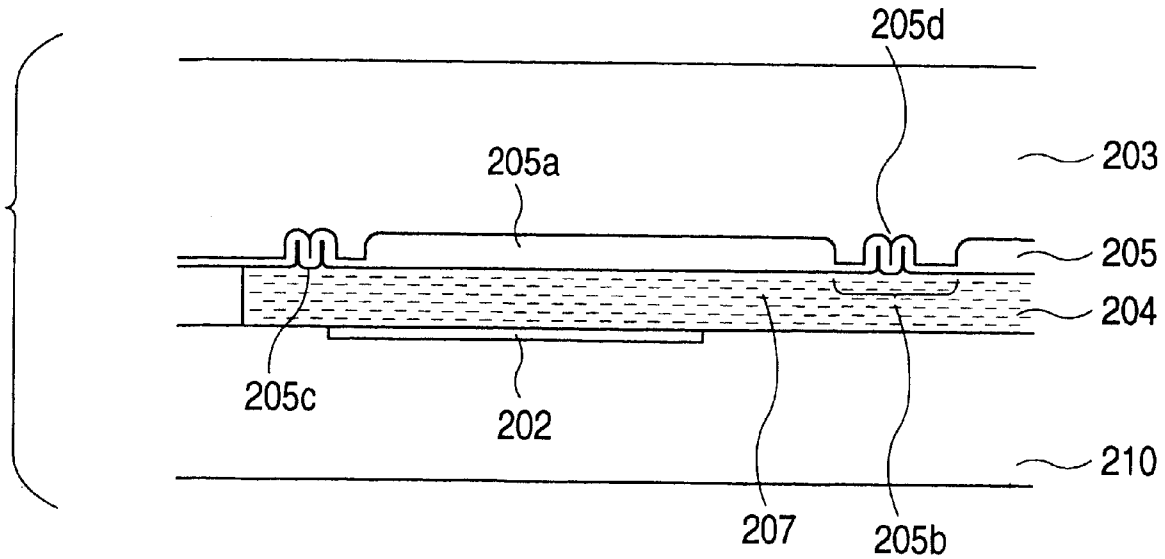
Figure 13B:
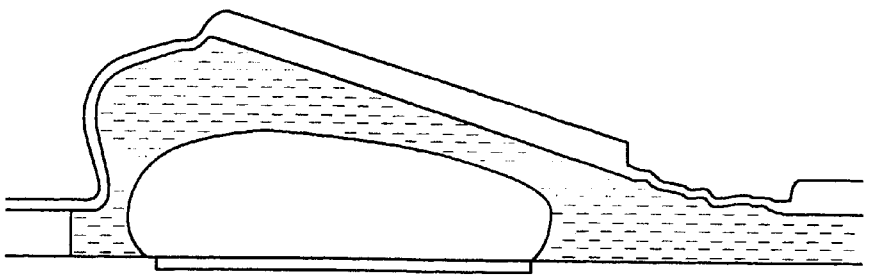
Figure 14:
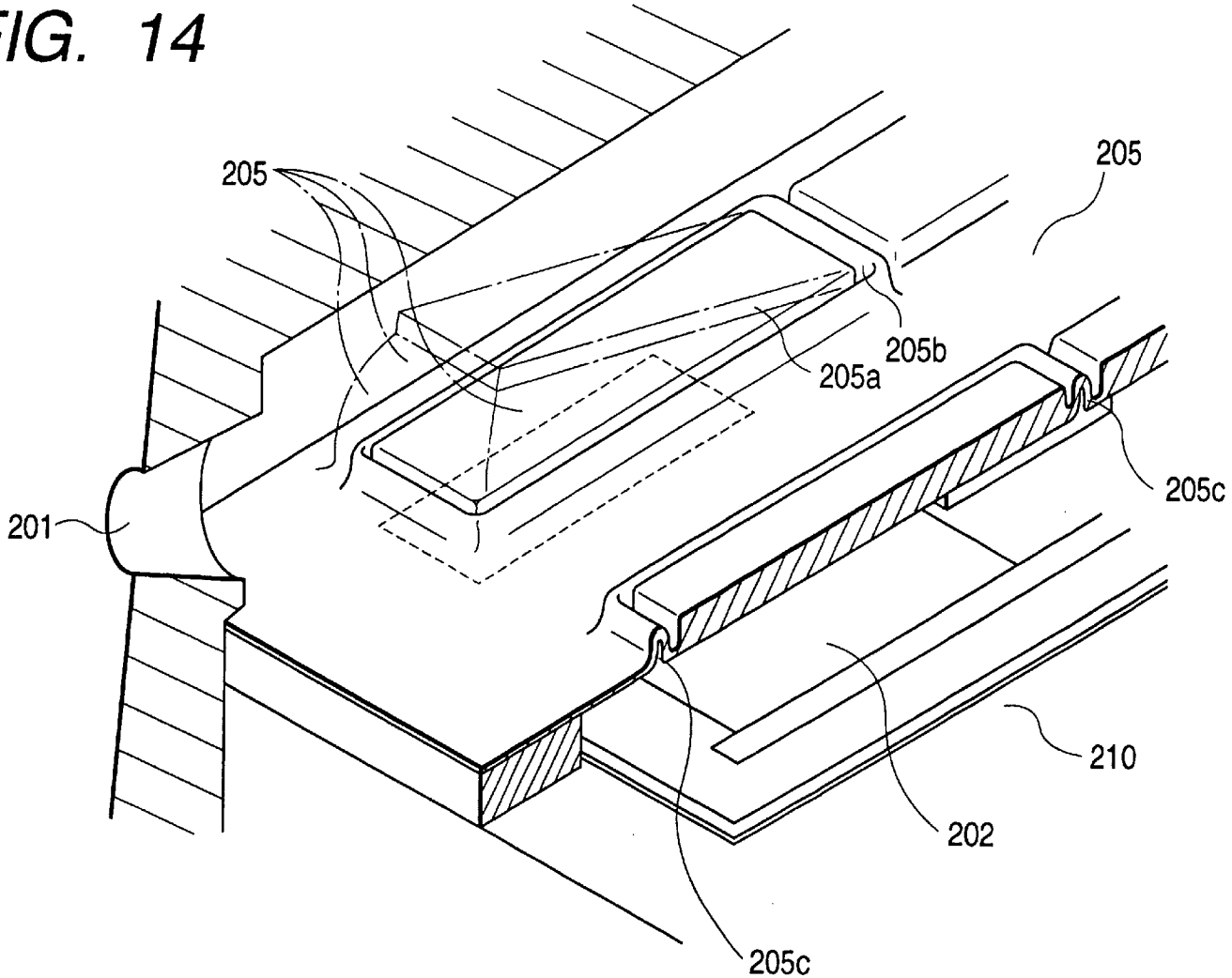
FIG. 14 is a perspective view, partly broken, of the liquid discharge apparatus shown in FIGS. 13A and 13B.

FIGS. 13A and 13B are cross-sectional views along the flow path direction to show the fifth embodiment of the liquid discharge method and the liquid discharge apparatus according to the present invention, wherein FIG. 13A is a drawing to show a state upon non-generation of bubble and FIG. 13B is a drawing to show a state upon generation of bubble (upon discharge). FIG. 14 is a perspective view, partly broken, of the liquid discharge apparatus shown in FIGS. 13A and 13B.

In the present embodiment, as shown in FIGS. 13A and 13B and FIG. 14, similar to Embodiment 1, the second liquid flow path 204 for bubble-generating liquid is provided on the substrate 210 provided with the heat-generating member 202 (the heating resistor member in the shape of 40 $\mu$m×105 $\mu$m in the present embodiment) for supplying the thermal energy for generating the bubble in the liquid, and the first liquid flow path 203 for discharge liquid in direct communication with the discharge port 201 is provided above it. Further, the movable separation film 205 made of a thin film with elasticity is provided between the first liquid flow path 203 and the second liquid flow path 204. The movable separation film 205 separates the discharge liquid in the first liquid flow path 203 from the bubble-generating liquid in the second liquid flow path 204.

Here, the movable separation film 205 in the portion located in the projection area above the surface of the heat-generating member 202 has thick portion 205*a* as the direction regulating means, facing opposite to the heat-generating member 202 and having the free end on the discharge port 202 side, and slack portion 205*c* on the discharge port 201 side of the free end. As described below, the movable separation film 205 operates so that the thick portion 205*a* is displaced into the first liquid flow path 203 with generation of bubble in the bubble-generating liquid and so that deformation on the discharge port 201 side becomes greater because of the slack portion 205*c* (FIG. 13B). Since the present embodiment does not need to expand the movable separation film because of provision of the slack portion, the discharge efficiency can be enhanced.

Recess portion 205*b* is formed on the opposite side to the discharge port 201 with respect to the thick portion 205*a* of the movable separation film 205 and is a hinge portion for facilitating the displacement of the thick portion 205*a*. The recess portion 205*b* may be omitted depending upon the thickness or the material of the thick portion 205*a*, if the thick portion 205*a* is easy to displace.

However, the recess portion 205*b* is the portion functioning as fulcrum 205*d* upon displacement of the thick portion 205*b*, and thus the fulcrum 205*d* is formed as a place to become a starting point of displacement even in the case of the structure without the recess portion 205*b*.

The thick portion 205*a* is located the distance of approximately 10 to 15 $\mu$m apart from the heat-generating member 202 so as to cover the heat-generating member 202 at the position opposite to the heat-generating member 202, while having the fulcrum 205*d* on the upstream side of flow of the liquid, flowing from the common liquid chamber (not illustrated) through the thick portion 205*a* to the discharge port 201 by the discharge operation of liquid, and the free end on the downstream side of this fulcrum 205*d*. The space between the heat-generating member 202 and the thick portion 205*a* is the bubble-generating region 207.

When heat is generated in the heat-generating member 202, the heat acts on the bubble-generating liquid in the bubble-generating region 207 between the thick portion 205*a* of the movable separation film 205 and the heat-generating member 202, thereby generating the bubble based on the film boiling phenomenon in the bubble-generating liquid. The pressure based on the generation of bubble preferentially acts on the movable separation film 205, and the movable separation film 205 is displaced so that the thick portion 205*a* opens greatly to the discharge port 201 about the recess portion 205*b*, as shown in FIG. 13B. By this, the pressure due to the bubble generated in the bubble-generating region 207 is guided to the discharge port 201.

Further, in the case wherein a bellows portion is provided in the movable separation film on the side of the direction regulating means, the free-end-side movable separation film of the direction regulating means swells more toward the discharge port by the pressure upon generation of bubble because of less limitation on swelling than in the case of the movable separation film being also provided on the side. Thus, such an arrangement can achieve higher discharge efficiency and higher discharge force.

In this case, when the direction regulating means is closed, the bellows portion of the movable separation film is closed substantially hermetically, thereby shutting off the first liquid from the second liquid. Since the first liquid flow path walls can prevent the pressure upon generation of bubble from leaking through the side of the direction regulating means to the outside upon displacement of the movable separation film, the discharge efficiency and discharge force are not degraded in comparison with the case without the bellows portion.

The discharge operation of the liquid discharge apparatus constructed as described above will be described in detail.

FIGS. 15A to 15D are drawings for explaining the operation of the liquid discharge apparatus shown in FIGS. 13A and 13B and FIG. 14.

Figure 15A:
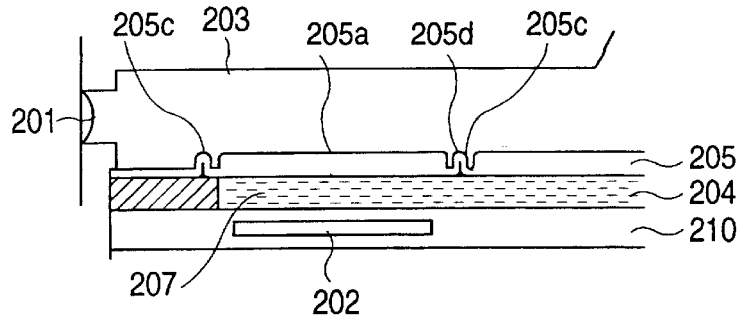
FIGS. 15A, 15B, 15C and 15D are drawings for explaining the operation of the liquid discharge apparatus shown in FIGS. 13A, 13B and FIG. 14.

In FIG. 15A, energy such as electric energy is not applied to the heat-generating member 202 yet, so that no heat is generated in the heat-generating member 202. The thick portion 205*a* is located at the first position nearly parallel to the substrate 201.

An important point herein is that the thick portion 205*a* is provided at the position where it faces at least the downstream portion of the bubble generated by the heat in the heat-generating member 202. Namely, for the downstream portion of the bubble to act on the thick portion 205*a*, the thick portion 205*a* is placed at least up to the position downstream of the center of the area of the heat-generating member 202 (downstream of a line passing the center of the area of the heat-generating member 202 and perpendicularly intersecting the direction of the length of flow path) in the structure of liquid flow path.

Figure 15B:
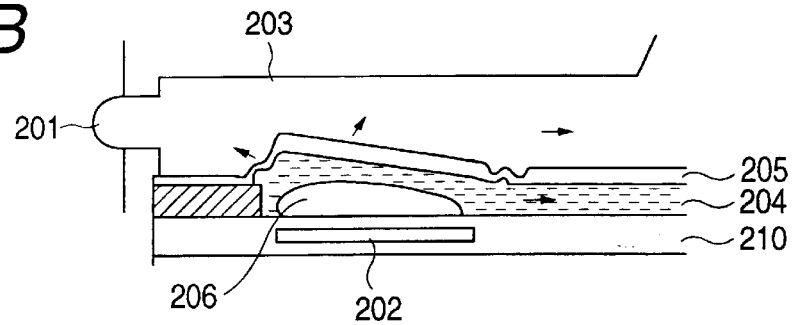

Here, when the electric energy or the like is applied to the heat-generating member 202, the heat-generating member 202 generates heat and part of the bubble-generating liquid filling the inside of the bubble-generating region 207 is heated thereby, thus generating the bubble 206 by film boiling. When the bubble 206 is generated, the slack portion 205*c* of the movable separation film 205 is extended so that the thick portion 205*a* is displaced from the first position to the second position so as to guide propagation of the pressure of bubble 206 toward the discharge port, by the pressure based on generation of bubble 206 (FIG. 15B).

An important point herein is that the free end of the thick portion 205*a* of the movable separation film 205 is positioned on the downstream side (on the discharge port side) and the fulcrum 205*d* is located on the upstream side (on the common liquid chamber side) whereby at least a part of the thick portion 205*a* faces the downstream portion of the heat-generating member 202, i.e., the downstream portion of bubble 206, as described above.

Figure 15C:
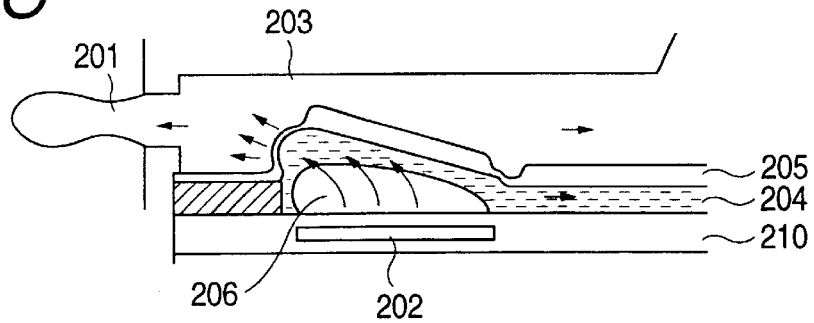

With further growth of bubble 206, the thick portion 205*a* of the movable separation film 205 is further displaced into the first liquid flow path 203 according to the pressure upon generation of bubble. With this, the free-end-side slack portion 205*c* swells greatly in the discharge direction while the fulcrum-side slack portion 205*c* is pulled by swelling force of the thick portion 205*a* toward the discharge port, thus assisting the shift thereof. As a result, the bubble 206 thus generated grows more downstream than upstream, so that the thick portion 205*a* moves greatly over the first position (FIG. 15C).

In this way, the thick portion 205*a* of the movable separation film 205 is gradually displaced into the first liquid flow path 203 according to the growth of bubble 206, whereby the bubble 206 grows to the free end side so as to inflate the slack portion 205*c* greatly toward the discharge port, and the pressure due to generation of bubble 206 is directed uniformly toward the discharge port 201. This enhances the discharge efficiency of liquid through the discharge port 201. The movable separation film 205, while guiding the bubble-generating pressure toward the discharge port 201, becomes little hindrance against transmission thereof, and thus the propagation direction of pressure and the growing direction of bubble 206 can be controlled efficiently depending upon the magnitude of the pressure propagating.

Figure 15D:
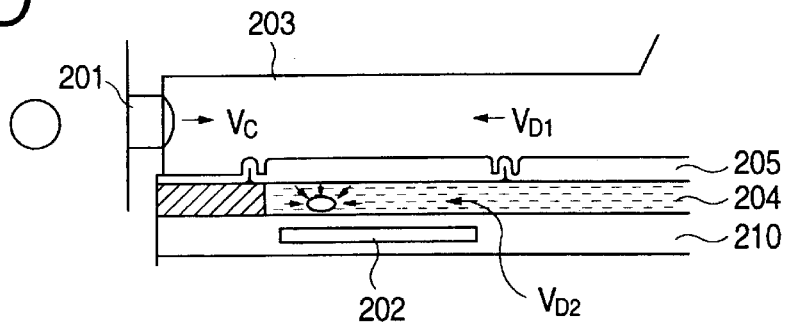

After that, when the bubble 206 contracts to disappear because of the decrease of internal pressure of bubble characteristic to the film boiling phenomenon described above, the thick portion 205*a* of the movable separation film 205 displaced up to the second position returns to the initial position (the first position) shown in FIG. 15A because of the negative pressure upon contraction of bubble 206 and the restoring force based on the spring property of the movable separation film 205 itself (FIG. 15D). Upon collapse of bubble, in order to compensate for the volume of the liquid ejected, the liquid flows into the space from upstream, i.e., from the common liquid chamber side as indicated by $V_{D1}$, $V_{D2}$ and from the discharge port 201 side as indicated by $V_c$.

As described above, since in the structure of the present embodiment the direction regulating means provided in the movable separation film lets the pressure propagate efficiently toward the discharge port, the liquid weak against heat, the high-viscosity liquid, or the like can be discharged at higher discharge efficiency and under higher discharge force.

Figure 16A:
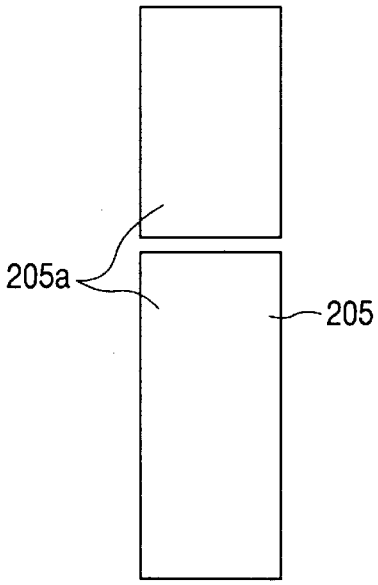
Figure 16B:
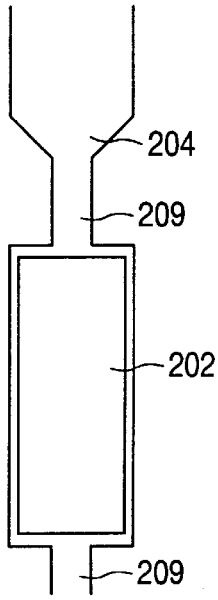
Figure 16C:
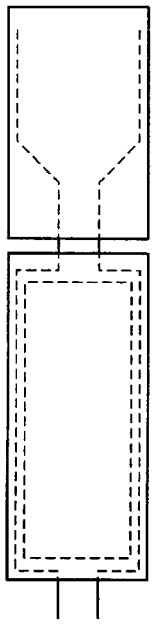

FIGS. 16A to 16C are drawings for explaining the relationship of location between the thick portion 205*a* of the movable separation film 205 and the second liquid flow path 204 in the liquid discharge apparatus shown in FIGS. 13A and 13B and FIGS. 15A to 15D, wherein FIG. 16A is a top plan view of the thick portion 205*a*, FIG. 16B is a top plan view of the second liquid flow path 204 without the movable separation film 205, and FIG. 16C is a schematic view of the positional relation between the thick portion 205*a* and the second liquid flow path 204 as superimposed. In either view the discharge port 201 is located on the bottom side.

The second liquid flow path 204 has constricted portions 209 before and after the heat-generating member 202, thereby being formed in such chamber (bubble-generating chamber) structure as to prevent the pressure upon generation of bubble from escaping through the second liquid flow path 204. In the present invention, since the bubble-generating liquid is separated completely from the discharge liquid by the movable separation film 205, consumption of the bubble-generating liquid is equal to substantially zero. However, the bubble-generating liquid, though a little amount, is replenished for the purposes of compensating for vaporization of the bubble-generating liquid under circumstances of physical distribution and storage and of removing bubbles remaining in the bubble-generating chamber after long-term continuous operation. Accordingly, the gap in the constricted portions 209 can be set very narrow, several $\mu$m to ten and several $\mu$m, the pressure upon generation of bubble occurring in the second liquid flow path 204 can be directed as concentrated to the movable separation film 205 with little escape thereof to the surroundings, and the liquid in the first liquid flow path 203 can be discharged at high efficiency and under high discharge force by the displacement of the thick portion 205*a* of the movable separation film 205 into the first liquid flow path 203 by this pressure. Here, the downstream constricted portion 209 of the bubble-generating chamber of the second liquid flow path 204 is a flow path for extracting bubbles remaining in the bubble-generating chamber therefrom.

The shape of the second liquid flow path 204 is not limited to the above-stated structure, but it may be any shape that can effectively transmit the pressure upon generation of bubble to the movable separation film.

The present embodiment is arranged so that the heat-generating member 202 is the one having the shape of 40 $\mu$m×105 $\mu$m and the movable separation film 205 is provided in such a state as to cover the bubble-generating chamber in which the heat-generating member 202 is provided, but without having to be limited to these, the size, shape, and location of the heat-generating member 202 and the movable separation film 205 in the present invention may be determined arbitrarily from shapes and locations by which the pressure upon generation of bubble can be utilized effectively as the discharge pressure.

In the present embodiment the flow path walls for forming the second liquid flow path 204 are formed by laminating the photosensitive resin (dry film) 15 $\mu$m thick on the substrate 210 and patterning it, but the present invention is not limited to this. As in Embodiment 1, the material for the flow path walls may be any material that has solvent resistivity against the bubble-generating liquid and that can readily form the shape of flow path walls.

Next described is a structural example of the liquid discharge apparatus that has two common liquid chambers, that can introduce the different liquids to the respective common liquid chambers as separating them well from each other, and that can be made at reduced cost, while decreasing the number of components.

Figure 17:
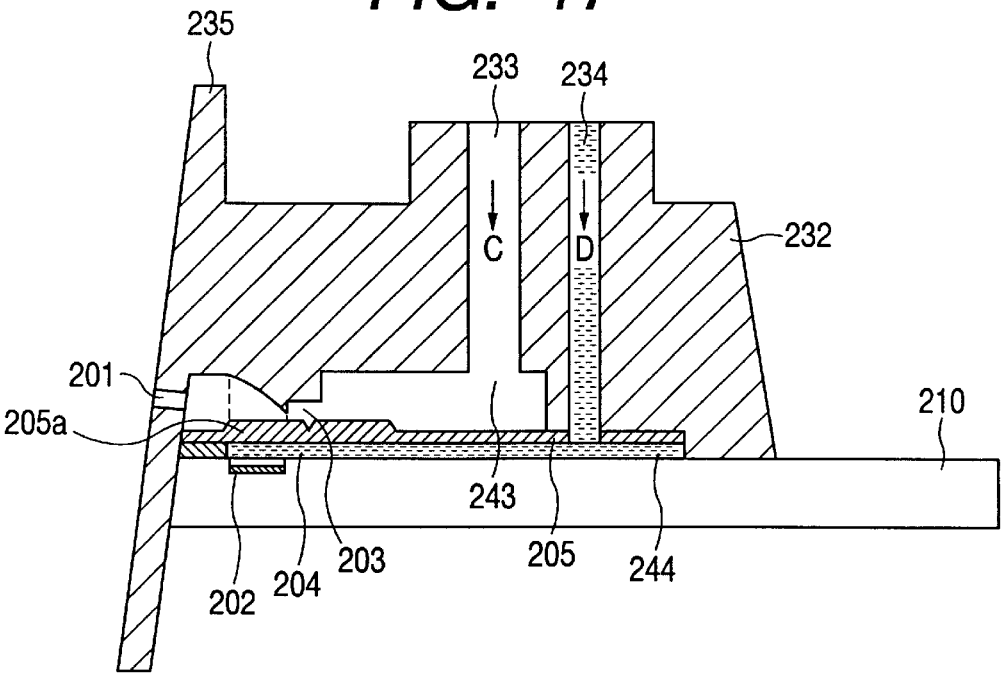
FIG. 17 is a schematic view to show a structural example of the liquid discharge apparatus according to the present invention.

FIG. 17 is a schematic view to show a structural example of the liquid discharge apparatus according to the present invention, wherein the same constituents as those in the example shown in FIGS. 13A and 13B to FIGS. 16A to 16C are denoted by the same reference symbols, and the detailed description thereof is omitted herein.

As in Embodiment 1, the grooved member 232 in the liquid discharge apparatus shown in FIG. 17 is schematically composed of the discharge ports, orifice plate 235, a plurality of grooves forming a plurality of first liquid flow paths 203, and a recessed portion for forming the first common liquid chamber 243, communicating in common with the plurality of first liquid flow paths 203, for supplying the liquid (the discharge liquid) to each first liquid flow path 203.

The plurality of first liquid flow paths 203 are formed by joining the movable separation film 205 to the lower portion of this grooved member 232 so that the inside thereof generally faces the heat-generating member. The grooved member 232 is provided with the first liquid supply path 233 running from the top thereof into the first common liquid chamber 243 and also with the second liquid supply path 234 running from the top thereof through the movable separation film 205 into the second common liquid chamber 244.

The first liquid is supplied through the first liquid supply path 233 and through the first common liquid chamber 243 to the first liquid flow paths 203, as shown by arrow C in FIG. 17, while the second liquid (the bubble-generating liquid) is supplied through the second liquid supply path 234 and through the second common liquid chamber 244 to the second liquid flow paths 204, as shown by arrow D in FIG. 17.

Figure 18:
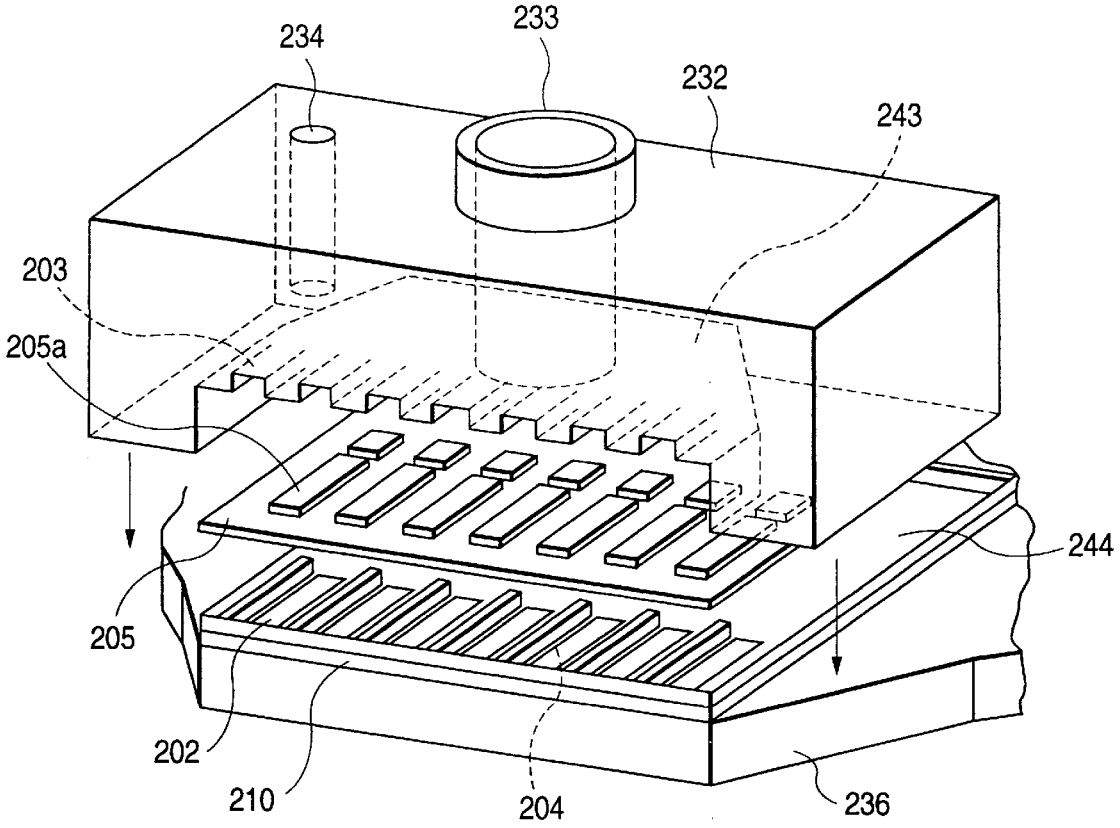
FIG. 18 is an exploded, perspective view to show a structural example of the liquid discharge apparatus according to the present invention.

FIG. 18 is an exploded, perspective view to show a structural example of the liquid discharge apparatus according to the present invention.

Also in the present embodiment, the element substrate 210 provided with a plurality of heat-generating members 202 is provided on the support body 236 made of the metal such as aluminum as in Embodiment 1.

Provided above the element substrate 210 are a plurality of grooves for forming the second liquid flow paths 204 constructed of the second liquid path walls, the recessed portion for forming the second common liquid chamber (common bubble-generating liquid chamber) 244, communicating with the plurality of second liquid flow paths 204, for supplying the bubble-generating liquid to each of the second liquid flow paths 204, and the movable separation film 205 having the thick portion 205*a* described above.

The grooved member 232 has the grooves for forming the first liquid flow paths (discharge liquid flow paths) 203 when joined with the movable separation film 205, the recessed portion for forming the first common liquid chamber (common discharge liquid chamber) 243, communicating with the discharge liquid flow paths, for supplying the discharge liquid to each of the first liquid flow paths 203, the first liquid supply path (discharge liquid supply path) 233 for supplying the discharge liquid to the first common liquid chamber 243, and the second liquid flow path (bubble-generating liquid supply path) 234 for supplying the bubble-generating liquid to the second common liquid chamber 244. The second liquid supply path 234 is connected to a communication passage communicating with the second common liquid chamber 244 as passing through the movable separation film 205 disposed outside the first common liquid chamber 243, so that the bubble-generating liquid can be supplied to the second common liquid chamber 243 through this communication passage without mixing with the discharge liquid.

The positional relation among the element substrate 210, the movable separation film 205, and the grooved member 232 is such that the thick portion 205*a* is located corresponding to the heat-generating member 202 of the element substrate 210 and that the first liquid flow path 203 is provided corresponding to this thick portion 205*a*.

Next described is the process for fabricating the movable separation film having the thick portion described above.

The movable separation film having the thick portion is made of a polyimide resin and is produced by the following process.

FIGS. 19A to 19E are drawings for explaining fabrication steps of the movable separation film in the liquid discharge apparatus shown in FIGS. 13A and 13B to FIG. 18.

Figure 19A:
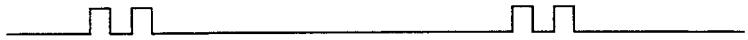
FIGS. 19A, 19B, 19C, 19D and 19E are drawings for explaining steps for producing the movable separation film in the liquid discharge apparatus shown in FIGS. 13A, 13B to FIG. 18.
Figure 19B:
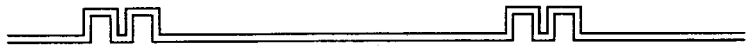

First, a mirror wafer of silicon having portions to become slacks of the movable separation film, which are made of metal or resin, is coated with a release agent and thereafter it is subjected to spin coating with liquid polyimide resin described above to form a film approximately 3 $\mu$m thick (FIG. 19B).

Then this film is cured by ultraviolet irradiation and thereafter it is subjected to further spin coating to form another layer.

Figure 19C:
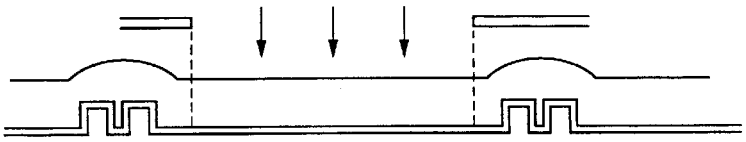

Next, the second resin layer is subjected to exposure in the portion to become the thick portion 205*a* and development is carried out (FIG. 19C).

Figure 19D:
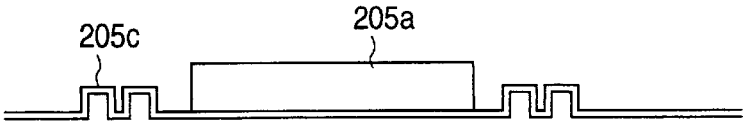

This forms the thick portion 205*a* on the thin film (FIG. 19D).

Figure 19E:
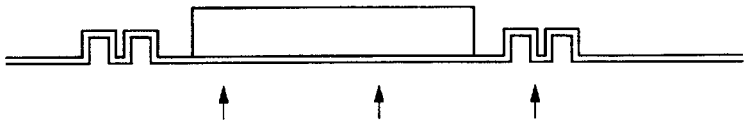

After that, this film is peeled off from the mirror wafer and is positioned and attached onto the substrate in which the second liquid flow path described above is formed, thereby making the movable separation film on the substrate (FIG. 19E).

(Embodiment 6)

Figure 20A:
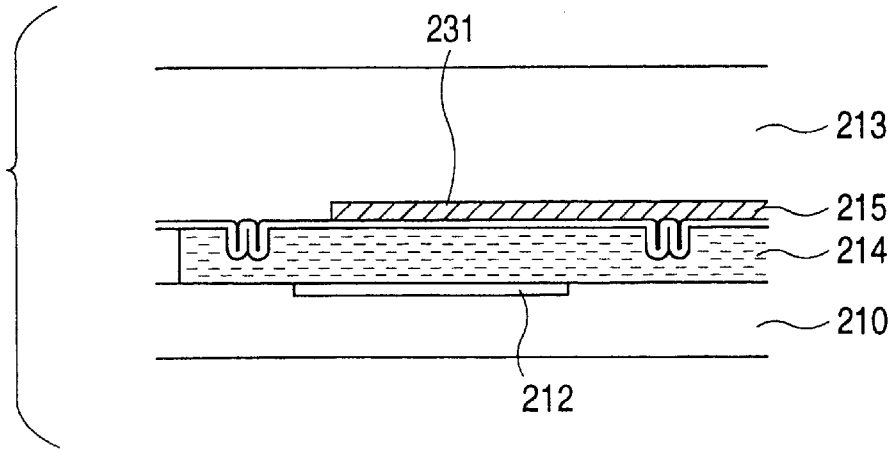
Figure 20B:
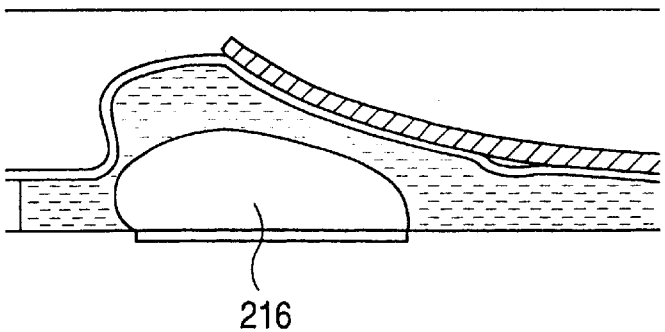

FIGS. 20A and 20B are cross-sectional views along the flow path direction to show the sixth embodiment of the liquid discharge method and the liquid discharge apparatus according to the present invention, wherein FIG. 20A is a drawing to show a state upon non-generation of bubble and FIG. 20B is a drawing to show a state upon generation of bubble (upon discharge).

The present embodiment, as shown in FIGS. 20A and 20B, has a separate member of movable member 231 as the direction regulating means, whereas the direction regulating means in the example shown in FIGS. 13A and 13B was a part of the movable separation film 215 for separating the first liquid flow path 213 from the second liquid flow path 214.

Since in the present embodiment the direction regulating means and the movable separation film are separate members, the slack portion is provided on the opposite side to that in the previous embodiment. As for the direction of the slack portion, there is no specific limitation on the direction as long as the pressure upon generation of bubble can inflate the slack portion toward the discharge port.

The movable separation film 215 is formed in uniform thickness by the similar process to that in the fifth embodiment described above.

The movable member 231 to be the direction regulating means was fabricated by electroforming of nickel.

The supply of the discharge liquid and the bubble-generating liquid may be the same as that in the fifth embodiment. In the case of the liquid discharge apparatus of the present embodiment, the separate body of the direction regulating means adds one step to the assembling process as compared with that in the fifth embodiment, but the separate arrangement of the movable separation film 215 and the direction regulating means can decrease the cost per component and, effectively utilizing the spring property of nickel, the movable separation film inflated can be returned efficiently to the original position.

In the present embodiment the movable member 231 was made of nickel, but the present invention is not limited to nickel. The material for the movable member 231 may be any material having elasticity for assuring good operation as the movable member 231.

FIGS. 21A to 21D are drawings for explaining the liquid discharge method in a modification of the liquid discharge apparatus shown in FIGS. 20A and 20B.

In the present modification as shown in FIGS. 21A to 21D, slack portion 325a is disposed on the downstream side of the movable separation film 305 facing the heat-generating member 302 and the upstream side of the movable separation film 305 facing the heat-generating member 302 has the function of the direction regulating means.

Figure 21A:
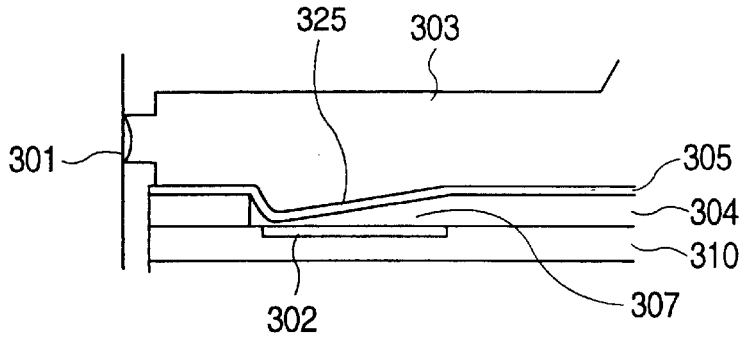
FIGS. 21A, 21B, 21C and 21D are drawings for explaining the liquid discharge method in a modification of the liquid discharge apparatus shown in FIGS. 20A and 20B.

In FIG. 21A, the energy such as the electric energy is not applied to the heat-generating member 302 yet, so that the heat is not generated in the heat-generating member 302. In this state, the slack portion 325*a* is slackened on the second liquid flow path side.

Figure 21B:
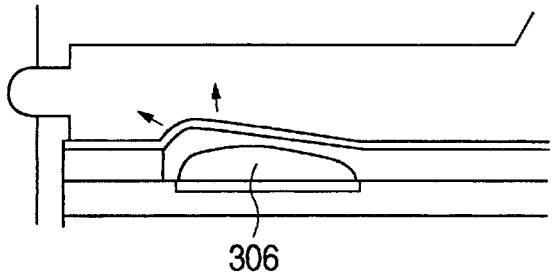

Here, when the electric energy or the like is applied to the heat-generating member 302, the heat-generating member 302 generates heat and part of the bubble-generating liquid filling the inside of the bubble-generating region 307 is heated by the heat, thus generating the bubble 306 by film boiling. When the bubble 306 is generated, the slack portion 325*a* of the movable separation film 305 is displaced from the first position to the second position on the first liquid flow path 303 side so as to guide propagation of the pressure of the bubble 306 toward the discharge port, by the pressure based on the generation of bubble 306 (FIG. 21B).

Figure 21C:
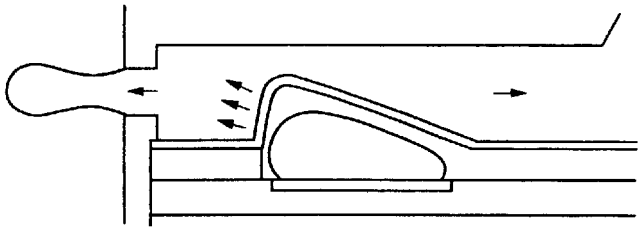

With further growth of bubble 306, the slack portion 325*a* of the movable separation film 305 is further displaced into the first liquid flow path 303 according to the pressure upon generation of bubble (FIG. 21C).

Figure 21D:
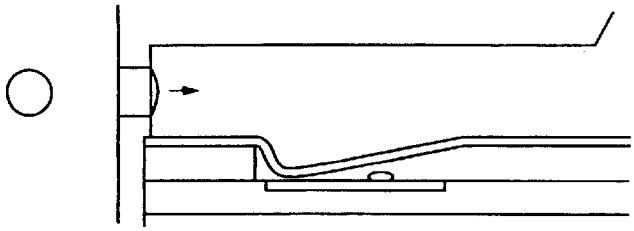

After that, when the bubble 306 contracts to disappear because of the decrease of internal pressure of bubble characteristic to the film boiling phenomenon described above, the slack portion 305*a* of the movable separation film 305 having been displaced up to the second position returns to the initial position (the first position) by the restoring force due to the negative pressure upon contraction of bubble 306 and the spring property of the movable separation film 305 itself (FIG. 21D).

(Embodiment 7)

Figure 22A:
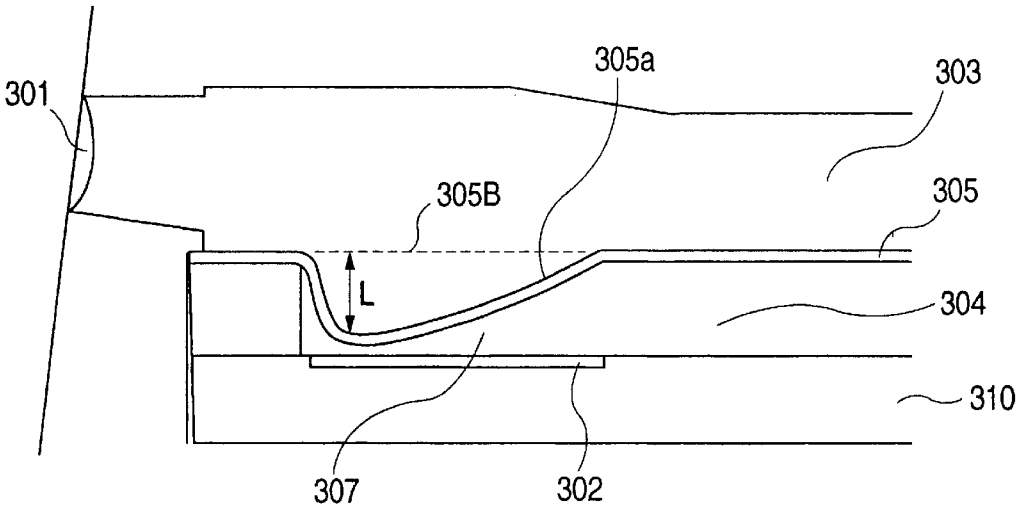
Figure 22B:
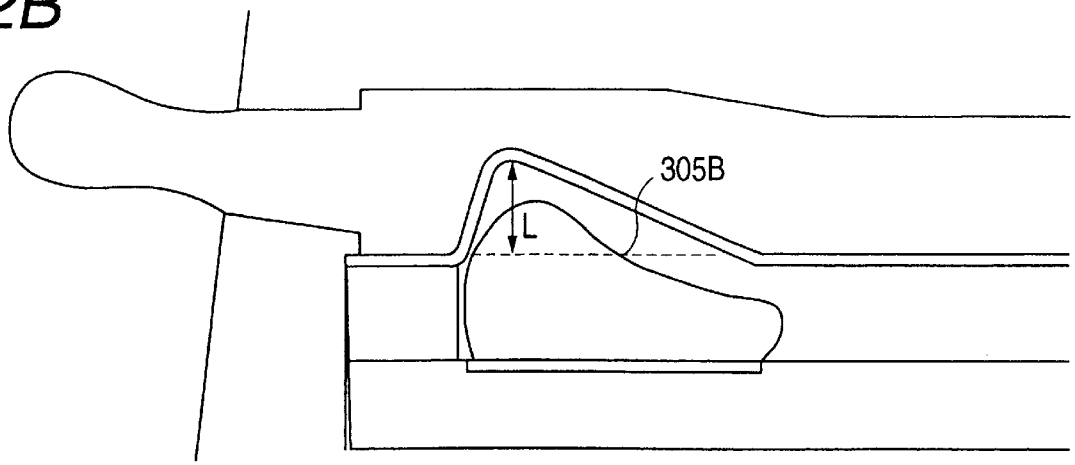

FIGS. 22A and 22B are cross-sectional views along the flow path direction to show the seventh embodiment of the liquid discharge apparatus according to the present invention, wherein FIG. 22A is a drawing to show a state upon non-generation of bubble and FIG. 22B is a state upon generation of bubble (upon discharge).

In the present embodiment, as shown in FIGS. 22A and 22B, the second liquid flow path 304 for bubble-generating liquid is provided on the substrate 310 provided with the heat-generating member 302 (the heating resistor member in the shape of 40 $\mu$m×105 $\mu$m in the present embodiment) for supplying the thermal energy for generating the bubble in the liquid, and the first liquid flow path 303 for discharge liquid in direct communication with the discharge port 301 is provided above it. The movable separation film 305 made of a thin film with little elasticity is provided between the first liquid flow path 303 and the second liquid flow path 304 and the movable separation film 305 separates the discharge liquid in the first liquid flow path 303 from the bubble-generating liquid in the second liquid flow path 304.

Here, the movable separation film 305 in the portion located in the projection area above the surface of the heat-generating member 302 projects into the second liquid flow path 304 upon non-generation of bubble and distance L of projection from reference surface 305B of the movable separation film is longer on the downstream side, which is the discharge port 301 side of the first liquid flow path 303, than on the upstream side, which is the common liquid chamber (not shown) side, as shown in FIG. 22A. Thus, this shape is inverted in FIG. 22B, thus achieving the displacing step as stated in the present invention. Namely, since the shape of the movable separation film is preliminarily defined, desired displacement can be achieved stably. Further, the simple structure is achieved, because the direction regulating member is the movable separation film itself.

The maximum volume (the sum of volumes made by the projecting portion at each position of FIG. 22A and FIG. 22B) caused by the displacement of convex portion 305*a* being the projecting portion is determined to be larger than the maximum expansion volume of the bubble generated in the bubble-generating region 307.

The distance between the surface of the movable separation film 305 where the convex portion 305*a* is not formed, and the surface of the heat-generating member 302 is set to approximately 5 to 20 $\mu$m. The bubble-generating region 307 is defined between the heat-generating member 302 and the convex portion 305*a*.

Here, when the electric energy or the like is applied to the heat-generating member 302, the heat-generating member 302 generates heat and part of the bubble-generating liquid filling the inside of the bubble-generating region 307 is heated by the heat, thus generating the bubble 306 by film boiling. When the bubble 306 is generated, the convex portion 305*a* of the movable separation film 305 is displaced from the first position to the second position on the first liquid flow path 303 side so as to guide propagation of the pressure of the bubble 306 toward the discharge port, by the pressure based on the generation of bubble 306.

In the present embodiment, since the movable separation film 305 is formed so as to be displaced into the first liquid flow path 303 by displacement of the convex portion 305*a*, the energy upon generation of bubble contributes more efficiently to the displacement of the movable separation film 305, as compared with the arrangement wherein the movable separation film 305 extends with generation of bubble to be displaced into the first liquid flow path 303. Thus, the present embodiment can achieve efficient discharge. Further, since the convex portion 305*a* of the movable separation film 305 is formed so that the maximum displacement volume thereof becomes greater than the maximum expansion volume of the bubble generated in the bubble-generating region 407, the growth of bubble is not regulated and further efficient discharge can be achieved.

In the present embodiment, since the movable separation film 305 is preliminarily projected into the second liquid flow path 304, the displacement amount becomes greater when the movable separation film 305 is displaced from the first position to the second position so as to guide propagation of pressure of bubble 306 toward the discharge port, by the pressure based on the generation of bubble 306, which increases the discharge efficiency of liquid from the discharge port 301. Since the distance L of the convex portion 305*a* of the movable separation film 305 is longer on the discharge port 301 side than on the common liquid chamber side, it is easy to transmit the pressure based on the generation of bubble 306 to the discharge port 301 in the first liquid flow path 303 for discharge liquid, which increases the discharge efficiency of liquid from the discharge port 301.

After that, when the bubble 306 contracts to disappear because of the decrease of internal pressure of bubble characteristic to the film boiling phenomenon described above, the convex portion 305*a* of the movable separation film 305 having been displaced up to the second position returns to the initial position (the first position) by the restoring force due to the negative pressure upon contraction of bubble 306 and the spring property of the movable separation film 305 itself.

Further, since the structure of the liquid discharge apparatus of the present invention also achieves the effects as described in the foregoing embodiments, the liquid such as the high-viscosity liquid can be discharged at further higher discharge efficiency and under further higher discharge force.

(Embodiment 8)

Figure 23A:
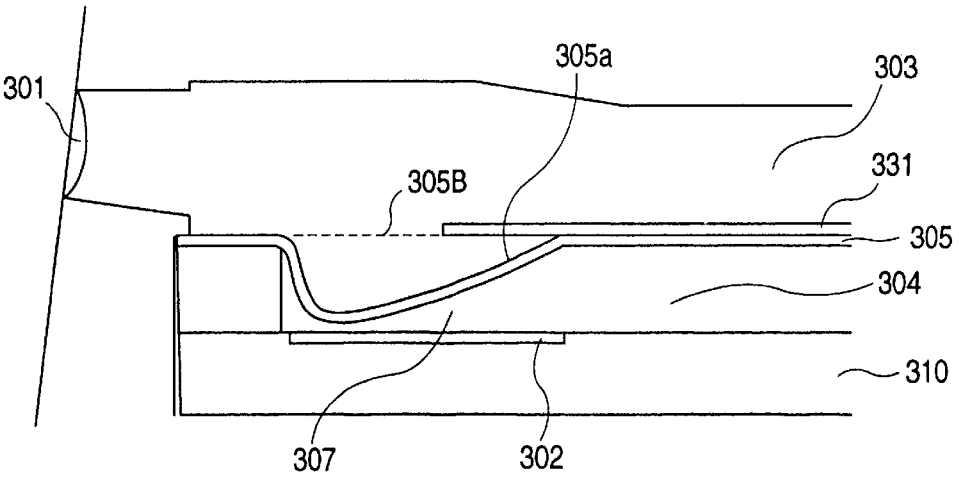
Figure 23B:
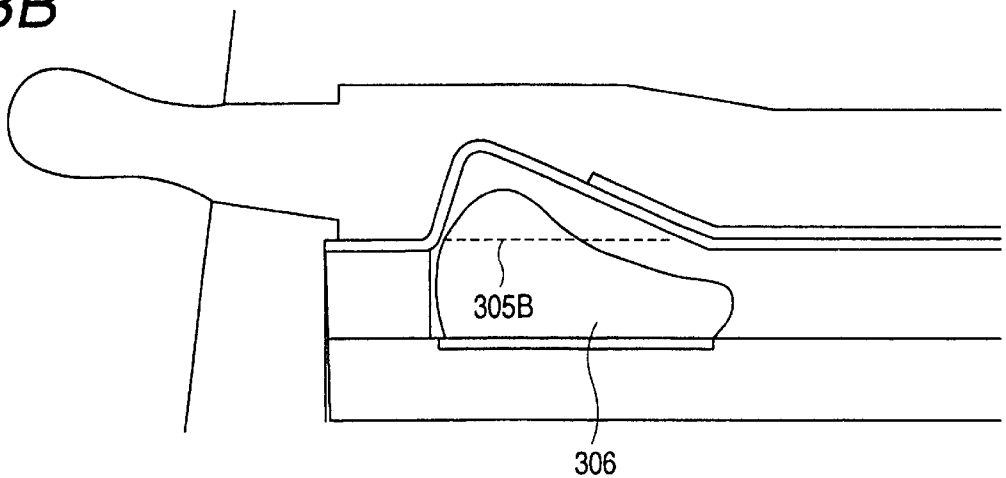

FIGS. 23A and 23B are cross-sectional views along the flow path direction to show the eighth embodiment of the liquid discharge method and the liquid discharge apparatus according to the present invention, wherein FIG. 23A is a drawing to show a state upon non-generation of bubble and FIG. 23B is a drawing to show a state upon generation of bubble (upon discharge).

In the present embodiment, as shown in FIGS. 23A and 23B, in addition to the structure shown in FIGS. 22A and 22B, the movable member 331, capable of being displaced, for regulating displacement of the movable separation film 305 is provided between the movable separation film 305 and the first liquid flow path 303, and the other structure is the same as in FIGS. 22A and 22B. The movable member 331 is made by electroforming of nickel. The supply of the discharge liquid and the bubble-generating liquid may be the same as described in the seventh embodiment.

In the liquid discharge apparatus constructed as described above, a large displaceable amount of the movable separation film 305 upon generation of bubble can also be assured stably. Further, the movable member 331 can reinforce the action for guiding the displacement of the movable separation film 305 toward the discharge port. Since the movable separation film 305 is projecting into the second liquid flow path 304 upon non-generation of bubble, the liquid above the projecting portion can also be guided to the discharge port 301 upon generation of bubble.

The movable member 331 also helps the projecting force of the convex portion 305a of the movable separation film 305 into the second liquid flow path 304.

The present embodiment used nickel for the movable member 331, but the present invention may employ any material without having to be limited to it, if the material has elasticity enough to assure good operation as the movable member 331.

(Embodiment 9)

Figure 24A:
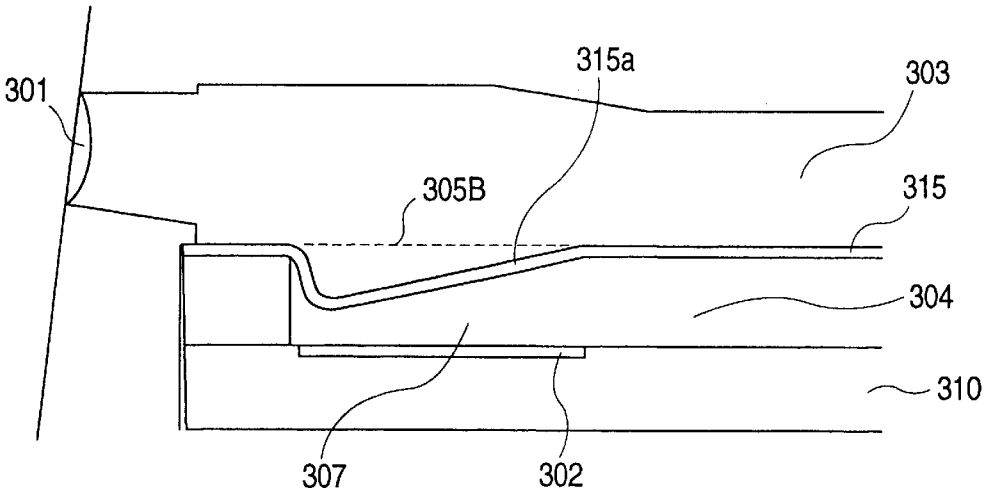
Figure 24B:
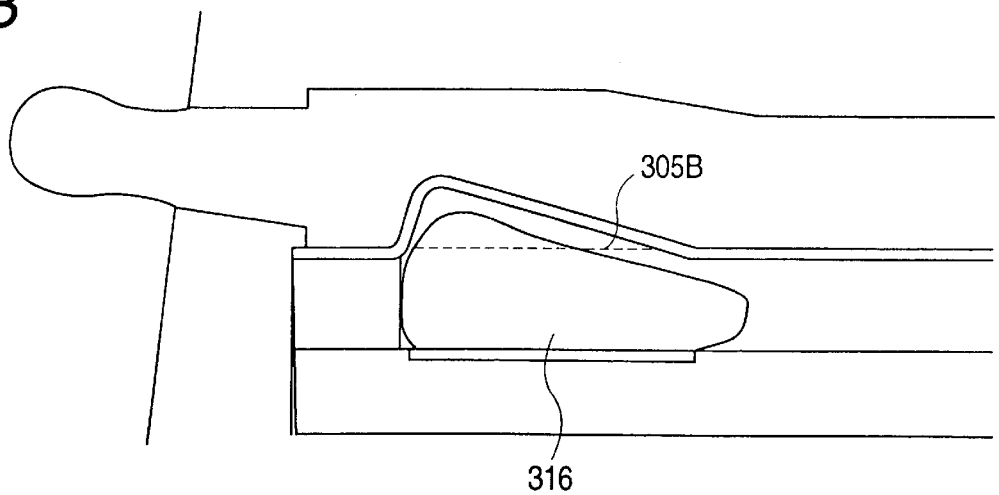

FIGS. 24A and 24B are cross-sectional views along the flow path direction to show the ninth embodiment of the liquid discharge method and the liquid discharge apparatus according to the present invention, wherein FIG. 24A is a drawing to show a state upon non-generation of bubble and FIG. 24B is a drawing to show a state upon generation of bubble (upon discharge).

When the electric energy is applied to the heat-generating member, the heat-generating member generates heat and part of the bubble-generating liquid filling the inside of the bubble-generating region is heated by the heat, thus generating the bubble by film boiling. On that occasion, the maximum expansion volume of bubble is not always constant because of dispersion elements due to the fabrication process, environmental conditions, etc. or it may differ nozzle by nozzle.

Thus, the present embodiment, as shown in FIGS. 24A and 24B, is arranged so that the maximum displacement volume of the convex portion 315*a* of the movable separation film 315 is smaller than the maximum expansion volume of the bubble 316 generated in the bubble-generating region 307.

Specifically, since the dispersion of expansion volume of bubble 316 due to the discharge characteristics of liquid is ±10%, the maximum displacement volume of the convex portion 315*a* of the movable separation film 315 is arranged to be 80% or less of the maximum expansion volume of the bubble 316 generated in the bubble-generating region 307.

This arrangement always keeps constant the displacement amount of the convex portion 315*a* of the movable separation film 315 upon generation of bubble even with dispersion of the expansion volume of bubble 316 due to the discharge characteristics of liquid, whereby the discharge amount of the discharge liquid becomes constant, thus achieving good discharge without dispersion among nozzles.

(Embodiment 10)

Figure 25A:
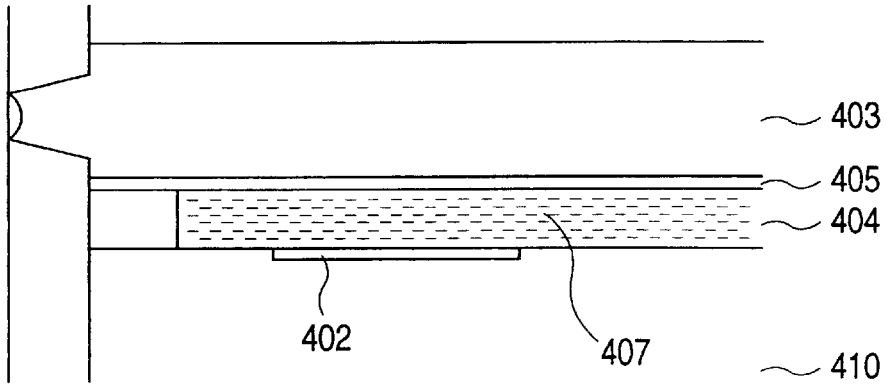
Figure 25B:
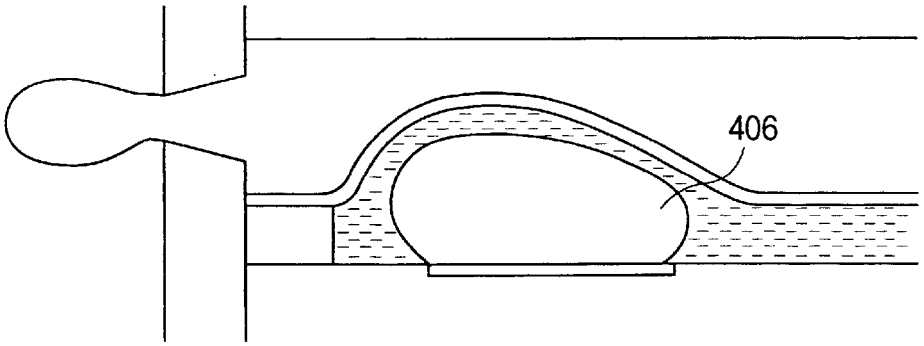
Figure 25C:
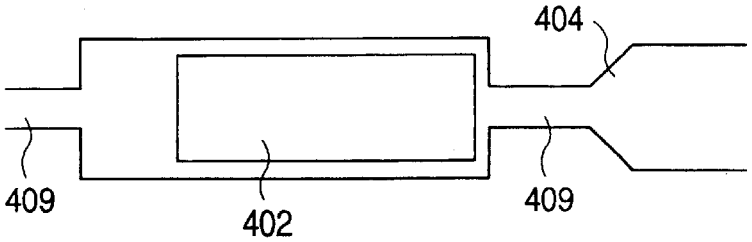

FIGS. 25A to 25C are drawings to show the tenth embodiment of the liquid discharge apparatus according to the present invention, wherein FIG. 25A is a cross-sectional view along the flow path direction to show a state upon non-generation of bubble, FIG. 25B is a cross-sectional view along the flow path direction to show a state upon generation of bubble (upon discharge), and FIG. 25C is a drawing to show the configuration of the second liquid flow path.

In the present embodiment, as shown in FIGS. 25A to 25C, the second liquid flow path 404 for bubble-generating liquid is provided on the substrate 410 provided with the heat-generating member 402 (the heating resistor member in the shape of 40 $\mu$m×105 $\mu$m in the present embodiment) for supplying the thermal energy for generating the bubble in the liquid, and the first liquid flow path 403 for discharge liquid in direct communication with the discharge port 401 is provided above it. The movable separation film 405 made of a thin film with elasticity is provided between the first liquid flow path 403 and the second liquid flow path 404, and the movable separation film 405 separates the discharge liquid in the first liquid flow path 403 from the bubble-generating liquid in the second liquid flow path 404.

When the heat-generating member 402 generates heat, the heat acts on the bubble-generating liquid in the bubble-generating region 407 between the movable separation film 405 and the heat-generating member 402, thereby generating the bubble based on the film boiling phenomenon in the bubble-generating liquid. The pressure based on the generation of bubble preferentially acts on the movable separation film 405, so that the movable separation film 405 is displaced so as to develop greatly toward the discharge port 401. This guides the bubble generated in the bubble-generating region 407 toward the discharge port 401.

In the present embodiment the second liquid flow path 404 is formed up to a further downstream position over the bubble-generating region 407 located immediately above the heat-generating member 402, whereby flow resistance on the downstream side becomes smaller than that immediately above the heat-generating member 402, so as to make it easier to guide the pressure due to the bubble generated by heat in the heat-generating member 402 to downstream. Therefore, the movable separation film 405 is also displaced toward the discharge port 401, thus achieving high discharge efficiency and high discharge force.

Since direct action of the bubble itself can be utilized by regulating growth of bubble in the second liquid flow path, the effect appears from the initial stage of generation of bubble.

Further, since the movable separation film 405 quickly returns to the position before displacement by the pressure upon contraction of bubble 406 as the bubble 406 contracts, the refilling speed of the discharge liquid into the first liquid flow path 403 is enhanced in addition to the control of the acting direction of pressure, thereby achieving stable discharge also in high-speed printing.

(Embodiment 11)

Figure 26A:
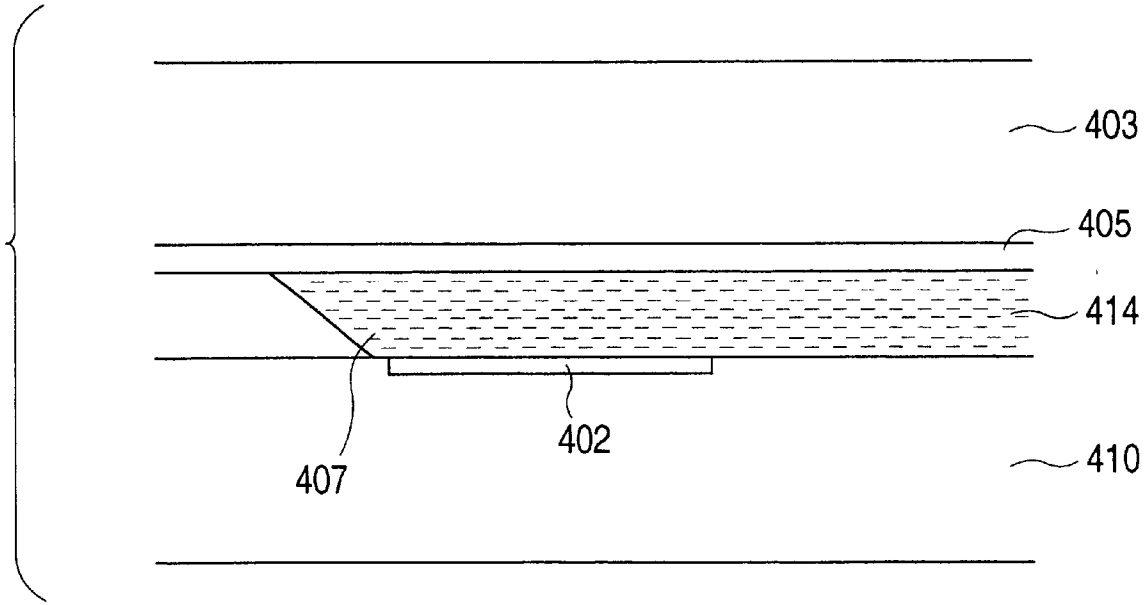
Figure 26B:
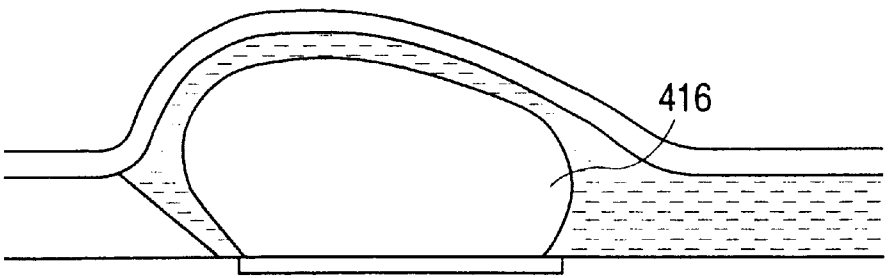

FIGS. 26A and 26B are cross-sectional views along the flow path direction to show the eleventh embodiment of the liquid discharge method and the liquid discharge apparatus according to the present invention, wherein FIG. 26A is a drawing to show a state upon non-generation of bubble and FIG. 26B is a drawing to show a state upon generation of bubble (upon discharge).

In the present embodiment, as shown in FIGS. 26A and 26B, the wall of the second liquid flow path 411 on the discharge port side of the heat-generating member 402 is formed in such a tapered shape as to expand toward the discharge port, whereby the flow resistance in and near the bubble-generating region 407 decreases along the flow path toward the discharge port, so as to make it easier to guide the pressure of bubble 416 generated by heat in the heat-generating member 402 toward the discharge port, thus achieving high discharge efficiency and high discharge force, similarly as in the tenth embodiment.

Figure 27A:
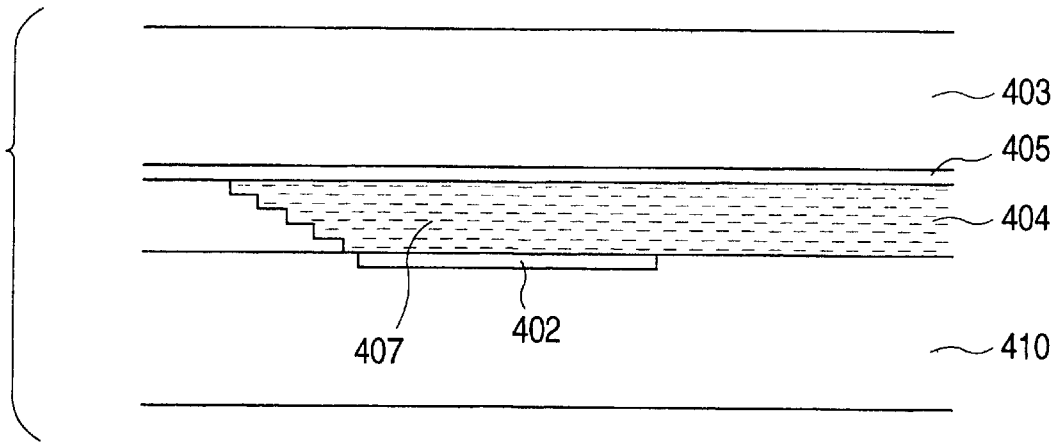
Figure 27B:
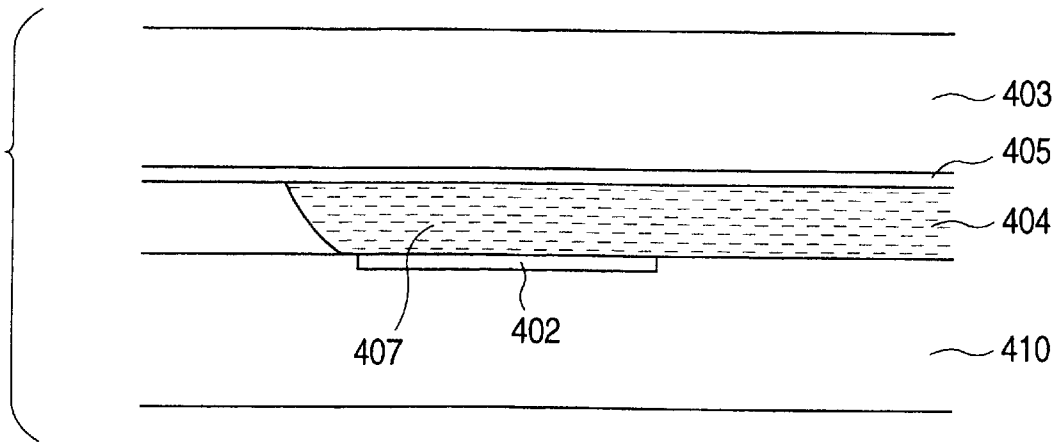

FIGS. 27A and 27B are cross-sectional views along the flow path direction to show modifications of the liquid discharge apparatus shown in FIGS. 26A and 26B, wherein FIG. 27A is a drawing to show a modification in which the part of the second liquid flow path wall is formed stepwise and FIG. 27B is a drawing to show another modification in which the part of the second liquid flow path wall is formed in a shape with a certain radius of curvature.

In the modification shown in FIG. 27A, the wall of the second liquid flow path 424 on the discharge port side of the heat-generating member 402 is formed in such a stepped shape as to expand toward the discharge port and in the modification shown in FIG. 27B, the wall of the second liquid flow path 434 on the discharge port side of the heat-generating member 402 is formed in such a shape with a certain radius of curvature as to expand toward the discharge port. In either case, the flow resistance in and near the bubble-generating region 407 thus decreases toward the discharge port, so as to make it easier to guide the pressure of bubble generated by heat in the heat-generating member 402 to the discharge port, thus achieving high discharge efficiency and high discharge force, similarly as in the embodiment shown in FIGS. 26A and 26B.

(Embodiment 12)

Figure 28A:
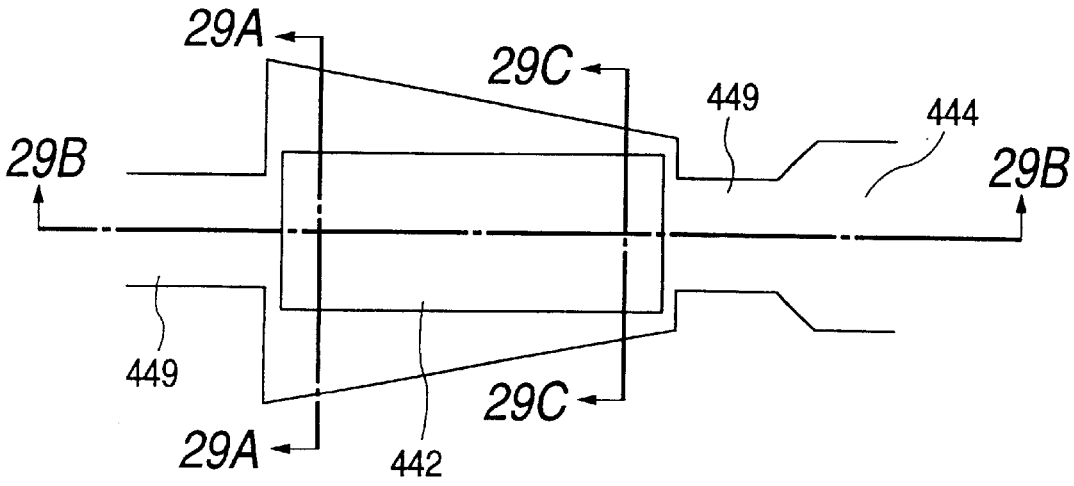
Figure 28B:
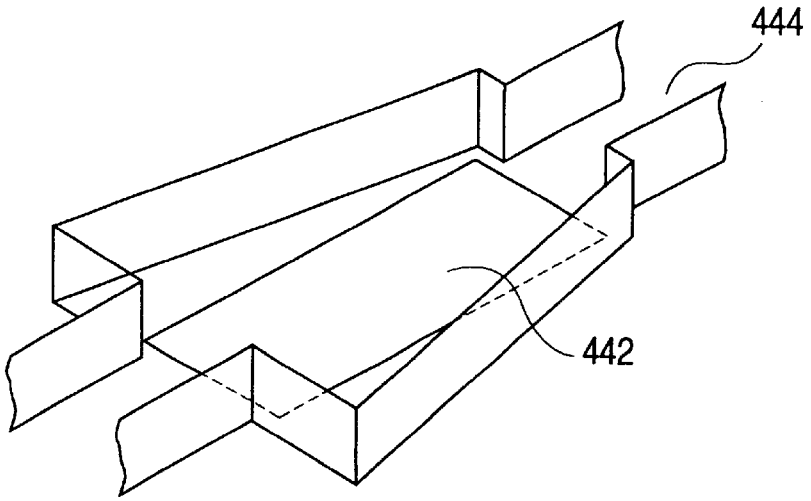

FIGS. 28A and 28B are drawings to show the twelfth embodiment of the liquid discharge apparatus according to the present invention, wherein FIG. 28A is a top plan view to show the positional relation between the second liquid flow path and the heat-generating member and FIG. 28B is a perspective view of the arrangement shown in FIG. 28A and wherein the discharge port is located on the left side in FIG. 28A.

As shown in FIGS. 28A and 28B, the second liquid flow path in the present embodiment has such a shape that the width of the second liquid flow path 444 gradually increases from upstream to downstream near the heat-generating member 442, as compared with that shown in FIGS. 25A to 25C.

The discharge operation in the liquid discharge apparatus constructed as described above will be described in detail.

Figures 29A, 29B, 29C:
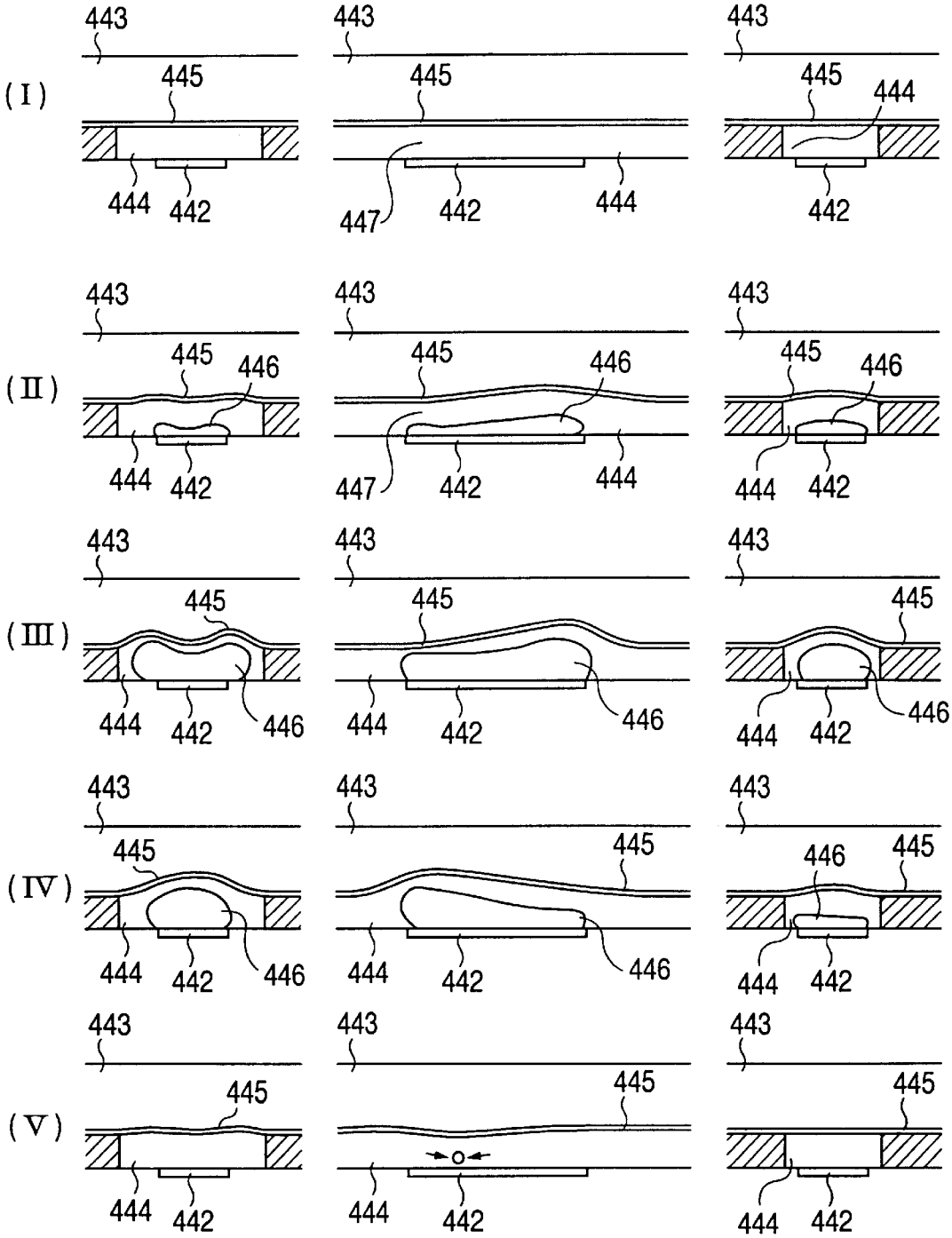
FIGS. 29A, 29B and 29C are drawings for explaining the discharge operation in the liquid discharge apparatus shown in FIGS. 28A and 28B, wherein FIG. 29A includes cross-sectional views along 29A—29A shown in FIG. 28A, FIG. 29B includes cross-sectional views along 29B—29B shown in FIG. 28A, and FIG. 29C includes cross-sectional views along 29C—29C shown in FIG. 28A.

FIGS. 29A to 29C are drawings for explaining the discharge operation in the liquid discharge apparatus shown in FIGS. 28A and 28B, wherein FIG. 29A includes cross-sectional views along 29A—29A shown in FIG. 28A, FIG. 29B includes cross-sectional views along 29B—29B shown in FIG. 28A, and FIG. 29C includes cross-sectional views along 29C—29C shown in FIG. 28A.

(I) in FIGS. 29A to 29C, the electric energy is not applied to the heat-generating member 442 yet, so that no heat is generated in the heat-generating member 442. The movable separation film 445 is located at the first position nearly parallel to the substrate 420.

Here, when the electric energy is applied to the heat-generating member 442, the heat-generating member 442 generates heat and part of the bubble-generating liquid filling the inside of the bubble-generating region 447 is heated by the heat, thus generating the bubble 446 by film boiling ((II) in FIGS. 29A to 29C).

The heat by the heat-generating member 442 quickly grows the bubble 446 thus generated, whereupon, because of the shape of the second liquid flow path 444 shown in FIGS. 28A and 28B, the central portion of the bubble grows large on the upstream side while the both end portions thereof grow large on the downstream side, thereby displacing the movable separation film 445 therewith ((III) in FIGS. 29A to 29C).

With further growth of bubble 446, the central portion downstream grows largest, which displaces the downstream portion of the movable separation film 445 greatly ((IV) in FIGS. 29A to 29C).

After that, when the bubble 446 contracts to disappear because of the decrease of the internal pressure of bubble characteristic to the film boiling phenomenon described above, the movable separation film 445 thus displaced returns to the initial position by the restoring force due to the negative pressure upon contraction of bubble 446 and the spring property of the movable separation film 445 itself ((V) in FIGS. 29A to 29C).

As described above, the pressure occurring with generation of bubble 446 gradually becomes directed to downstream, i.e., toward the discharge port.

This gradually decreases the flow resistance in and near the bubble-generating region 447 toward the discharge port, so as to make it easier to guide the pressure of the bubble generated by heat in the heat-generating member 442 toward the discharge port, thus achieving high discharge efficiency and high discharge force, similarly as in the tenth embodiment. This can also transport the first liquid in the projection area of the heat-generating member 442 to the discharge port, thus increasing the discharge amount.

Figure 30A:
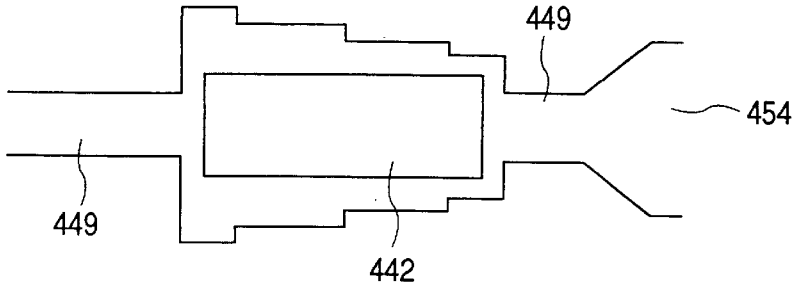
Figure 30B:
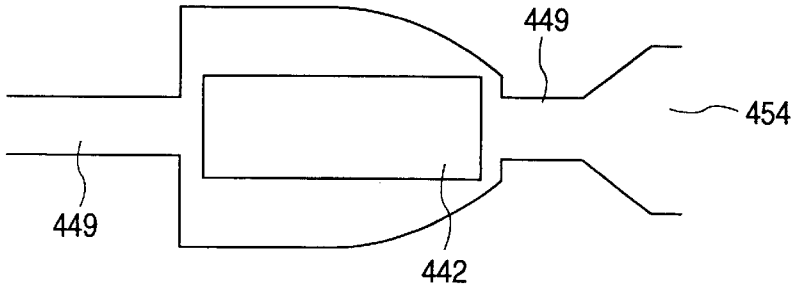
Figure 30C:
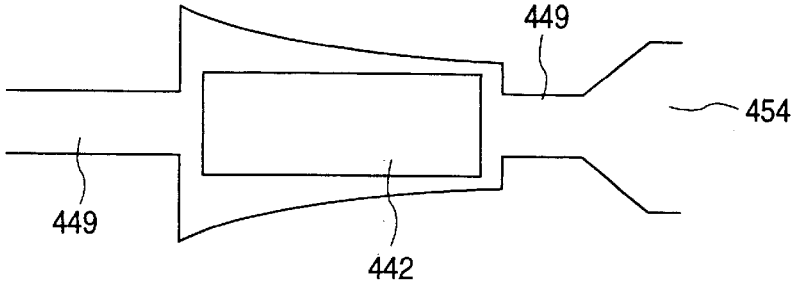

FIGS. 30A to 30C are drawings to show modifications of the liquid discharge apparatus shown in FIGS. 28A and 28B, wherein FIG. 30A is a drawing to show a modification in which the width of the second liquid flow path near the heat-generating member gradually increases stepwise from upstream to downstream, FIG. 30B is a drawing to show a modification in which the width of the second liquid flow path near the heat-generating member gradually increases at a certain radius of curvature from upstream to downstream, and FIG. 30C is a drawing to show a modification in which the width of the second liquid flow path near the heat-generating member gradually increases at the opposite radius of curvature to FIG. 30B from upstream to downstream. In either drawing the discharge port is located on the left side in the drawing.

Since in the modification shown in FIG. 30A the width of the second liquid flow path 454 near the heat-generating member 442 gradually increases stepwise from upstream to downstream, since in the modification shown in FIG. 30B the width of the second liquid flow path 464 near the heat-generating member 442 gradually increases at the certain radius of curvature from upstream to downstream, or since in the modification shown in FIG. 30C the width of the second liquid flow path 474 near the heat-generating member 442 gradually increases at the opposite radius of curvature to FIG. 30B from upstream to downstream, the flow resistance in and near the bubble-generating region gradually decreases toward the discharge port in either case, so as to make it easier to guide the pressure of the bubble generated by heat in the heat-generating member 442 toward the discharge port, thus achieving high discharge efficiency and high discharge force.

(Embodiment 13)

FIGS. 31A to 31E are drawings for explaining the operation of the liquid discharge apparatus to show the thirteenth embodiment of the liquid discharge apparatus according to the present invention.

In the present embodiment, similar to each of the previous embodiments, the second liquid flow path 504 for bubble-generating liquid is provided on the substrate 510 provided with the heat-generating member 502 (the heating resistor member in the shape of 40 $\mu$m×105 $\mu$m in the present embodiment) for supplying the thermal energy for generating the bubble in the liquid, and the first liquid flow path 503 for discharge liquid in direct communication with the discharge port 501 is provided above it. Further, the movable separation film 505 made of a thin film with elasticity is provided between the first liquid flow path 503 and the second liquid flow path 504 and the movable separation film 505 separates the discharge liquid in the first liquid flow path 503 from the bubble-generating liquid in the second liquid flow path 504. A further feature of the present embodiment is that a movable separation film displacement regulating member 531 having an opening portion near the bubble-generating region 507 and arranged to restrict displacement of the movable separation film 505 is provided on the first liquid flow path 503 side of the movable separation film 505.

The discharge operation of the liquid discharge apparatus of the present embodiment will be described in detail with reference to FIGS. 31A to 31E.

Figure 31A:
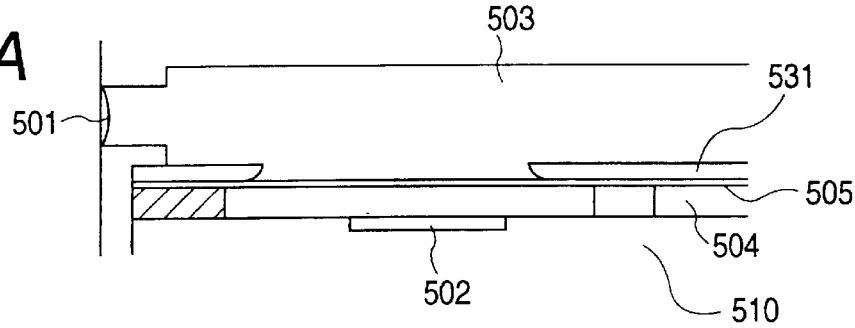
FIGS. 31A, 31B, 31C, 31D and 31E are drawings for explaining the operation of the liquid discharge apparatus to show the thirteenth embodiment of the liquid discharge apparatus according to the present invention.

In FIG. 31A, the energy such as the electric energy is not applied to the heat-generating member 502 yet, so that no heat is generated in the heat-generating member 502. The movable separation film 505 is located at the first position nearly parallel to the substrate 510.

An important point herein is that the center of the opening portion of the movable separation film displacement regulating member 531 is located downstream of the center of the heat-generating member 502, which locates the center of the movable area of the movable separation film 505 on the downstream side of the center of the heat-generating member 502.

Figure 31B:
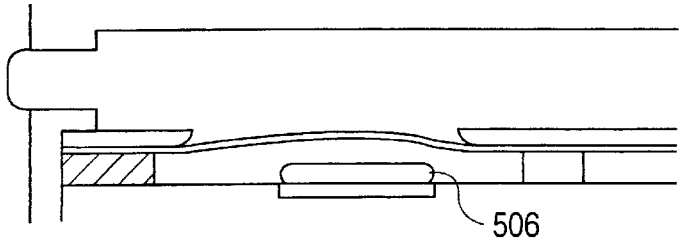

Here, when the electric energy or the like is applied to the heat-generating member 502, the heat-generating member 502 generates heat and part of the bubble-generating liquid filling the inside of the bubble-generating region 507 is heated by the heat, thus generating the bubble 506 by film boiling. Since the center of the movable area of the movable separation film 505 is located downstream of the center of the heat-generating member 502, the movable separation film 505 becomes easier to be displaced on the downstream side of the heat-generating member 502 by the pressure of bubble 506 (FIG. 31B).

Figure 31C:
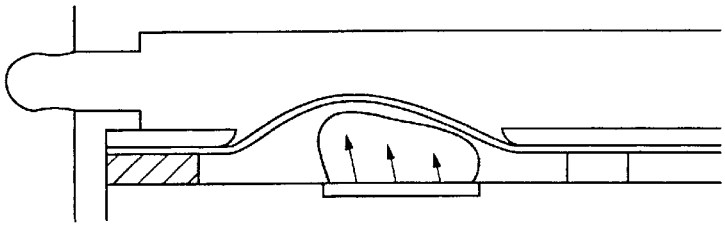

With further growth of the bubble 506, the movable separation film 506 is further displaced into the first liquid flow path 503 according to the pressure upon generation of bubble. As a result, the bubble 506 generated grows greater downstream than upstream, so that the movable separation film 505 moves greatly over the first position (FIG. 31C).

Figure 31D:
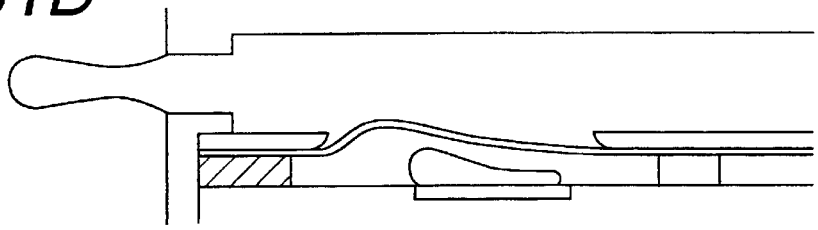

After that, as the bubble 506 contracts because of the decrease of internal pressure of bubble characteristic to the film boiling phenomenon described above, the movable separation film 505 having been displaced up to the second position gradually returns to the initial position (the first position) shown in FIG. 31A by the negative pressure upon contraction of bubble 506 (FIG. 31D).

Figure 31E:
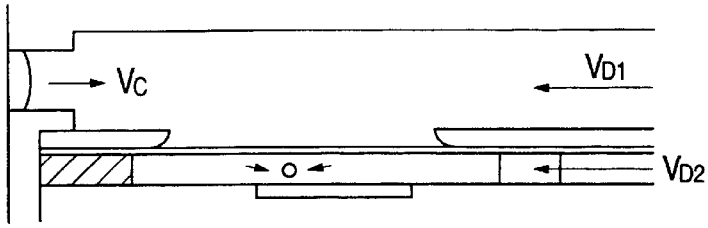

When the bubble 506 is collapsed, the movable separation film 505 returns to the initial position (the first position) (FIG. 31E). Upon collapse of bubble, in order to compensate for the volume of liquid ejected, the liquid flows as indicated by $V_{D1}$, $V_{D2}$ from upstream, i.e., from the common liquid chambers and as indicated by $V_c$ from the discharge port 501. At this time, since there was the flow of liquid from the heat-generating member 502 to downstream (to the discharge port), the flow of $V_{D1}$, $V_{D2}$ is greater, which is useful to increase of refilling speed and decrease of retracting amount of meniscus.

Since the opening portion of the movable separation film 531 is rounded in the thickness direction as shown in FIGS. 31A to 31E, stress concentration on the movable separation film 505 in this portion is relieved, so as to decrease degradation of strength, thus improving durability.

Next described is the structure and fabrication process of the liquid discharge apparatus described above.

Figure 32A:
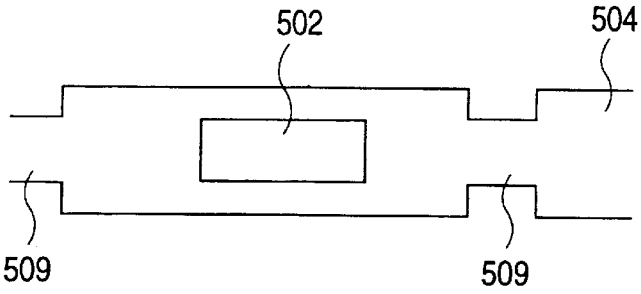
Figure 32B:
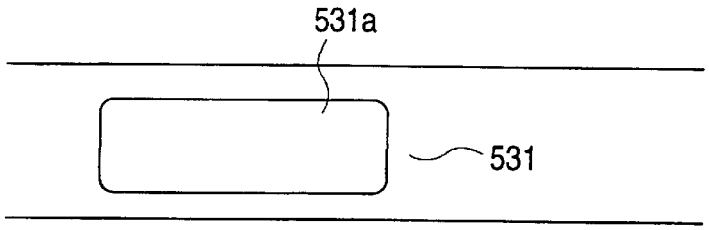
Figure 32C:
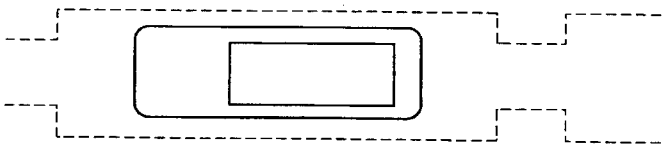
Figure 32D:
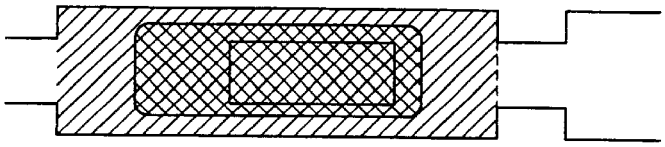

FIGS. 32A to 32D are drawings for explaining the positional relation among the heat-generating member 502, the second liquid flow path 504, and the movable separation film displacement regulating member 531 in the liquid discharge apparatus shown in FIGS. 31A to 31E, wherein FIG. 32A is a drawing to show the positional relation between the heat-generating member 502 and the second liquid flow path 504, FIG. 32B is a top plan view of the movable separation film displacement regulating member 531, FIG. 32C is a drawing to show the positional relation among the heat-generating member 502, the second liquid flow path 504, and the movable separation film displacement regulating member 531, and FIG. 32D is a drawing to show the displaceable areas of the movable separation film 505 and wherein in either drawing the discharge port is located on the left side of the drawing.

As shown in FIG. 32D, the present embodiment is arranged so that the downward displaceable area of the movable separation film 505 where the movable separation film 505 can be displaced downward is the area surrounded by the wall of the second liquid flow path 504, so that the upward displaceable area of the movable separation film 505 where the movable separation film 505 can be displaced upward is the area in the opening portion of the movable separation film displacement regulating member 531, and so that the center of the movable area of the movable separation film 505 is located downstream of the center of the heat-generating member 502.

As shown in FIG. 32B, the four corners of the opening portion 531*a* of the movable separation film displacement regulating member 531 are rounded, so as to prevent the movable separation film 505 from being broken thereby, thus improving the durability.

The second liquid flow path 504 is provided with constricted portions 509 for the same purposes as in the fifth embodiment, before and after the heat-generating member 502, and a large space is given on the discharge port 501 side of the heat-generating member 502.

As described above, since the structure of the present embodiment is such that the center of the movable area of the movable separation film is located downstream of the center of the heat-generating member whereby the movable separation film displaced according to the pressure upon generation of bubble grows on the downstream side, the liquid weak against heat, the high-viscosity liquid, or the like can be discharged at high efficiency and under high discharge pressure. In addition, a further increase of discharge amount is achieved by the transport action of the liquid in the first liquid flow path.

(Embodiment 14)

Figure 33:
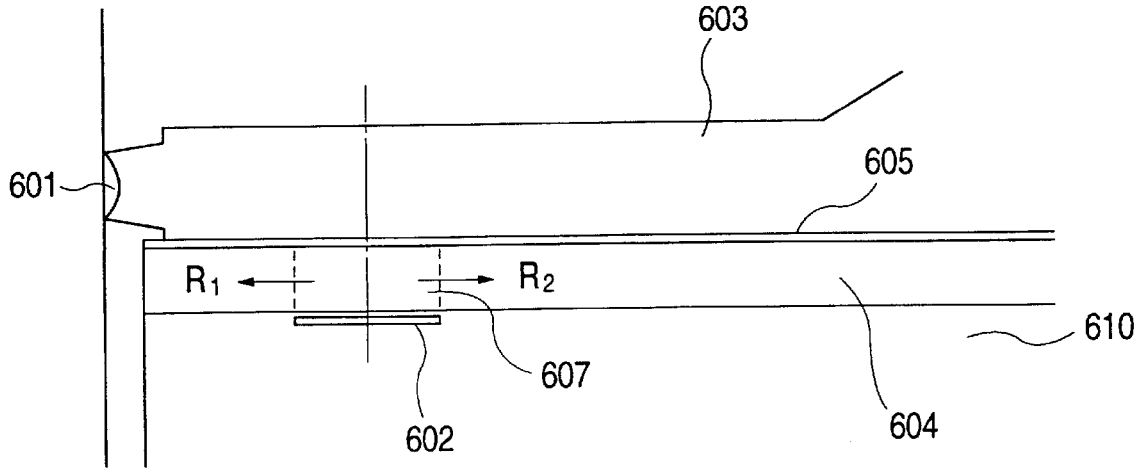
FIG. 33 is a cross-sectional view along the flow path direction to show the fourteenth embodiment of the liquid discharge apparatus according to the present invention.

FIG. 33 is a cross-sectional view along the flow path direction to show the fourteenth embodiment of the liquid discharge apparatus according to the present invention.

In the present embodiment, as shown in FIG. 33, the second liquid flow path 604 for bubble-generating liquid is provided on the substrate 610 provided with the heat-generating member 602 (the heating resistor member in the shape of 40 $\mu$m×105 $\mu$m in the present embodiment) for supplying the thermal energy for generating the bubble in the liquid, and the first liquid flow path 603 for discharge liquid in direct communication with the discharge port 601 is provided above it. Further, the movable separation film 605 made of a thin film with elasticity is provided between the first liquid flow path 603 and the second liquid flow path 604 and the movable separation film 605 separates the discharge liquid in the first liquid flow path 603 from the bubble-generating liquid in the second liquid flow path 604.

When the heat-generating member 602 generates heat, the bubble is generated based on the film boiling phenomenon in the bubble-generating liquid. Here, the flow resistance $R_1$ downstream of the center of the area of the heat-generating member 602 is greater than the flow resistance $R_2$ upstream thereof in the second liquid flow path 604, whereby among the pressure based on the generation of bubble, components downstream of the center of area of the heat-generating member 602 preferentially act on the movable separation film 605 while upstream components act not only on the movable separation film 605 but also on the upstream side.

Thus, as the bubble grows continuously, the movable separation film 605 is displaced greater toward the discharge port 601. This guides the pressure due to the bubble generated in the bubble-generating region 607 to the discharge port 601.

The discharge operation of the liquid discharge apparatus constructed as described above will be described in detail.

FIGS. 34A to 34D are drawings for explaining the operation of the liquid discharge apparatus shown in FIG. 33.

Figure 34A:
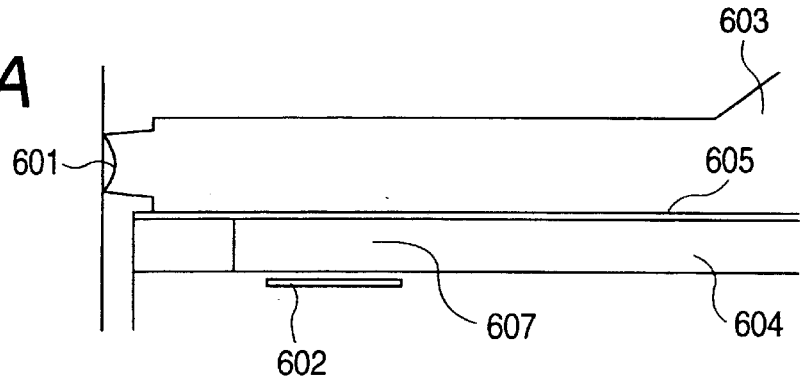
FIGS. 34A, 34B, 34C and 34D are drawings for explaining the operation of the liquid discharge apparatus shown in FIG. 33.

In FIG. 34A, the energy such as the electric energy is not applied to the heat-generating member 602 yet, so that no heat is generated in the heat-generating member 602.

Figure 34B:
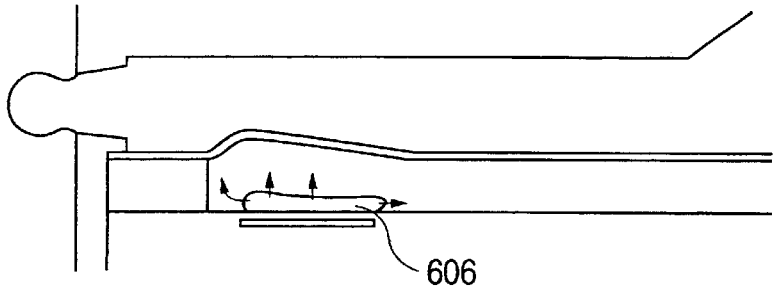

Here, when the electric energy or the like is applied to the heat-generating member 602, the heat-generating member 602 generates heat and part of the bubble-generating liquid filling the inside of the bubble-generating region 607 is heated by the heat, thus generating the bubble 606 by film boiling. When the bubble 606 is generated, the pressure based on the generation of bubble 606 starts displacing the movable separation film 605 from the first position to the second position with propagation of bubble 606 (FIG. 34B).

An important point herein is that the flow resistance on the downstream side is greater than that on the upstream side so that the pressure components on the downstream side (on the discharge port side) of the center of area of the heat-generating member 602 preferentially act on the movable separation film 605 in the second liquid flow path 604, as described above.

Figure 34C:
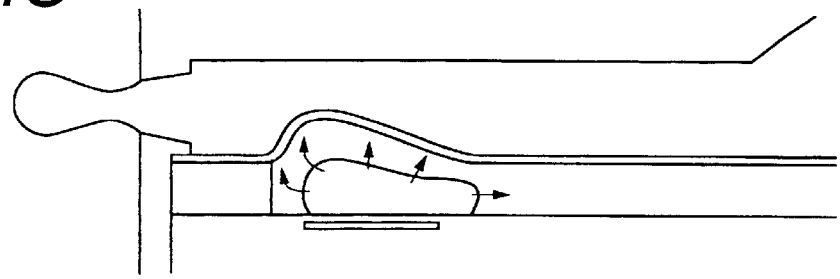

With further growth of bubble 606, the horizontal components out of the downstream pressure components become directed upward as being subject to the downstream flow resistance described above. This makes the most of the downstream pressure components preferentially act on the movable separation film 605, thereby further displacing the movable separation film 605 into the first liquid flow path 603. With this, the movable separation film 605 is inflated greatly toward the discharge port 601 (FIG. 34C).

Since the bubble 606 grows to downstream so as to inflate the movable separation film 605 greater toward the discharge port with gradual displacement of the downstream portion of the movable separation film 605 into the first liquid flow path 603 according to the growth of bubble 606 as described above, the pressure upon generation of bubble 606 is directed uniformly toward the discharge port 601. This enhances the discharge efficiency of liquid from the discharge port 601. In guiding the bubble-generating pressure to the discharge port 601, the movable separation film 605 rarely impedes transmission of the pressure, so that the propagating direction of pressure and the growing direction of bubble 606 can be controlled efficiently according to the magnitude of the propagating pressure.

Figure 34D:
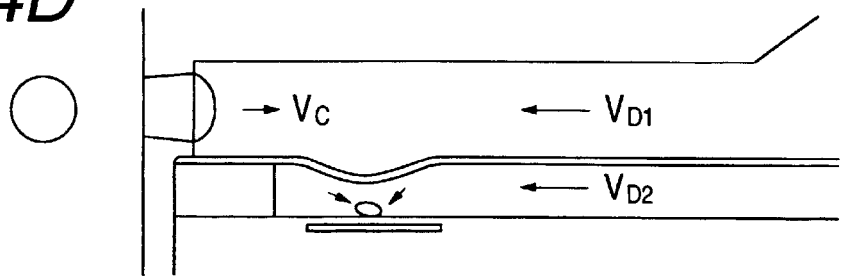

After that, when the bubble 606 contracts to disappear due to the decrease of internal pressure of bubble characteristic to the film boiling phenomenon described above, the movable separation film 605 having been displaced up to the second position is displaced into the second liquid flow path 604 over the first position because of the negative pressure due to the contraction of bubble 606 and thereafter it returns to the initial position (the first position) shown in FIG. 34A (FIG. 34D). Upon collapse of bubble, in order to compensate for the volume of liquid ejected, the liquid flows into the region as indicated by $V_{D1}$, $V_{D2}$ from upstream, i.e., from the common liquid chambers and as indicated by $V_c$ from the discharge port 401. The liquid also flows into the region from upstream in the second liquid flow path 604.

The structure of the liquid discharge apparatus described above will be described.

Figure 35:
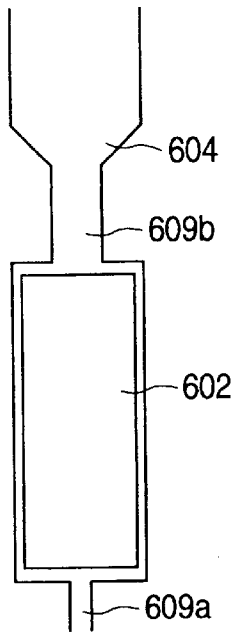
FIG. 35 is a top plan view of the second liquid flow path without the movable separation film, which is a drawing for explaining the structure of the second liquid flow path in the liquid discharge apparatus shown in FIG. 33 and FIGS. 34A, 34B, 34C and 34D.

FIG. 35 is a drawing for explaining the structure of the second liquid flow path 604 of the liquid discharge apparatus shown in FIG. 33 and FIGS. 34A to 34D, which is a top plan view of the second liquid flow path 604 without the movable separation film 605. The discharge port is located on the bottom side in the drawing.

The second liquid flow path 604 is provided with constricted portions 609*a*, 609*b* for the same purposes as in Embodiment 5, before and after the heat-generating member 602, thus forming such chamber (bubble-generating chamber) structure as to prevent the pressure upon generation of bubble from escaping through the second liquid flow path 604. Here, the constricted portions 609*a*, 609*b* of the second liquid flow path 604 are formed so that the opening portion on the downstream side (on the discharge port side) is narrower than the opening portion on the upstream side (on the common liquid chamber side). By making the opening portion narrower on the downstream side as described, the flow resistance in the second liquid flow path 604 can be made larger on the downstream side and smaller on the upstream side. This makes the downstream components of the pressure caused by the generation of bubble effectively and preferentially act on the movable separation film 605, so as to displace the movable separation film 605 into the first liquid flow path 603, whereby the liquid in the first liquid flow path 603 can be discharged at high efficiency and under high discharge force. The downstream constricted portion 609*a* of the bubble-generating chamber of the second liquid flow path 604 is a passage for extracting bubbles remaining in the bubble-generating chamber.

The shape of the second liquid flow path 604 may be determined in any shape that can effectively transmit the pressure upon generation of bubble to the movable separation film 605 without being limited to the above shape.

As described above, since in the structure of the present embodiment the flow resistance downstream of the center of the area of the heat-generating member is greater than that upstream thereof in the second liquid flow path whereby the movable separation film displaced by the pressure upon generation of bubble grows to downstream, the liquid weak against heat, the high-viscosity liquid, or the like can be discharged at high efficiency and under high discharge pressure.

(Embodiment 15)

Figure 36:
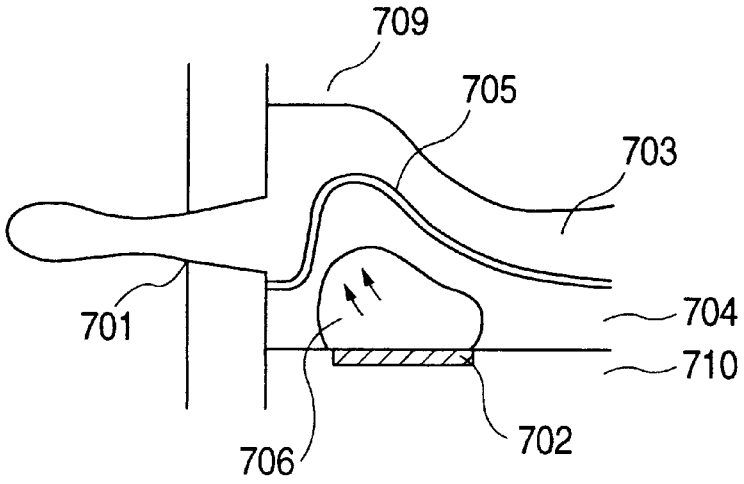
FIG. 36 is a cross-sectional view along the flow path direction to show the fifteenth embodiment of the liquid discharge apparatus according to the present invention, which shows a state upon generation of bubble.

FIG. 36 is a cross-sectional view along the flow path direction to show the fifteenth embodiment of the liquid discharge apparatus according to the present invention, which shows a state upon generation of bubble.

In the present embodiment, as shown in FIG. 36, the second liquid flow path 704 for bubble-generating liquid is provided on the substrate 710 provided with the heat-generating member 702 (the heating resistor member in the shape of 40 $\mu$m×105 $\mu$m in the present embodiment) for supplying the thermal energy for generating the bubble in the liquid, and the first liquid flow path 703 for discharge liquid in direct communication with the discharge port 701 is provided above it. Further, the movable separation film 705 made of a thin film with elasticity is provided between the first liquid flow path 703 and the second liquid flow path 704 and the movable separation film 705 separates the discharge liquid in the first liquid flow path 703 from the bubble-generating liquid in the second liquid flow path 704.

The most significant feature of the present embodiment is that the height of top plate 709 forming the first liquid flow path 703, i.e., the height of the first liquid flow path 703 in the projection area of the heat-generating member 702 is higher on the downstream side where the discharge port 701 exists than on the upstream side where the common liquid chamber (not illustrated) exists.

In the liquid discharge apparatus constructed as described above, when the heat-generating member 702 generates heat, the bubble 706 is generated thereby based on the film boiling phenomenon in the bubble-generating liquid. Here, the movable separation film 705 is displaced into the first liquid flow path 703 with generation of bubble 706, but, because the height of the first liquid flow path is higher on the downstream side than on the upstream side, the movable separation film 705 is displaced into the first liquid flow path 703 greater on the downstream side than on the upstream side. This guides the pressure due to the bubble 706 generated in the bubble-generating region to the discharge port 701.

The discharge operation of the liquid discharge apparatus constructed as described above will be described in detail.

FIGS. 37A to 37D are drawings for explaining the operation of the liquid discharge apparatus shown in FIG. 36.

Figure 37A:
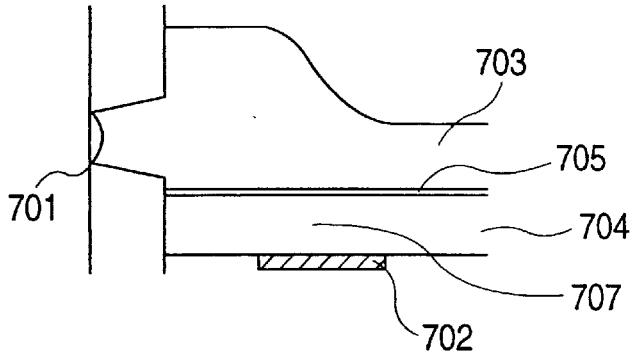
FIGS. 37A, 37B, 37C and 37D are drawings for explaining the operation of the liquid discharge apparatus shown in FIG. 36.

In FIG. 37A, the energy such as the electric energy is not applied to the heat-generating member 702 yet, so that no heat is generated in the heat-generating member 702. The movable separation film 705 is located at the first position nearly parallel to the substrate 710.

Figure 37B:
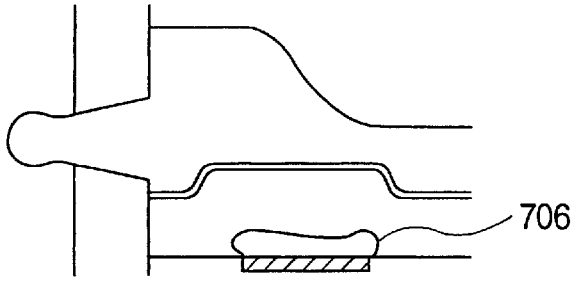

Here, when the electric energy or the like is applied to the heat-generating member 702, the heat-generating member 702 generates heat and part of the bubble-generating liquid filling the inside of the bubble-generating region 707 is heated thereby, thus generating the bubble 706 by film boiling. This totally displaces the portion of the movable separation film 705 facing the bubble-generating region 707 into the first liquid flow path 703 (FIG. 37B).

Figure 37C:
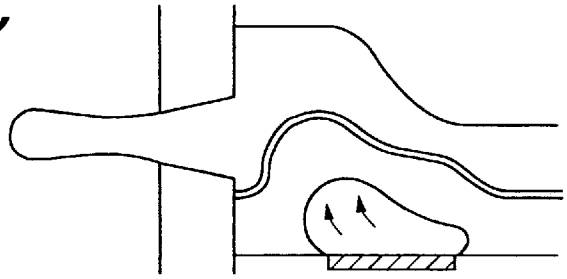

With further growth of bubble 706, the movable separation film 705 is displaced further into the first liquid flow path 703 up to the second position according to the pressure upon generation of bubble, whereupon, because the height of the first liquid flow path 703 is greater on the downstream side than on the upstream side, the movable separation film 705 is displaced more into the first liquid flow path 703 on the downstream side than on the upstream side (FIG. 37C). Therefore, a further increase in the discharge efficiency can be achieved.

Figure 37D:
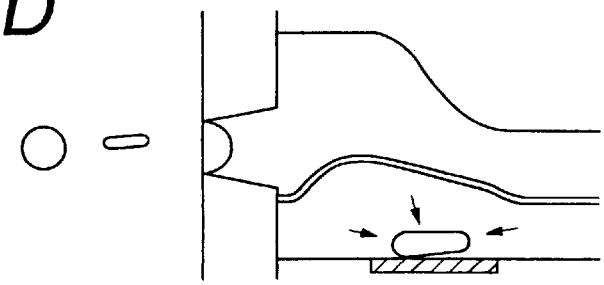

After that, when the bubble 706 contracts to disappear due to the decrease of internal pressure of bubble characteristic to the film boiling phenomenon described above, the movable separation film 705 having been displaced up to the second position gradually returns to the initial position (the first position) shown in FIG. 37A by the negative pressure due to the contraction of bubble 706 (FIG. 37D). Upon collapse of bubble, in order to compensate for the volume of the liquid ejected, the liquid flows into the area from upstream, i.e., from the common liquid chamber side and from the discharge port 701 side.

This can prevent the meniscus from being retracted by the decrease of volume of liquid due to the displacement into the first liquid flow path 703, caused when the movable separation film 705 is displaced back to the second liquid flow path 704. Therefore, the refilling time can be decreased.

(Embodiment 16)

Figure 38:
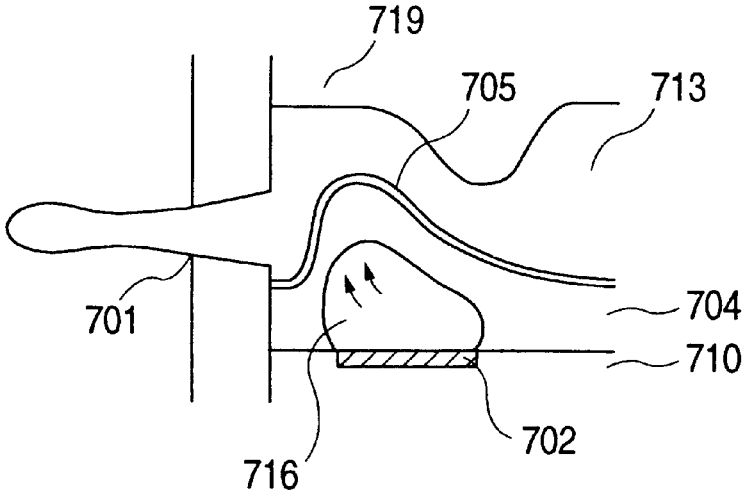
FIG. 38 is a cross-sectional view along the flow path direction to show the sixteenth embodiment of the liquid discharge method and the liquid discharge apparatus according to the present invention, which shows a state upon generation of bubble.

FIG. 38 is a cross-sectional view along the flow path direction to show the sixteenth embodiment of the liquid discharge method and the liquid discharge apparatus according to the present invention, which shows a state upon generation of bubble.

The present embodiment is different from that shown in FIG. 36 in the shape of the top plate 719, i.e., in the shape of the first liquid flow path 713, as shown in FIG. 38, and the other structure is the same.

The top plate 719 in the present embodiment is formed so that the height of the portion upstream of the space above the heat-generating member 702 is smaller than that of the other portions.

Here, the movable separation film 705 is displaced into the first liquid flow path 713 with generation of bubble 716 but, because the height of the first liquid flow path 713 in the portion upstream of the area above the heat-generating member 702 is smaller than that of the other portions, the movable separation film 705 is displaced more into the first liquid flow path 713 on the downstream side than on the upstream side. This guides the pressure due to the bubble 716 generated in the bubble-generating region to the discharge port 701. Since the flow resistance in the first liquid flow path 713 is higher upstream than downstream, the discharge efficiency is increased and the supply characteristics from upstream in the first liquid flow path are good, thereby further improving the refilling characteristics.

(Embodiment 17)

Figure 39:
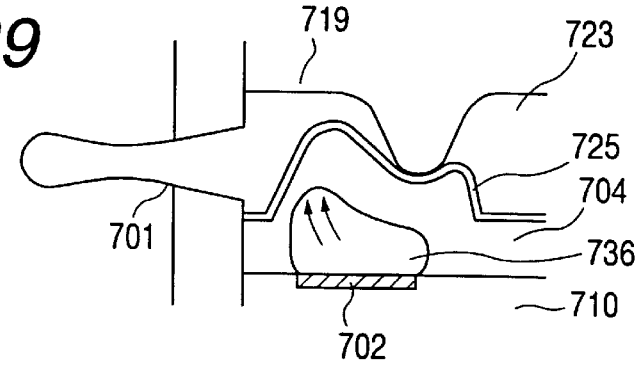
FIG. 39 is a cross-sectional view along the flow path direction to show the seventeenth embodiment of the liquid discharge method and the liquid discharge apparatus according to the present invention, which shows a state upon generation of bubble.

FIG. 39 is a cross-sectional view along the flow path direction to show the seventeenth embodiment of the liquid discharge method and the liquid discharge apparatus according to the present invention, which shows a state upon generation of bubble.

The present embodiment, as shown in FIG. 39, is different from that shown in FIG. 38 in that the movable separation film 729 comes to contact the low-height portion of the top plate 719 upon generation of bubble and the other structure is the same.

Here, the movable separation film 725 is displaced into the first liquid flow path 723 with generation of bubble 736, but, because the height of the first liquid flow path 723 in the portion upstream of the area above the heat-generating member 702 is smaller than that of the other portions, the movable separation film 725 is displaced more into the first liquid flow path 723 on the downstream side than on the upstream side. Then with further growth of bubble 736 the movable separation film 725 displaced into the first liquid flow path 723 comes to contact the low-height portion of the top plate 719 of the first liquid flow path 723, whereby the movable separation film 725 is deformed as depressed by the top plate 719. This further displaces the downstream portion of the movable separation film 725 greater into the first liquid flow path 723, thereby guiding the pressure due to the bubble 736 generated in the bubble-generating region to the discharge port 701. Since the part of the top plate 719 contacts the part of the movable separation film 725, the first liquid flow path 723 is separated into two on either side of the contact portion, which prevents crosstalk and which prevents the pressure upon generation of bubble from escaping to upstream, thus increasing the discharge efficiency.

(Embodiment 18)

Figure 40A:
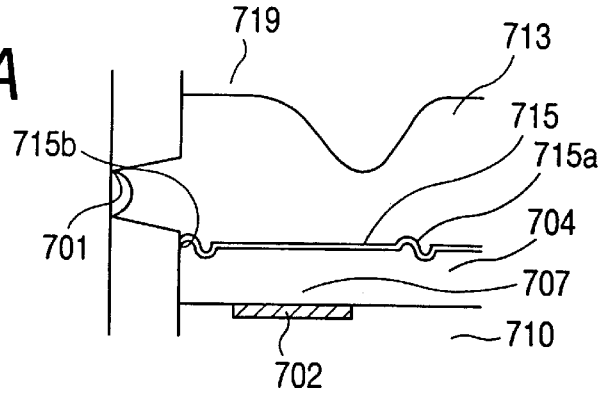
Figure 40B:
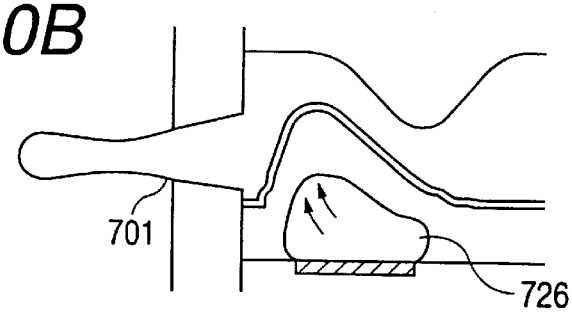

FIGS. 40A and 40B are cross-sectional views along the flow path direction to show the eighteenth embodiment of the liquid discharge method and the liquid discharge apparatus according to the present invention, wherein FIG. 40A is a drawing to show a state upon non-generation of bubble and FIG. 40B is a drawing to show a state upon generation of bubble.

The present embodiment, as shown in FIGS. 40A and 40B, is different only in the movable separation film 715 from that shown in FIG. 38 and the other structure is the same.

As shown in FIGS. 40A and 40B, the movable separation film 715 in the present embodiment has slack portions 715*a*, 715*b* upstream and downstream of the bubble-generating region 707 for generating the bubble on the heat-generating member 702, thus forming the structure with spring property.

Here, the movable separation film 715 is displaced into the first liquid flow path 713 with generation of bubble 726, but, because the height of the first liquid flow path 713 in the portion upstream of the region above the heat-generating member 702 is lower than that of the other portions, the movable separation film 715 is displaced more into the first liquid flow path 713 on the downstream side than on the upstream side. This guides the pressure due to the bubble 726 generated in the bubble-generating region 707 to the discharge port 701. Since the flow resistance in the first liquid flow path 713 is higher on the upstream side than on the downstream side, the refilling characteristics are improved. Since the present embodiment employs the structure wherein the movable separation film 715 is provided with the slack portions 715*a*, 715*b* upstream and downstream of the bubble-generating region 707 whereby the movable separation film 715 has the spring property, the movable separation film 715 becomes easier to be displaced by the pressure upon generation of bubble, thus increasing the discharge efficiency.

(Embodiment 19)

Figure 41:
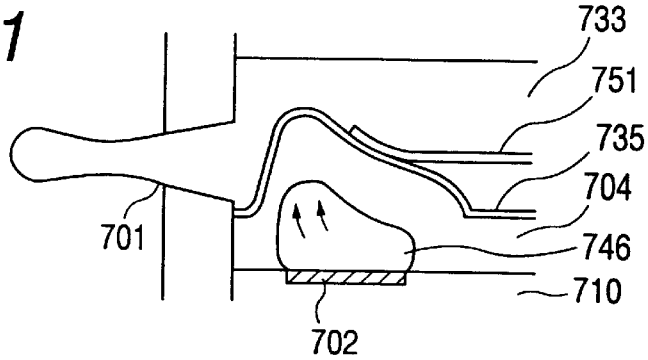
FIG. 41 is a cross-sectional view along the flow path direction to show the nineteenth embodiment of the liquid discharge method and the liquid discharge apparatus according to the present invention, which shows a state upon generation of bubble.

FIG. 41 is a cross-sectional view along the flow path direction to show the nineteenth embodiment of the liquid discharge method and the liquid discharge apparatus according to the present invention, which shows a state upon generation of bubble.

In the present embodiment, as shown in FIG. 41, the second liquid flow path 704 for bubble-generating liquid is provided on the substrate 710 provided with the heat-generating member 702 (the heating resistor member in the shape of 40 $\mu$m×105 $\mu$m in the present embodiment) for supplying the thermal energy for generating the bubble in the liquid, and the first liquid flow path 733 for discharge liquid in direct communication with the discharge port 701 is provided above it. Further, the movable separation film 735 made of a thin film with elasticity is provided between the first liquid flow path 733 and the second liquid flow path 704 and the movable separation film 735 separates the discharge liquid in the first liquid flow path 733 from the bubble-generating liquid in the second liquid flow path 704. In the first liquid flow path 733 the movable member 751 having a free end in the area above the heat-generating member 702 and a fulcrum upstream thereof is disposed nearly in parallel to the movable separation film 735 and at a predetermined distance from the movable separation film 735. The distance between the movable member 751 and the movable separation film 735 is set to be such a separation that the free end of the movable member 751 is pushed up by the movable separation film 735 when the movable separation film 735 is displaced into the first liquid flow path 733 by the pressure upon generation of bubble.

Here, the movable separation film 735 is displaced into the first liquid flow path 703 with generation of bubble 746. Once the upstream portion of the movable separation film comes to near or into contact with the movable member 751 with displacement of the movable separation film 735 into the first liquid flow path 733, the movable member 751 restricts the displacement of the upstream portion of the displaced portion of the movable separation film 735, so that the movable separation film 735 is displaced more into the first liquid flow path 733 on the downstream side than on the upstream side. This guides the pressure due to the bubble 746 generated in the bubble-generating region to the discharge port 701.

Since the present embodiment is arranged so that the action of the movable member 751 prevents excessive displacement of the movable separation film 735 and so that the movable member 751 and the movable separation film 735 are located the predetermined distance apart from each other upon non-generation of bubble, there is no resistance in the initial stage of displacement of the movable separation film 735, thus making reaction quicker.

The fifteenth to nineteenth embodiments described above were achieved noting the flow resistance of liquid above the movable area of the movable separation film and in the first liquid flow path.

(Embodiment 20)

Figure 42A:
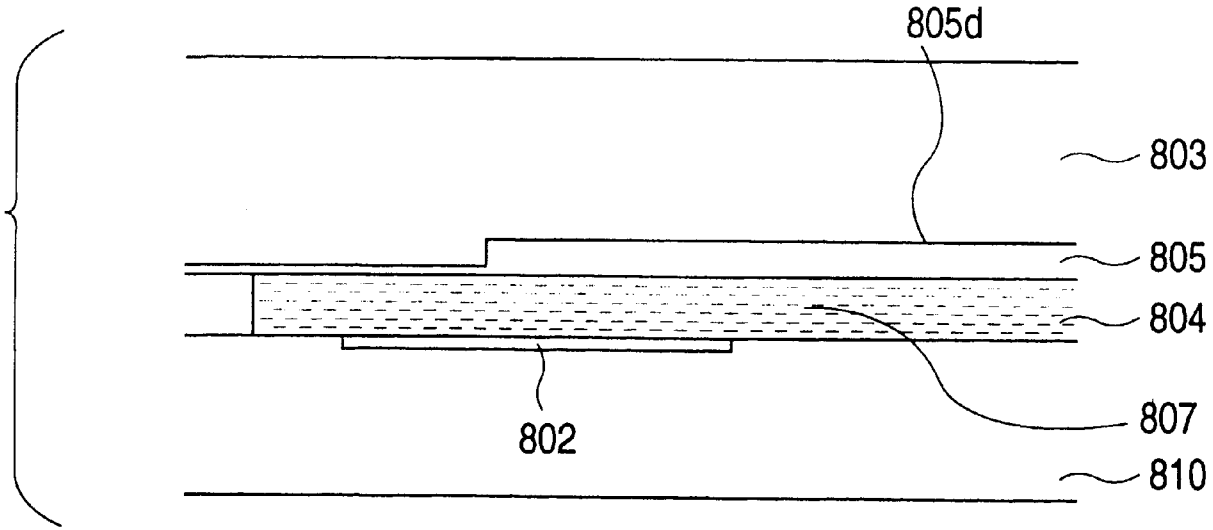
Figure 42B:
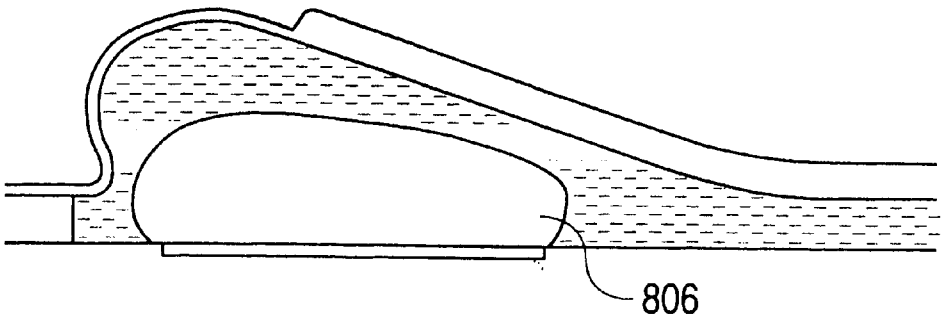

FIGS. 42A and 42B are cross-sectional, schematic views along the flow path direction to show the twentieth embodiment of the liquid discharge method and the liquid discharge apparatus according to the present invention, wherein FIG. 42A is a drawing to show a state upon non-discharge and FIG. 42B is a drawing to show a state upon discharge.

In the present embodiment, as shown in FIGS. 42A and 42B, the second liquid flow path 804 for bubble-generating liquid is provided on the substrate 810 provided with the heat-generating member 802 (the heating resistor member in the shape of 40 $\mu$m×105 $\mu$m in the present embodiment) for supplying the thermal energy for generating the bubble in the liquid, and the first liquid flow path 803 for discharge liquid in direct communication with the discharge port 801 is provided above it. The movable separation film 805 made of a thin film with elasticity is provided between the first liquid flow path 803 and the second liquid flow path 804 and separates the discharge liquid in the first liquid flow path 803 from the bubble-generating liquid in the second liquid flow path 804.

Here, the movable separation film 805 is made so that the thickness of the downstream side from the center of the heat-generating member 802 is smaller than the thickness of the upstream side therefrom in the portion located in the projection area above the surface of the heat-generating member 802, thereby operating to deform more to the discharge port 801 upon generation of bubble (FIG. 42B).

The shape of the movable separation film 805 may be any shape that can direct the pressure upon generation of bubble toward the discharge port efficiently, without having to be limited to that shown in FIGS. 42A and 42B.

The bubble-generating region 807 is defined between the heat-generating member 802 and the movable separation film 805.

When the heat-generating member 802 generates heat, the bubble is generated thereby based on the film boiling phenomenon in the bubble-generating liquid. The pressure based on the generation of bubble preferentially acts on the movable separation film 805, so that the movable separation film 805 is displaced greater toward the discharge port 801, as shown in FIG. 42B. This guides the pressure due to the bubble generated in the bubble-generating region 807 to the discharge port 801.

As described above, since the structure of the present embodiment is such that in the projection area above the surface of the heat-generating member in the movable separation film the thickness of the downstream side from the center of the heat-generating member is smaller than the thickness of the upstream side therefrom, the pressure positively acts on the thin portion in the movable separation film displaced by the pressure upon generation of bubble, so as to inflate the movable separation film toward the discharge port, whereby the liquid can be discharged at high discharge efficiency and under high discharge pressure.

(Embodiment 21)

Figure 43A:
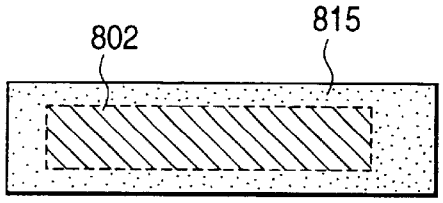
Figure 43B:
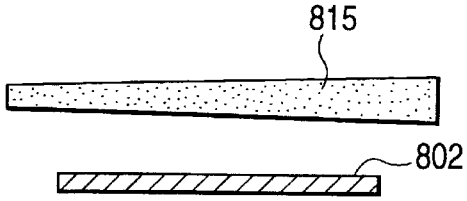

FIGS. 43A and 43B are cross-sectional views along the flow path direction to show the twenty first embodiment of the liquid discharge apparatus according to the present invention, wherein FIG. 43A is a lateral, cross-sectional view and FIG. 43B is a longitudinal, cross-sectional view. In the drawing the discharge port is located on the left side thereof.

The movable separation film 815 in the present embodiment gradually decreases its thickness from upstream toward downstream where the discharge port is provided. The movable separation film 815 is made of urethane resin.

The process for fabricating the movable separation film 815 in the present embodiment will be described.

First, the release agent is applied onto a mirror wafer of silicon, thereafter it is subjected to spin coating with liquid urethane resin to form a film approximately 3 $\mu$m thick, and then solvent therein is evaporated to make the film thinner.

Then this film is peeled off from the mirror wafer, the rear end (upstream) thereof is fixed onto the substrate in which the second liquid flow path described above is formed, thereafter the film is pulled toward the discharge port so as to make the thickness of the tip portion of film equal to 1 $\mu$m, and the film is bonded to the substrate, thus forming the movable separation film on the substrate.

By making the movable separation film 815 in this way, the movable separation film 815 naturally deforms toward the discharge port with growth of bubble, so that the discharge force can be used for discharge of liquid efficiently. Since the movable separation film 815 in the present embodiment is excellent in response to the growth of bubble, it can also be applied to high-speed discharge. Since high position accuracy is not required in bonding of the movable separation film 815, fabrication of the liquid discharge apparatus becomes easier.

Another fabrication process of the movable separation film 815 in the present embodiment will be described.

First, the release agent is applied onto the mirror wafer of silicon, thereafter the mirror wafer is immersed in the liquid urethane resin, and it is lifted up slowly. The film thickness can be increased gradually by gradually decreasing the lifting speed of mirror wafer on that occasion. After that, the solvent is evaporated to make the film thinner.

Then this film is peeled off from the mirror wafer, the film is positioned on the substrate in which the second liquid flow path described above is formed, and it is bonded to the substrate, thus forming the movable separation film on the substrate.

By fabricating the movable separation film 815 in this way, the movable separation film 815 naturally deforms toward the discharge port with growth of bubble, so that the discharge force can be used for discharge of liquid efficiently. Since the movable separation film 815 in the present embodiment is excellent in response to growth of bubble, it can also be applied to high-speed discharge.

(Embodiment 22)

Figure 44A:
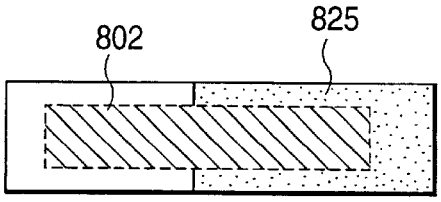
Figure 44B:
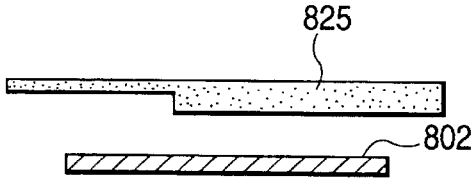

FIGS. 44A and 44B are cross-sectional views along the flow path direction to show the twenty second embodiment of the liquid discharge apparatus according to the present invention, wherein FIG. 44A is a lateral, cross-sectional view and FIG. 44B is a longitudinal, cross-sectional view. In the drawing the discharge port is located on the left side thereof.

As shown in FIGS. 44A and 44B, the movable separation film 825 in the present embodiment is formed so that the thickness of the downstream side thereof is smaller than that of the upstream side thereof with respect to the border at a predetermined position on the downstream side where the discharge port is provided, from the center of the heat-generating member 802. The movable separation film 825 is made of the polyimide resin.

The fabrication process of the movable separation film 825 in the present embodiment will be described.

FIGS. 45A to 45E are drawings for explaining the fabrication process of the movable separation film 825 shown in FIGS. 44A and 44B.

Figure 45A:
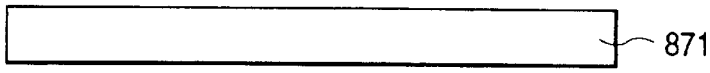
FIGS. 45A, 45B, 45C, 45D and 45E are drawings for explaining a process for producing the movable separation film shown in FIGS. 44A and 44B.
Figure 45B:
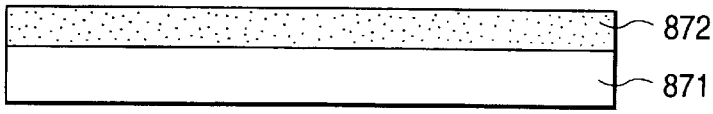

First, the release agent is applied onto the mirror wafer 871 of silicon as shown in FIG. 45A and thereafter it is subjected to spin coating with liquid polyimide resin to form a film thereof approximately 2 $\mu$m thick (FIG. 45B).

Figure 45C:
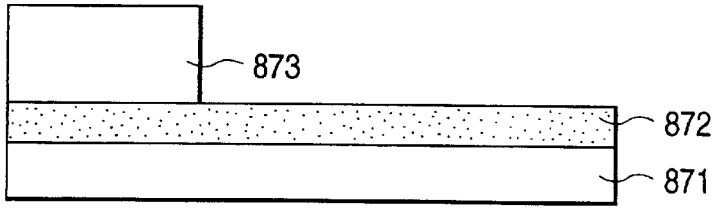

Then the film 872 is cured by ultraviolet irradiation and resist 873 10 $\mu$m thick is patterned thereon (FIG. 45C).

Figure 45D:
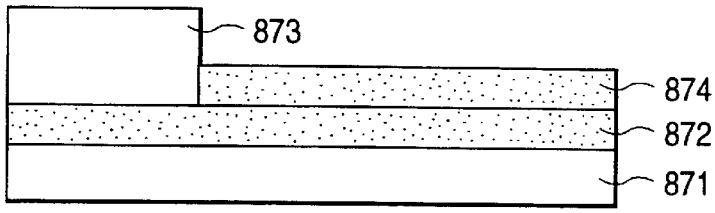

Next, further spin coating is carried out to form film 874 2 $\mu$m thick of the polyimide resin (FIG. 45D).

Figure 45E:
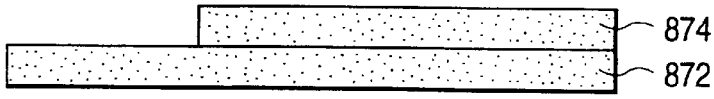

After that, the film 874 is cured by ultraviolet irradiation, the films 872, 874 thus formed are peeled off from the mirror wafer 871, then they are positioned on the substrate in which the second liquid flow path described above is formed, and the films are bonded to the substrate, thus forming the movable separation film on the substrate (FIG. 45E).

The films 872, 874 may be made of respective materials different from each other. Another process may be arranged so that the film 872 is made separately from the film 874 and they are joined with each other in the assembling stage so as to achieve the form as in the present embodiment.

By fabricating the movable separation film 825 in this way, the movable separation film 825 naturally deforms toward the discharge port with generation of bubble, whereby the discharge force can be used for discharge of liquid efficiently. Since the movable separation film 825 in the present embodiment is excellent in response to growth of bubble, it can also be applied to high-speed discharge.

(Embodiment 23)

Figure 46A:
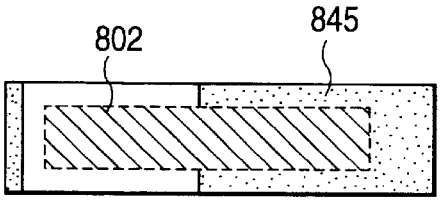
Figure 46B:
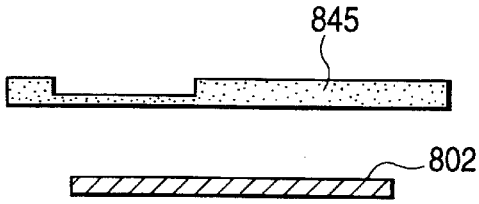

FIGS. 46A and 46B are cross-sectional views along the flow path direction to show the twenty third embodiment of the liquid discharge apparatus according to the present invention, wherein FIG. 46A is a lateral, cross-sectional view and FIG. 46B is a longitudinal, cross-sectional view. In the drawing the discharge port is located on the left side thereof.

As shown in FIGS. 46A and 46B, the movable separation film 835 in the present embodiment is formed so that the thickness of the downstream side thereof is smaller than the thickness of the upstream side thereof with respect to the border at a predetermined position on the downstream side where the discharge port is provided, from the center of the heat-generating member 802 and so that the thickness of the downstream side is greater than the thickness of the upstream side with respect to the border at a predetermine position on the further downstream side of the downstream edge of the heat-generating member 802. The movable separation film 835 is made of the polyimide resin.

The fabrication process of the movable separation film 835 in the present embodiment will be described.

FIGS. 47A to 47E are drawings for explaining the process for producing the movable separation film shown in FIGS. 46A and 46B.

Figure 47A:
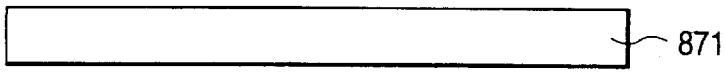
FIGS. 47A, 47B, 47C, 47D and 47E are drawings for explaining a process for producing the movable separation film shown in FIGS. 46A and 46B.
Figure 47B:
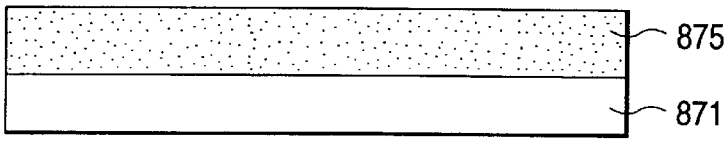

First, the release agent is applied onto the mirror wafer 871 of silicon as shown in FIG. 47A, thereafter it is subjected to spin coating with liquid polyimide resin to form a film approximately 3 μm thick, and the film is cured by ultraviolet irradiation (FIG. 47B).

Then patterned resist 876 was formed over non-etching portions on the film 875 approximately 3 μm thick described above. The resist was OFPR800 (available from Tokyo Ohka Sha).

Figure 47C:
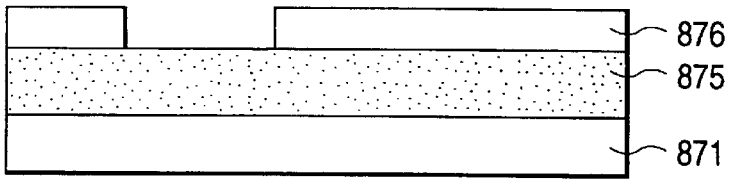

The resist 876 was applied in the thickness of 6 μm and pre-baked at 100° C. Exposure was carried out using PLA600 available from CANON INC. and in the exposure dose of 450 mJ. Development was carried out using the developer of MND-3 (available from Tokyo Ohka Sha) and thereafter post-baking was carried out at 120° C. (FIG. 47C).

Figure 47D:
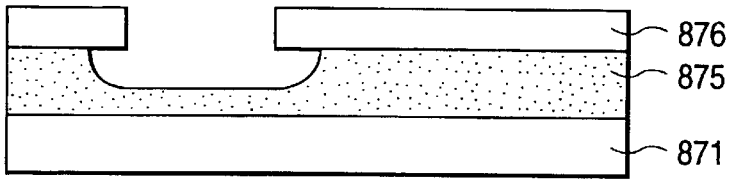

Then the film 875 of the polyimide resin was etched only by the thickness of 2 μm. The etching was carried out with MAS-800 available from CANON INC. and under such conditions as the substrate temperature of 50° C., microwave power of 500 W, oxygen flow rate of 200 sccm, and pressure of 100 Pa (FIG. 47D).

Then, for removing the resist 876, the wafer was immersed in remover 1112-A (available from Shipley Far East Ltd.) and ultrasonic wave was applied thereto, thereby removing the resist 876.

Figure 47E:
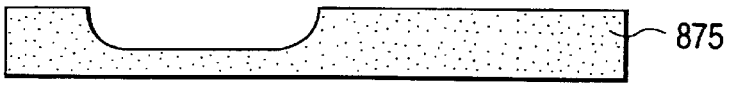

After that, the film 875 of the polyimide resin was peeled off from the mirror wafer 871, it was positioned on the substrate in which the second liquid flow path described above was formed, and it was bonded to the substrate, thus forming the movable separation film on the substrate (FIG. 47E).

By fabricating the movable separation film 835 in this way, the movable separation film 835 naturally deforms toward the discharge port with growth of bubble, whereby the discharge force can be used for discharge of liquid efficiently. Since the movable separation film 835 in the present embodiment is excellent in response to growth of bubble, it can also be applied to high-speed discharge.

Figure 48A:
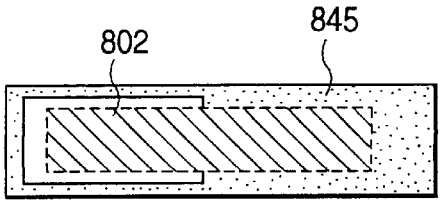
Figure 48B:
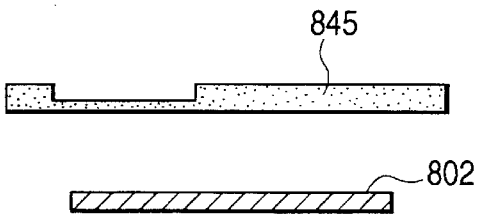

FIGS. 48A and 48B are drawings to show a similar form of the movable separation film shown in FIGS. 46A and 46B and FIGS. 47A to 47E, wherein FIG. 48A is a lateral, cross-sectional view and FIG. 48B is a longitudinal, cross-sectional view. In the drawing the discharge port is disposed on the left side thereof.

As shown in FIGS. 48A and 48B, the thin portion having the smaller film thickness may be formed every liquid flow path in the similar form of the movable separation film shown in FIGS. 46A and 46B and FIGS. 47A to 47E. This arrangement makes the bubble-generating pressure concentrated toward the discharge port efficiently.

(Embodiment 24)

Figure 49A:
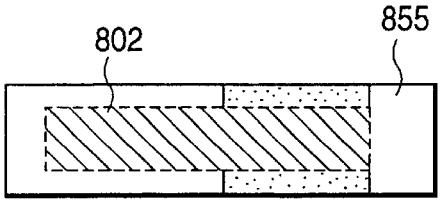
Figure 49B:
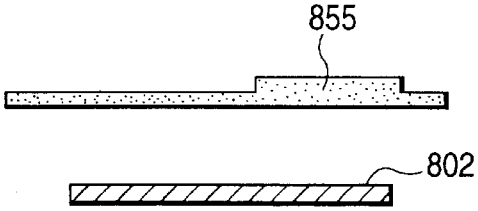

FIGS. 49A and 49B are cross-sectional views along the flow path direction to show the twenty fourth embodiment of the liquid discharge apparatus according to the present invention, wherein FIG. 49A is a lateral, cross-sectional view and FIG. 49B is a longitudinal, cross-sectional view. In the drawing the discharge port is disposed on the left side thereof.

As shown in FIGS. 49A and 49B, the movable separation film 855 in the present embodiment is formed so that the thickness of the downstream side thereof is smaller than the thickness of the upstream side thereof with respect to the border at a predetermined position on the upstream side from the center of the heat-generating member 802 and so that the thickness of the downstream side thereof is lager than the thickness of the upstream side thereof with respect to the border at the downstream edge of the heat-generating member 802. The movable separation film 855 is made of the polyimide resin and it was fabricated by the same process as in the twenty second embodiment.

By fabricating the movable separation film 855 in this way, the movable separation film 855 naturally deforms toward the discharge port with growth of bubble, whereby the discharge force can be used for discharge of liquid efficiently. Since the movable separation film 855 in the present embodiment is excellent in response to growth of bubble, it can also be applied to high-speed discharge.

The thin portion having the smaller film thickness may be formed every liquid flow path in a similar form of the present embodiment. This arrangement makes the bubble-generating pressure concentrated to the discharge port efficiently.

(Embodiment 25)

Figure 50A:
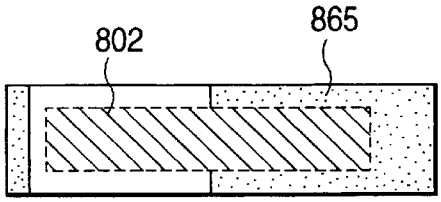
Figure 50B:
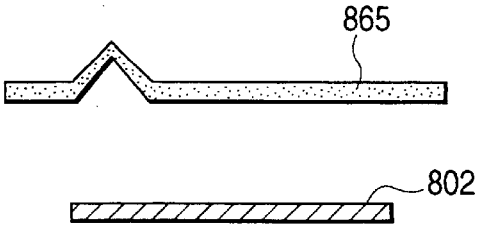

FIGS. 50A and 50B are cross-sectional views along the flow path direction to show the twenty fifth embodiment of the liquid discharge apparatus according to the present invention, wherein FIG. 50A is a lateral, cross-sectional view and FIG. 50B is a longitudinal, cross-sectional view. In the drawing the discharge port is located on the left side thereof.

As shown in FIGS. 50A and 50B, the movable separation film 865 in the present embodiment has a portion decreasing its thickness toward downstream from the center of heat-generating member 802. The movable separation film 865 is made of the polyimide resin.

The fabrication process of the movable separation film 865 in the present embodiment will be described.

FIGS. 51A to 51D are drawings for explaining the fabrication process of the movable separation film 865 shown in FIGS. 50A and 50B.

Figure 51A:
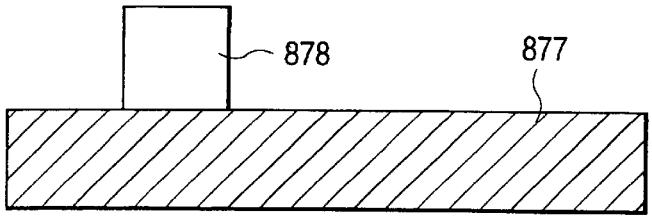
FIGS. 51A, 51B, 51C and 51D are drawings for explaining a process for producing the movable separation film shown in FIGS. 50A and 50B.
Figure 51B:
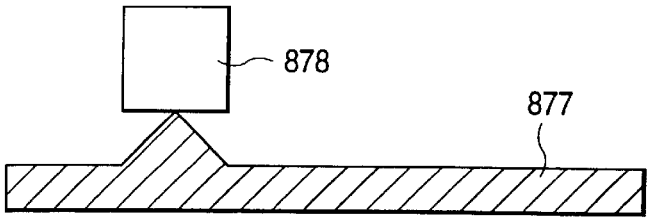

First, a part on silicon substrate 877 to be a matrix mold is masked using silicon oxide 878 of a rod shape 4 μm square (FIG. 51A) and anisotropic etching is carried out thereon (FIG. 51B).

Figure 51C:
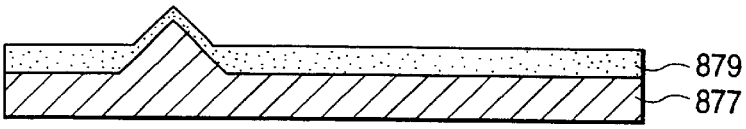

Then the release agent is applied onto the silicon substrate 877, thereafter it is subjected to spin coating with liquid polyimide resin to form film 879 approximately 3 μm thick, and the film is cured by ultraviolet irradiation (FIG. 51C).

Figure 51D:
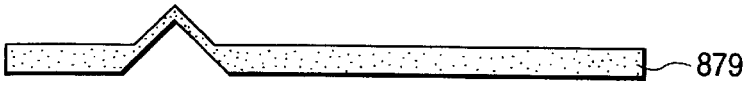

After that, the film 879 is peeled off from the silicon substrate 877, it is positioned on the substrate in which the second liquid flow path described above is formed, and it is bonded to the substrate, thus forming the movable separation film on the substrate (FIG. 51D).

By fabricating the movable separation film 865 in this way, the movable separation film 865 naturally deforms toward the discharge port with growth of bubble, whereby the discharge force can be used for discharge of liquid efficiently. Since the movable separation film 865 in the present embodiment is excellent in response to the growth of bubble, it can also be applied to high-speed discharge.

Also, the thin portion having the smaller film thickness may be fabricated every liquid flow path in a similar form of the present embodiment. This arrangement makes the bubble-generating pressure concentrated toward the discharge port efficiently.

The present invention was described using the discharge method for discharging the liquid in the direction parallel to the flow direction of liquid in the first liquid flow path in the all embodiments described above, but the present invention, without having to be limited to the above discharge method, can also be applied to the discharge method for discharging the liquid in the direction perpendicular to the flow direction of the liquid in the first liquid flow path, provided that the discharge port is provided downstream of the region for generating the bubble.

Figure 52A:
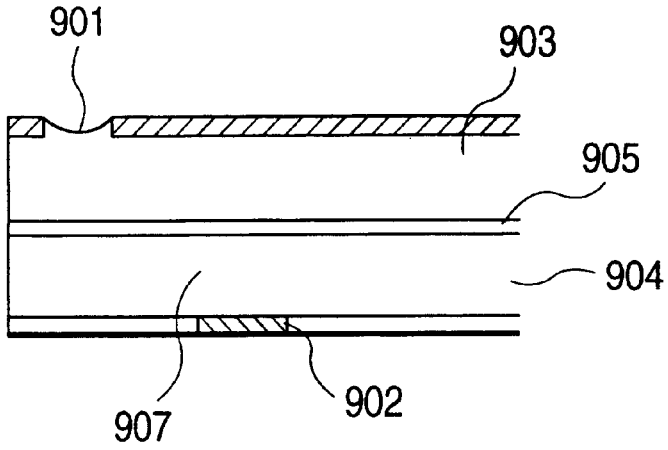
Figure 52B:
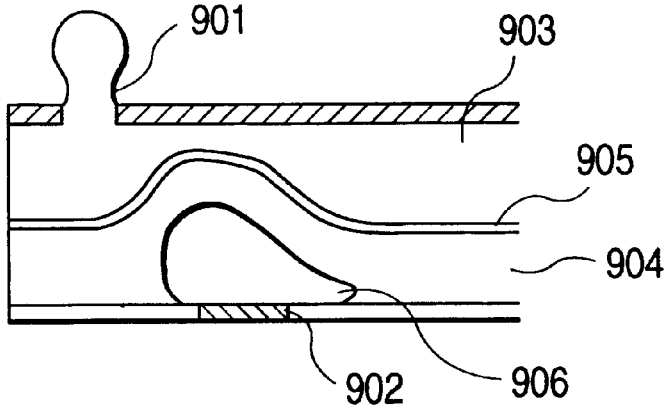

FIGS. 52A and 52B are cross-sectional views along the flow path direction to show an example in which the present invention is applied to the arrangement wherein the discharge port is located downstream of the bubble-generating region so as to discharge the liquid in the direction perpendicular to the flow direction of the liquid in the first liquid flow path, wherein FIG. 52A is a drawing to show a state upon non-generation of bubble and FIG. 52B is a drawing to show a state upon generation of bubble.

As shown in FIGS. 52A and 52B, the same effects can be achieved by employing the structure of each embodiment described above in the arrangement wherein the discharge port 901 is located in the direction perpendicular to the flow direction of the liquid in the first liquid flow path 903, if the discharge port 901 is located downstream of the bubble-generating region 907.

In the present invention, the liquid in the first liquid flow path can be discharged efficiently from the discharge port with generation of bubble, because the downstream portion of the movable separation film is displaced relatively greater toward the discharge port than the upstream portion of the movable separation film with respect to the flow direction of the liquid.

What is claimed is:

1. A liquid discharging method for discharging liquid from a discharge port by displacing, using a bubble generated at a bubble generation area, a continuous movable separation film that does not have an end near the bubble generation area, the continuous movable separation film substantially separating from each other a first liquid flow path communicating with the discharge port for discharging the liquid and a second liquid flow path having the bubble generation area, said method comprising the steps of:

generating a bubble in the bubble generation area; and displacing the continuous movable separation film substantially without stretch in accordance with said generating step to discharge the liquid from the discharge port, wherein, when the bubble is not generated, at least a part of the continuous movable separation film projects into the second liquid flow path.

2. A liquid discharging method according to claim 1, wherein the discharge port is provided downstream of the bubble generation area with respect to a flow direction of the liquid in the first liquid flow path.

3. A liquid discharging method according to claim 2, wherein the liquid is discharged in a direction parallel to the flow direction.

4. A liquid discharging method according to claim 1, wherein the liquid is discharged in a direction perpendicular to the flow direction.

5. A liquid discharging method according to claim 1, wherein the movable separation film has a maximum volume caused by displacement of a convex portion, and the maximum volume is less than a maximum expansion of the bubble.

6. A liquid discharging method according to claim 1, wherein a distance by which the movable separation film projects into the first liquid flow path or the second liquid flow path increases moving downstream along a length of the movable separation film toward the discharge port.

7. A liquid discharging head comprising:

a first liquid flow path communicating with a discharge port for discharging liquid;

a second liquid flow path having a bubble generation area for generating a bubble in the liquid; and a continuous movable separation film substantially separating from each other said first liquid flow path and said second liquid flow path, the continuous movable separation film being displaced by the bubble generated at the bubble generation area to discharge the liquid from the discharge port, wherein the continuous movable separation film comprises a thin film without substantial elasticity and does not have an end near the bubble generation area, and when the bubble is not generated, at least a part of the continuous movable separation film projects into said second liquid flow path.

8. A liquid discharging head according to claim 7, wherein the discharge port is provided downstream of the bubble generation area with respect to a flow direction of the liquid in said first liquid flow path.

9. A liquid discharging head according to claim 8, wherein the liquid is discharged in a direction parallel to the flow direction.

10. A liquid discharging head according to claim 7, wherein the liquid is discharged in a direction perpendicular to the flow direction.

11. A liquid discharging head according to claim 7, wherein said movable separation film has a maximum volume caused by displacement of a convex portion, and the maximum volume is less than a maximum expansion of the bubble.

12. A liquid discharging head according to claim 7, wherein a distance by which said movable separation film projects into said first liquid flow path or said second liquid flow path increases moving downstream along a length of said movable separation film toward the discharge port.

13. A liquid discharging apparatus comprising:

a liquid discharging head according to claim 7;

a first liquid supply path for supplying a first liquid to the first liquid flow path; and a second liquid supply path for supplying a second liquid to the second liquid flow path.

* * * * *